US008107324B2

(12) United States Patent
Kojima

(10) Patent No.: US 8,107,324 B2
(45) Date of Patent: Jan. 31, 2012

(54) HAND POSITION DETECTING DEVICE AND METHOD

(75) Inventor: Tadashi Kojima, Musashino (JP)

(73) Assignee: Casio Computer Co., Ltd., Tokyo (JP)

( * ) Notice: Subject to any disclaimer, the term of this patent is extended or adjusted under 35 U.S.C. 154(b) by 607 days.

(21) Appl. No.: 12/341,470

(22) Filed: Dec. 22, 2008

(65) Prior Publication Data

US 2009/0161120 A1 Jun. 25, 2009

(30) Foreign Application Priority Data

Dec. 25, 2007 (JP) ..... 2007-331355

(51) Int. Cl.
*G04B 19/04* (2006.01)
*G04B 19/02* (2006.01)

(52) U.S. Cl. ..... 368/80; 368/220

(58) Field of Classification Search ..... 368/73, 368/74, 76, 80, 185, 17, 220, 228
See application file for complete search history.

(56) References Cited

U.S. PATENT DOCUMENTS 4,358,753 A * 11/1982 Cascini ..... 341/2
4,645,357 A 2/1987 Allgaier
5,270,993 A * 12/1993 Besson et al. ..... 368/80
5,457,664 A 10/1995 Izukawa et al.
5,640,007 A 6/1997 Talbott et al.
5,734,474 A 3/1998 Haecker et al.
5,999,495 A 12/1999 Hashizume et al.
6,288,977 B1 9/2001 Yoshida
6,367,967 B1 4/2002 Kojima et al.
6,424,600 B1 7/2002 Okeya et al.
6,473,366 B2 * 10/2002 Peng ..... 368/47
6,473,367 B2 * 10/2002 Peng ..... 368/47
6,731,571 B2 5/2004 Yiu
6,804,173 B2 10/2004 Yiu
6,807,128 B2 10/2004 Yiu
7,154,818 B2 12/2006 Liu
RE40,370 E 6/2008 Sato et al.
2002/0095226 A1 7/2002 Suzuki et al.
2002/0167869 A1 11/2002 Masuda et al.

(Continued)

FOREIGN PATENT DOCUMENTS

EP 2042947 A1 4/2009

(Continued)

OTHER PUBLICATIONS

Extended European Search Report dated Jul. 7, 2010 (in English) issued in European Application No. 09161225.9, which is an European counterpart of *related* U.S. Appl. No. 12/473,750.

(Continued)

*Primary Examiner* — Vit Miska
(74) *Attorney, Agent, or Firm* — Holtz, Holtz, Goodman & Chick, PC

(57) ABSTRACT

A hand position detecting device stops optical detection of the respective rotational positions of seconds, center and hour hands when such detection is impossible. When it is determined that the respective positions of the hands have not been detected successively a predetermined number of times, the detection of the hand positions is stopped until a predetermined time, for example 5 minutes before 11 o'clock or 55 minutes past 10 o'clock. This prevents unnecessary repetition of detection of the hand positions and hence useless consumption of battery energy which would otherwise occur.

8 Claims, 30 Drawing Sheets

U.S. PATENT DOCUMENTS

| | | | | |
|---|---|---|---|---|
| 2004/0120220 | A1 | 6/2004 | Ogasawara | |
| 2004/0120221 | A1* | 6/2004 | Ogasawara et al. | 368/80 |
| 2004/0120223 | A1* | 6/2004 | Luk | 368/220 |
| 2004/0125702 | A1* | 7/2004 | Kitajima et al. | 368/80 |
| 2006/0114750 | A1 | 6/2006 | Iida et al. | |
| 2009/0016172 | A1 | 1/2009 | Fujii et al. | |
| 2009/0086580 | A1 | 4/2009 | Aoki et al. | |
| 2009/0086581 | A1 | 4/2009 | Suizu et al. | |
| 2009/0296533 | A1 | 12/2009 | Kojima | |
| 2009/0296534 | A1 | 12/2009 | Kojima et al. | |

FOREIGN PATENT DOCUMENTS

| | | | |
|---|---|---|---|
| GB | 2 270 398 | A | 3/1994 |
| JP | 6-222164 | A | 8/1994 |
| JP | 2000-162336 | A | 6/2000 |
| JP | 2002-71847 | A | 3/2002 |
| JP | 2002-107465 | A | 4/2002 |
| JP | 2002-116270 | A | 4/2002 |
| JP | 2002-357678 | A | 12/2002 |
| JP | 2003-194971 | A | 7/2003 |
| JP | 2004-184088 | A | 7/2004 |
| JP | 2004-257816 | A | 9/2004 |
| JP | 2006-046924 | A | 2/2006 |
| JP | 2006-153652 | A | 6/2006 |
| JP | 2006-275803 | A | 10/2006 |
| JP | 3872688 | B2 | 10/2006 |
| WO | WO 2007/102412 | A1 | 9/2007 |

OTHER PUBLICATIONS

Japanese Office Action dated Nov. 10, 2009 and English translation thereof issued in a counterpart Japanese Application No. 2007-253830 of *related* U.S. Appl. No. 12/238,090.

Extended European Search Report dated Mar. 6, 2009, 4 pages, issued in counterpart European Application No. EP 08021912.4-1240.

Japanese Office Action dated Jun. 1, 2010 (and English translation thereof) issued in Japanese Application No. 2008-139127, which is a Japanese counterpart of *related* U.S. Appl. No. 12/472,515.

Japanese Office Action dated Mar. 16, 2010 and English translation thereof issued in counterpart Japanese Application No. 2007-331355.

U.S. Appl. No. 12/472,515, filed May 27, 2009.

U.S. Appl. No. 12/473,750, filed May 28, 2009.

* cited by examiner

FIG.6

| 1ST DRIVING SYSTEM: SECONDS HAND TRAIN WHEELS | | | | | |
|---|---|---|---|---|---|
| GEAR TYPE | GEAR: PINION | NUMBER OF GEAR TEETH (Z) | ROTATIONAL ANGLE | NUMBER OF PULSES REQUIRED FOR ONE ROTATION OF GEAR | DETECTION APERTURE |
| ROTOR | PINION | 10 | 180 | 2 | |
| FIFTH WHEEL | GEAR | 50 | 36 | 10 | |
| | PINION | 10 | | | |
| SECONDS WHEEL | GEAR | 60 | 6 | 60 | ● |

| 2ND DRIVING SYSTEM: HOUR/CENTER TRAIN GEARS | | | | | |
|---|---|---|---|---|---|
| GEAR TYPE | GEAR: PINION | NUMBER OF GEAR TEETH (Z) | ROTATIONAL ANGLE | NUMBER OF PULSES REQUIRED FOR ONE ROTATION OF GEAR | DETECTION APERTURE |
| ROTOR | PINION | 10 | 180 | 2 | |
| INTERMEDIATE WHEEL | GEAR | 60 | 30 | 12 | ● |
| | PINION | 8 | | | |
| THIRD WHEEL | GEAR | 60 | 4 | 90 | |
| | PINION | 16 | | | |
| CENTER WHEEL | GEAR | 64 | 1 | 360 | ● |
| | PINION | 20 | | | |
| MINUTE WHEEL | GEAR | 60 | 1/3 | 1080 | |
| | PINION | 16 | | | |
| HOUR WHEEL | GEAR | 64 | 1/12 | 4320 | ● |

DETECTED PATTERN FOR SECONDS WHEEL

FIG.27

| DISPLAY OF HAND POSITION DETECTION ERRORS | |
|---|---|
| ERROR TYPE | STOP POSITION OF SECONDS HAND |
| ERROR NO. 0 (HAND POSITION IS CORRECT) | 55 SECONDS POSITION |
| ERROR NO. 1 | 3 SECONDS POSITION |
| ERROR NO. 2 | 6 SECONDS POSITION |
| ERROR NO. 3 | 9 SECONDS POSITION |
| ERROR NO. 4 | 12 SECONDS POSITION |
| ERROR NO. 5 | 15 SECONDS POSITION |
| ERROR NO. 6 | 18 SECONDS POSITION |
| ERROR NO. 7 | 21 SECONDS POSITION |
| ERROR NO. 8 | 24 SECONDS POSITION |
| ERROR NO. D | 39 SECONDS POSITION |
| ERROR NO. E | 42 SECONDS POSITION |

HAND POSITION DETECTING DEVICE AND METHOD

CROSS-REFERENCE TO RELATED APPLICATIONS

This application is based upon and claims the benefit of priority from the prior Japanese Patent Application No. 2007-331355, filed on Dec. 25, 2007, the entire contents of which are incorporated herein by reference.

BACKGROUND OF THE INVENTION

1. Field of the Invention

The present invention relates to a hand position detecting device and method which detects the rotational positions of seconds, center and hour hands.

2. Description of the Related Art

In the past, a hand position detecting device which detects the rotational positions of hands of a timepiece is known, as disclosed by Japanese Published Unexamined Application 2000-162336. This device comprises a first drive system in which a first drive motor transmits its rotation to a seconds wheel which in turn causes a seconds hand to sweep around a dial, a second drive system in which a second drive motor transmits its rotations to the center and hour wheels to cause the seconds and hour hands, respectively, to sweep around the dial. This device also includes a photosensor which, when the seconds, center and hour wheels of the first and second drive systems are rotated after pointing to the same direction on the same axis, optically detects, with the aid of a light emission element and a photo detection element included in the photosensor, a first, a second and a third light-passing apertures provided in the seconds, center and hour wheels, respectively, such that the respective rotational positions of the seconds, center and hour wheels and hence the seconds, center and hour hands are determined based on detected signals from the photosensor.

However, in this apparatus, the moving positions of the seconds, center and hour hands are only determined. Thus, when it is determined that these hands move around the dial correctly, they are required to continue to do so normally. However, when the positions of the seconds, minute and hour hands cannot be detected, such detection tends to be repeatedly many times, thereby consuming a significant amount of battery power.

It is therefore an object of the present invention to provide a hand position detecting apparatus and method for stopping the detection of the hand positions when the seconds, center and hour hand positions cannot be detected, thereby preventing useless power consumption.

SUMMARY OF THE INVENTION

In one aspect, the present invention provides a hand position detecting device having a plurality of hand wheels each with a corresponding hand, each hand wheel having at least one light-passing aperture therein, the device comprising:

an optical detection unit configured to detect passage of light through a plurality of light-passing apertures in the plurality of hand wheels, each aperture included in the at least one aperture in a respective one of the hand wheels;

a position detecting unit configured to optically detect the respective positions of the hand wheels on the basis of a transmitted state of light detected by the optical detection unit; and an optical detection controlling unit configured to count the number of times the position detecting unit has successively failed to detect the positions of the hand wheels, determine if the counted number of times is equal to, or has exceeded, a predetermined number of times, and stop, if so, the position detecting unit from detecting the hand wheel positions for a time period ranging from when the position detection controlling unit has determined that the position detecting unit has successively failed to detect the positions of the hands the predetermined number of times to a predetermined time.

In another aspect, the present invention provides a hand position detecting device having a plurality of hand wheels each with a corresponding hand, each hand wheel having at least one light-passing aperture therein, the device comprising: an optical detection unit configured to detect passage of light through a plurality of light-passing apertures in the plurality of hand wheels, each aperture included in the at least one aperture in a respective one of the hand wheels; a position detecting unit configured to optically detect the respective positions of the hand wheels on the basis of a transmitted state of light detected by the optical detection unit; a position detection error reporting unit responsive to the position detecting unit failing to detect the positions of the hand wheels, configured to report to a user a hand position detection error indicating that the position detecting unit has failed to detect the positions of the hand wheels; and an optical detection controlling unit configured to determine if the position detecting unit has failed to detect the positions of the hand wheels successively a predetermined number of times, and configured to stop the position detecting unit from detecting the respective hand wheel positions for a time period ranging from when the optical detection controlling unit has determined that the position detecting unit has failed to detect the positions of the hands successively the predetermined number of times to a predetermined time.

In a further aspect, the present invention provides a hand position detecting device having a plurality of hand wheels each with a corresponding hand, each hand wheel having at least one light-passing aperture therein, the device comprising: an optical detection unit configured to detect passage of light through a plurality of light-passing apertures in the plurality of hand wheels, each aperture included in the at least one aperture in a respective one of the hand wheels; a position detecting unit configured to optically detect the respective positions of the hand wheels on the basis of a transmitted state of light detected by the optical detection unit; an optical detection controlling unit configured to determine if a position detection error indicating that the position detecting unit has failed to detect the respective positions of the hand wheels is produced successively a predetermined number of times, and configured to stop, if so, the position detecting unit from detecting the respective positions of the hand wheels for a time period ranging from when the optical detection controlling unit has determined that the position detection error has been produced successively the predetermined number of times to a predetermined time; and an operation unit configured to operably select one of a normal hand rotating mode in which the hands are rotated normally and an error display mode in which the contents of the hand position detection error are displayed.

In accordance with the invention, when the position detecting unit has failed to detect the positions of the hand wheels successively the predetermined number of times, the optical detection controlling unit stops the position detecting unit from detecting the position detection until the predetermined time. That is, the detection of the hand wheel positions is not required to be repeated unnecessarily many times and useless consumption of the battery power is prevented.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 6 shows details of components of each of first and second driving systems of FIG. 2, the operational conditions of the components, etc.

FIGS. 11A-11P show a basic position detecting operation of the seconds, hour and intermediate wheels of FIG. 5, wherein FIGS. 11A-11M illustrate the respective states of these wheels obtained when the center wheel is rotated sequentially one step (or 12 degrees) at a time, FIG. 11P shows the state of these wheels at an "11-o'clock 00-minute position" obtained when the center wheel is rotated one hour from the state of FIG. 11O.

FIGS. 15A-15F illustrate a relationship between the respective operational positions which the seconds, center and hour wheels assume at every two seconds.

FIG. 27 shows a table of hand position detection errors.

DETAILED DESCRIPTION OF THE INVENTION

Figure 1:
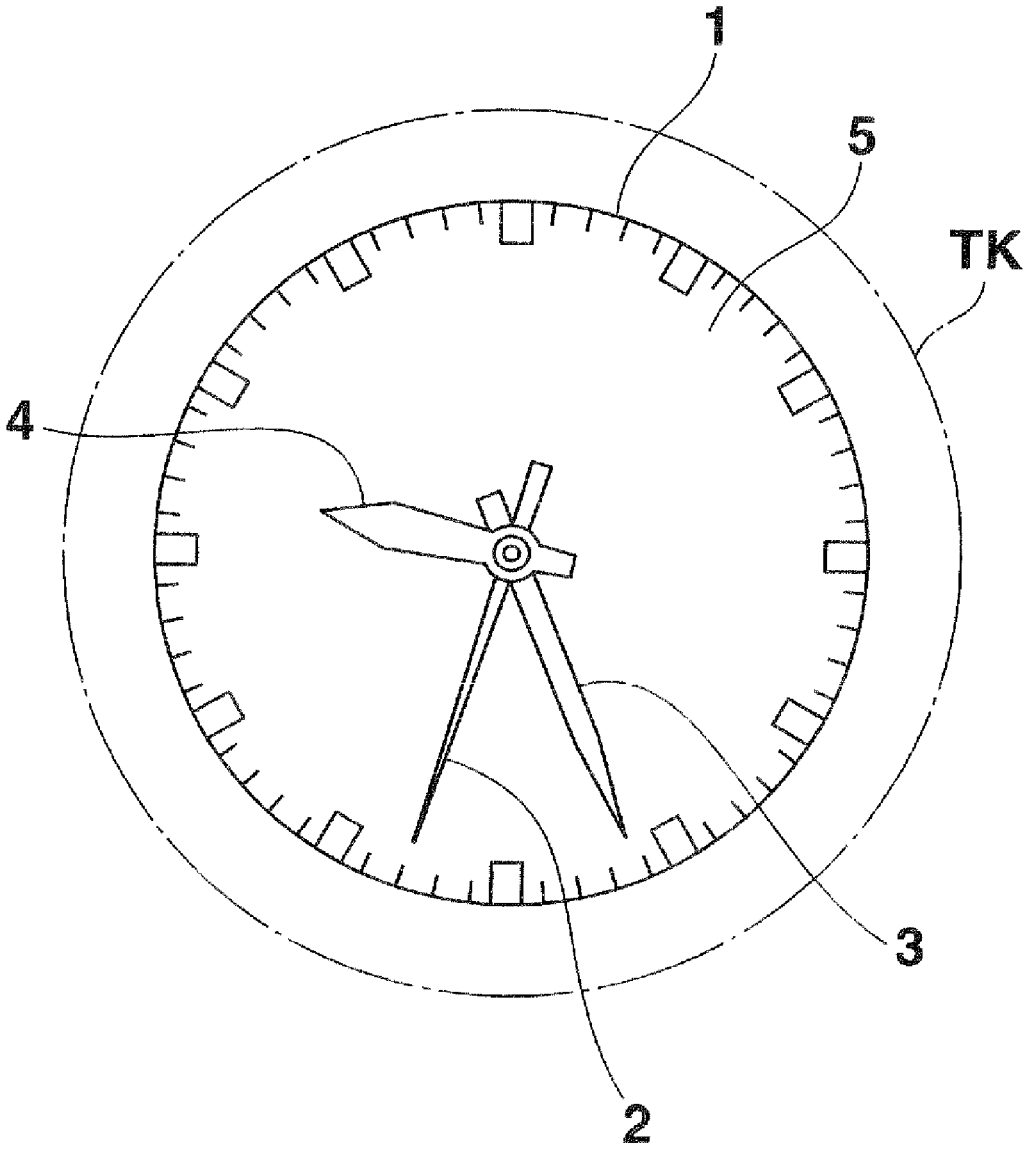
FIG. 1 is a plan view of a watch module of a hand type wristwatch according to one embodiment of the present invention.

Referring to FIGS. 1-27, description will be made of a hand type wristwatch according to one embodiment of the present invention. This wristwatch comprises a watch module 1 of FIGS. 1 and 2, which in turn comprises a seconds hand 2, a center hand 3 and an hour hand 4 which are driven around a dial 5 to indicate time and is encased within a case TK with glass (not shown) on top of the case, which is covered at its bottom with a case back UB.

Figure 2:
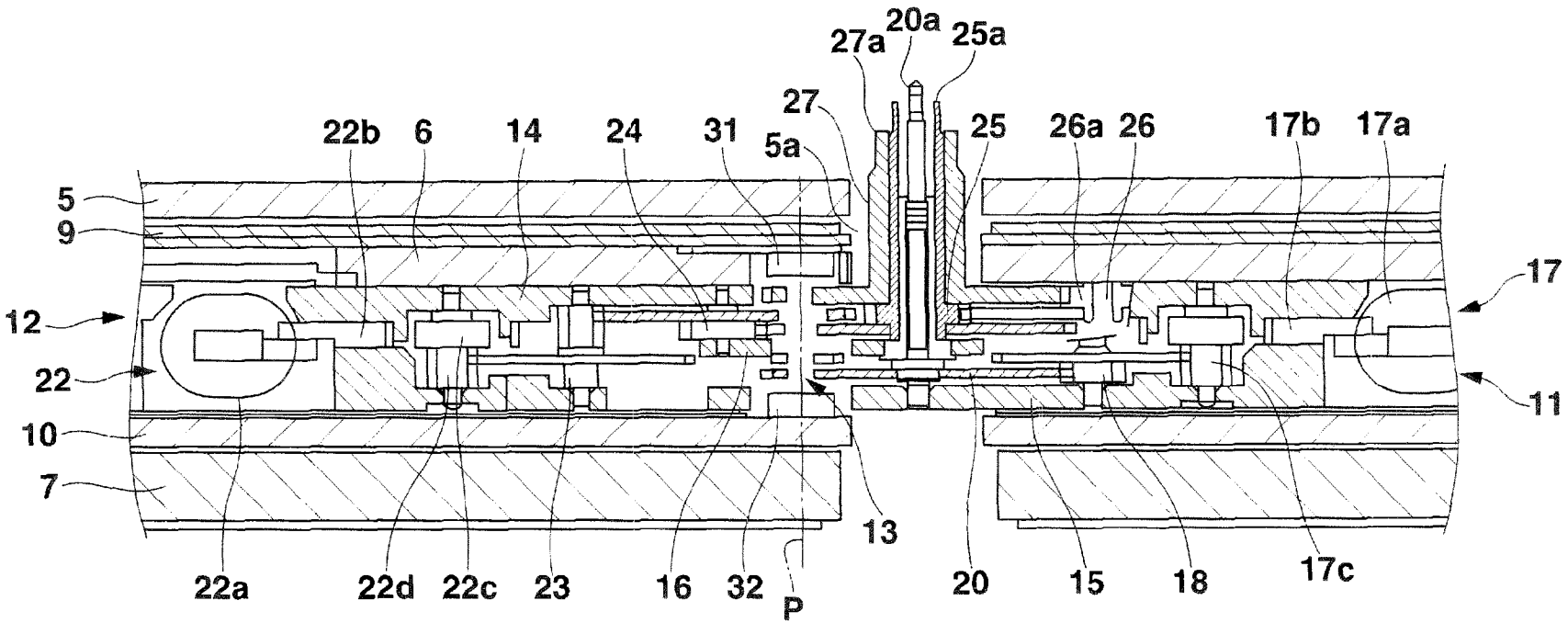
FIG. 2 is an enlarged cross-sectional view of an essential portion of the watch module of FIG. 1.

As shown in FIG. 2, the watch module 1 has an upper housing 6 and a lower housing 7 between which a watch movement 8 is provided. The dial 5 is provided on top of the upper housing 6 through a solar panel 9. A circuit board 10 is provided within the lower housing 7.

Figure 3:
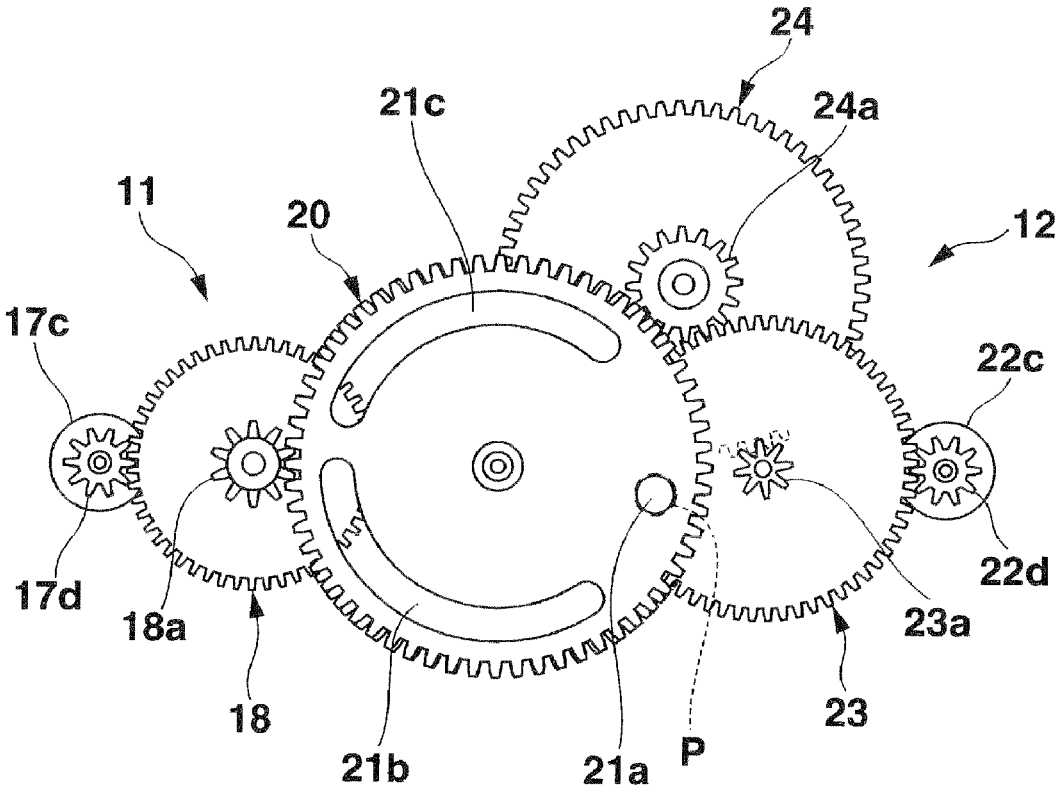
FIG. 3 is an enlarged bottom view of an essential portion of a watch movement of FIG. 2.
Figure 4:
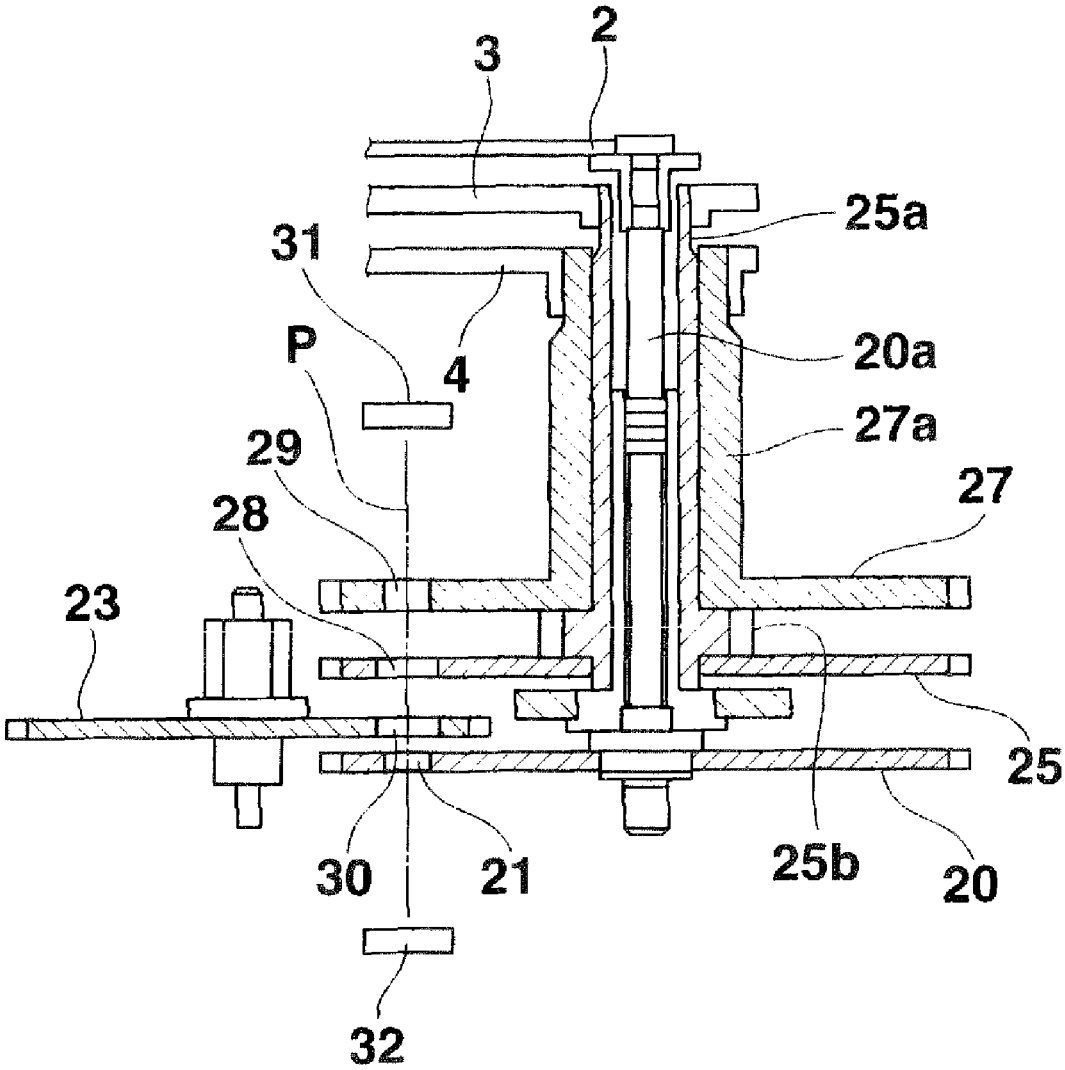
FIG. 4 is an enlarged cross-section view of an essential portion of FIG. 2.

As shown in FIGS. 2-4, the watch movement 8 comprises a first driving system 11 which drives the seconds hand 2, a second driving system 12 which drives the center and hour hands 3 and 4, and a detection unit 13 that detects the rotational positions of the seconds, center and hour hands 2, 3 and 4. The first and second driving systems 11 and 12 are attached to a main plate 14, a train wheel bridge 15 and a center wheel bridge 16 between the upper and lower housings 6 and 7.

As shown in FIGS. 2-4, the first driving system 11 comprises a first stepping motor 17, a fifth wheel 18 rotated by the first stepping motor 17, a fourth or seconds (hand) wheel 20 which is rotated by the fifth wheel 18. The seconds hand 2 is attached to a seconds hand shaft 20*a* (FIG. 4). As shown in FIG. 2, the first stepping motor 17 comprises a coil block 17*a*, a stator 17*b* and a rotor 17*c*. When a required current flows through the coil block 17*a*, a magnetic field will be produced, thereby rotating the rotor 17*c* 180 degrees at a time.

Figure 5:
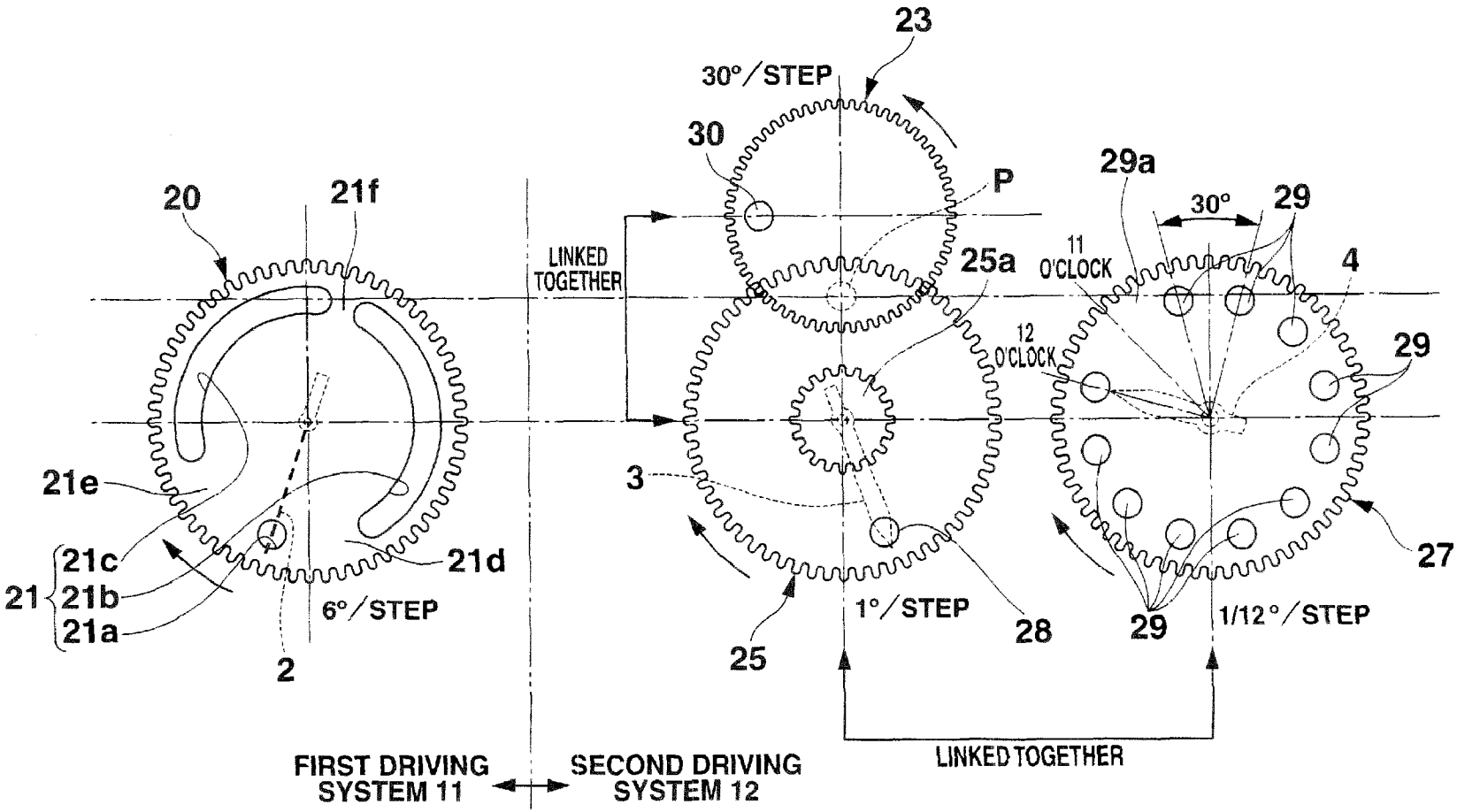
FIG. 5 is an enlarged exploded plan view of an assembly of a seconds, a center and an hour wheel of FIG. 3.
Figure 7:
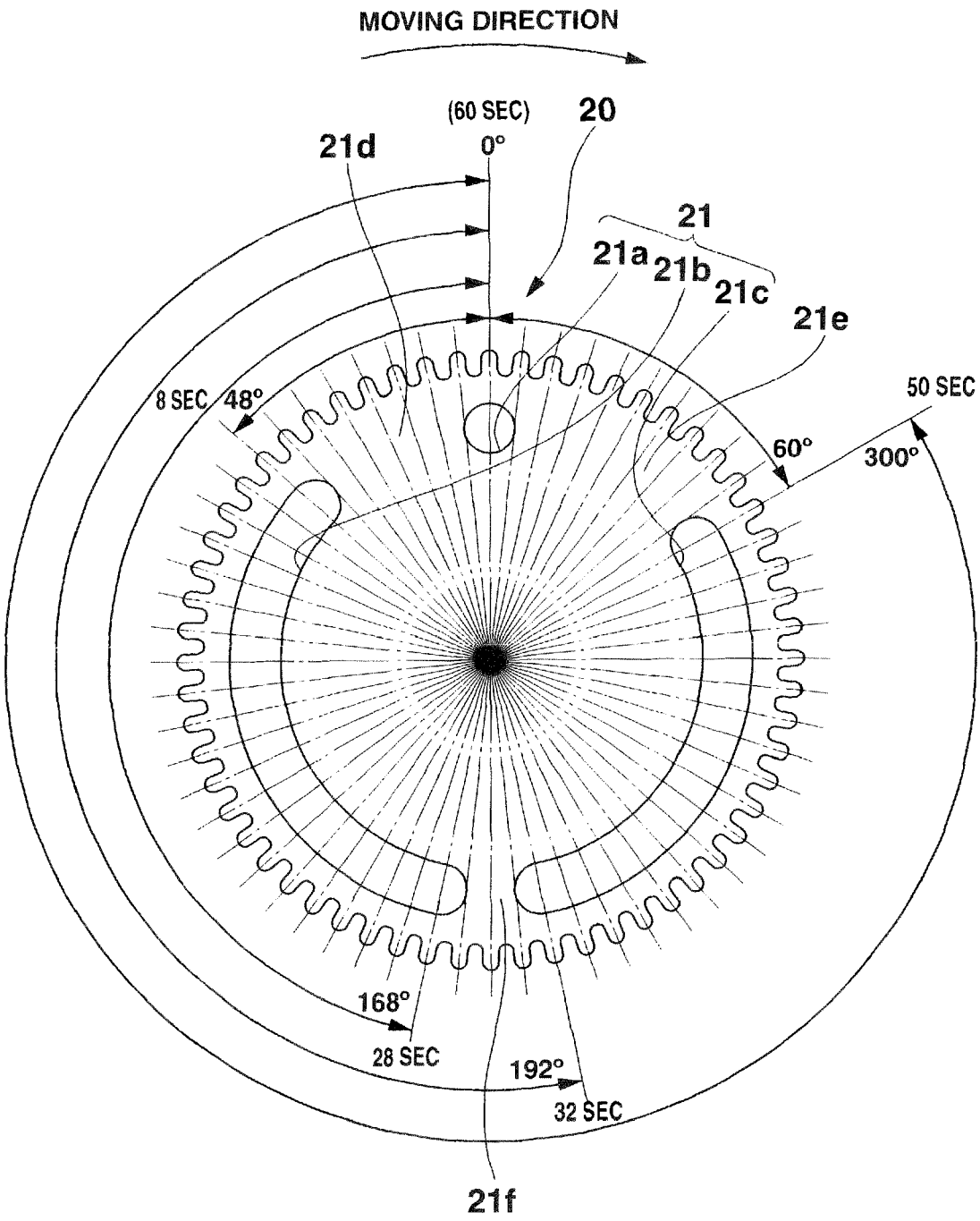
FIG. 7 is an enlarged plan view of the seconds wheel of FIG. 5.

As shown in FIGS. 2 and 3, the fifth wheel 18 rotates, meshing with a pinion 17*d* of the rotor 17*c* of the first stepping motor 17. The seconds wheel 20 rotates, meshing with a pinion 18*a* of the fifth wheel 18. As shown in FIG. 2, the seconds hand shaft 20*a* extends upward through aligned apertures 5*a* in the seconds wheel 20, upper housing 6, solar panel 9 and dial 5. As shown in FIG. 4, the seconds hand 2 is attached to a top of the seconds hand shaft 20*a*. As shown in FIGS. 5 and 7, the seconds wheel 20 has a first light-passing aperture 21 including a first circular aperture 21*a*, a second arcuate aperture 21*b* and a third arcuate aperture 21*c*.

As shown in FIGS. 2-5, the second driving system 12 comprises a second stepping motor 22, an intermediate wheel 23 which is rotated by the second stepping motor 22, a third wheel 24 which is rotated by the intermediated wheel 23, a second or center (hand) wheel 25 rotated by the third wheel 24, a minute wheel 26 which is rotated by the center wheel 25, and an hour (hand) wheel 27 which is rotated by the minute wheel 26. The center hand 3 is attached to a shaft 25*a* of the center wheel 25 and the hour hand 4 to a shaft 27*a* of the hour wheel 27.

As shown in FIG. 2, the second stepping motor 22 comprises a coil block 22*a*, a stator 22*b* and a rotor 22*c*. When a required current flows through the coil block 22*a*, a magnetic field will be produced, thereby rotating the rotor 22*c* 180 degrees at a time. As shown in FIGS. 2 and 3, the intermediate wheel 23 rotates, meshing with a pinion 22*d* of the second stepping motor rotor 22*c*. As shown in FIG. 5, the intermediate wheel 23 has a fourth circular light-passing aperture 30. The third wheel 24 rotates, meshing with a pinion 23*a* of the intermediate wheel 23. The center wheel 25 rotates, meshing with a pinion 24*a* of the third wheel 24.

As shown in FIGS. 2 and 4, the center wheel 25 has at its center an upright hollow cylindrical shaft 25*a* through which the shaft 20*a* of the seconds wheel 20 extends rotatably. As shown in FIG. 2, the center hand shaft 25*a* extends upward through the common apertures 5*a* provided in the upper housing 6, solar panel 9 and dial 5. As shown in FIG. 4, the center hand 3 is attached to a top of the center hand shaft 25*a* with the center wheel 25 disposed on the same axis as the seconds wheel 20 above the same. As shown in FIG. 5, the center wheel 25 has a (second) light-passing aperture 28.

As shown in FIG. 2, the minute wheel 26 rotates, meshing with a pinion 25*b* of the center wheel 25. The hour wheel 27 rotates, meshing with a pinion 26*a* of the minute wheel 26. The hour wheel 27 has at its center an upward protruding hollow cylindrical shaft 27*a* through which the shaft 25*a* of the center wheel 25 in turn extends rotatably. As shown in FIG. 2, the hour hand shaft 27*a* extends upward through the apertures 5*a* provided in the upper housing 6, solar panel 9 and dial 5. As shown in FIG. 4, the hour hand 4 is attached to a top of the hour hand shaft 27*a* with the hour wheel 27 disposed above the center wheel 25 on the same axis as the seconds wheel 20 and center wheel 25. As shown in FIG. 5, the hour wheel 27 has a plurality of (fourth) circular light-passing apertures 29 provided at predetermined intervals along the periphery thereof.

FIG. 6 shows details of components of each of the first and second driving systems 11 and 12, the drive conditions of the components, etc. The rotor pinion 17*d* of the first driving system 17 rotates 180 degrees or one step per pulse. The fifth wheel 18 rotates 36 degrees per pulse (or per step of the rotor 17*c* rotation). The seconds wheel 20 rotates 6 degree per pulse (or per step of the rotor 17*c* rotation) and hence makes one rotation with 60 pulses (or in 60steps of the rotor 17*c* rotation).

The pinion 22*d* of the rotor 22 of the second driving system 12 rotates 180 degrees or one step per pulse. The intermediate wheel 23 rotates 30 degrees per pulse (or per step of the rotor 22*c* rotation), thereby making one rotation with 12 pulses (in 12 steps of the rotor 22*c* rotation). The third wheel 24 rotates 4 degrees per pulse (or per step of the rotor 22*c* rotation). The center wheel 25 rotates one degree per pulse (or per step of the rotor 22*c* rotation), and makes one rotation with 360 pulses (in 360 steps of the rotor 22*c* rotation). The minute wheel 26 rotates ⅓ degrees per pulse (per step of the rotor 22*c* rotation). The hour wheel 27 rotates 1/12 degrees per pulse (per step of the rotor 22*c* rotation) and hence makes one rotation with 4320 pulses (in 4320 steps of the rotor 22*c* rotation).

As shown in FIG. 2, a detection unit 13 is provided which comprises a light emission element 31, which includes a light emitting diode, and a photo detection element 32, which includes a phototransistor. The light emission element 31 and the photodetection element 32 are attached to the upper housing 6 and the circuit board 10, respectively. The arrangement is such that when one of the light-passing apertures 21*a*, 21*b* and 21*c* in the seconds wheel 20; the aperture 28 in the center 25; one of the apertures 29 in the hour wheel 27; and the aperture 30 in the intermediate wheel 23, respectively, align wholly or partially with an optical path or detection position P, which is set at the noontime or 0-o'clock 00-minute 00-seconds position in this embodiment, between the light emission and detection elements 31 and 32, the photo detection element 32 receives light from the light emission element 31 through those apertures, thereby detecting the respective rotational positions of the seconds, center and hour wheels 20, 25 and 27. The position of the optical path or detection position P is not limited to the specified example, but may be another position such as, for example, an 11-o'clock 55-minute position.

As shown in FIG. 7, in the seconds wheel 20 the circular aperture 21*a* is provided at a reference or 00-second position, and the arcuate apertures 21*b* and 21*c* are provided on the opposite sides of the circular aperture 21*a* along the periphery of the seconds wheel 20 so as to be spaced by first and second light blocking areas 21*d* and 21*e* of different lengths, respectively, from the circular aperture 21*a*. A third light blocking area 21*f* formed between the arcuate apertures 21*b* and 21*c* is diametrically opposed to the circular aperture 21*a* in the seconds wheel 20.

Figure 25:
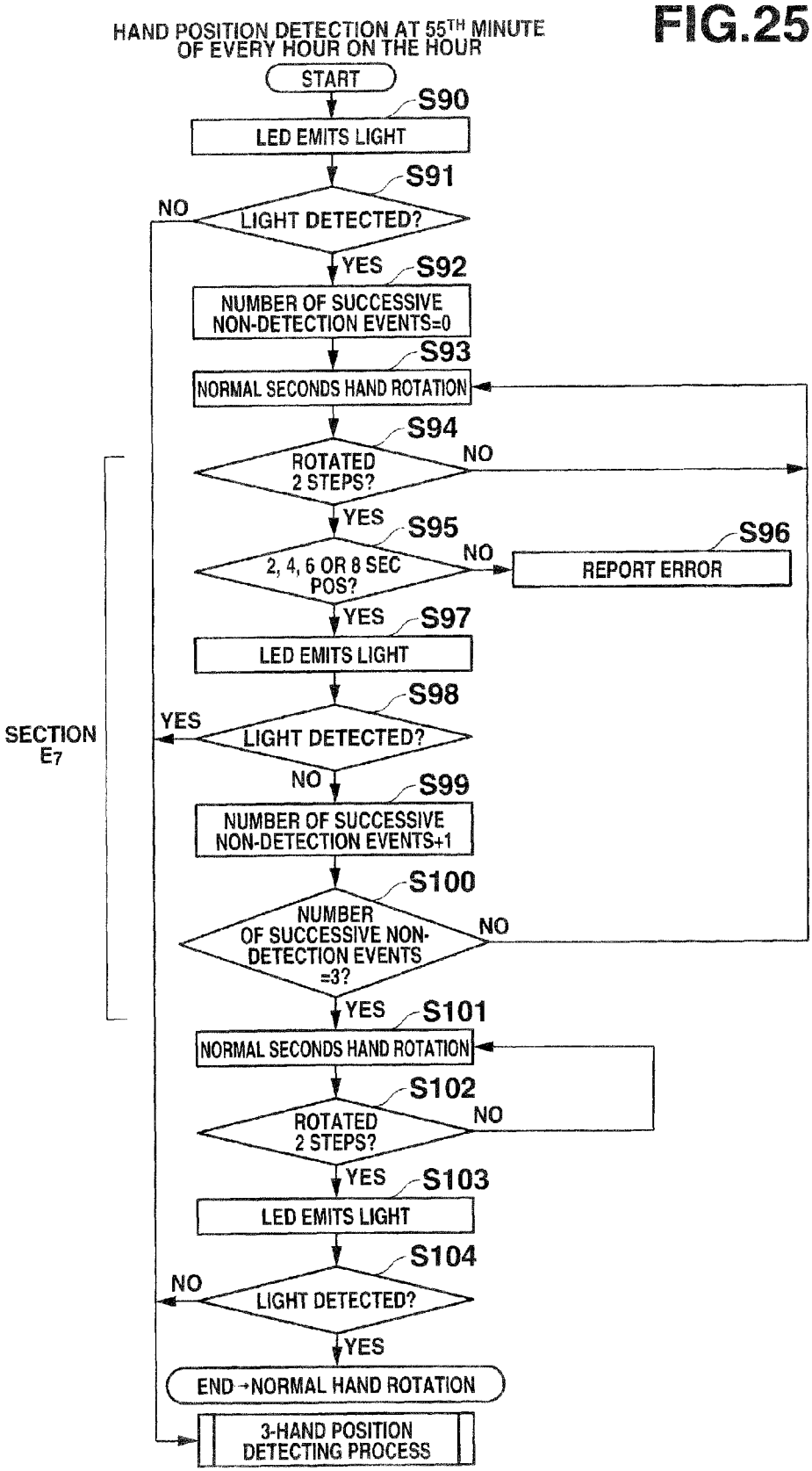
FIG. 25 is a flowchart indicative of a hand position confirming process for confirming the positions of the seconds, center and hour hands at the 55 minutes of every hour in the normal hand rotating operation.

As shown in FIGS. 7 and 25, the seconds wheel 20 has a diameter of approximately 3-4 mm. Its circular aperture 21*a* has a diameter of approximately 0.4-0.5 mm or approximately 12 degrees indicative of an angle of the circular aperture 21*a*, as viewed from the center of the seconds wheel 20. As shown in FIG. 7, the first arcuate aperture 21*b* extends between an approximately 48 degree or 8 seconds position and an approximately 168 degree or 28 seconds position in a counterclockwise direction from the circular aperture 21*a* on the circumference of the same circle as the circular aperture 21*a*. As shown in FIG. 7, the second arcuate aperture 21*c* extends between an approximately 192 degree or 32 seconds position and an approximately 300 degree or 50 seconds position in the counterclockwise direction from the center of the aperture 21*a* on the circumference of the same circle as the circular aperture 21*a*.

As shown in FIG. 7, the first light blocking area 21*d* present in the counterclockwise direction from the reference or 0 degree position which is the center of the circular aperture 21*a* extends through an angular extent of approximately three times 12 degrees indicative of the angle of the circular aperture 21*a*, as viewed from the center of the seconds wheel 20, or a net angular extent of approximately 36 degrees between the reference or 0 degree position which is the center of the circular aperture 21*a* and an approximately 48 degree or 8 seconds position as viewed in the counterclockwise direction from the center of the circular aperture 21*a*.

The second light blocking area 21*e* is longer by an angular extent of approximately the angle of the circular aperture 21*a* as viewed from the center of the seconds wheel 20 than the first light blocking area 21*d*. That is, the second light blocking area 21*e* extends through an angular extent of approximately 4 times the angle of the circular aperture 21*a* as viewed from the center of the seconds wheel 20, or through a net angular extent of approximately 48 degrees from the center of the circular aperture 21*a* (or the reference or 0-degree position) to an approximately 60 degree or 50 seconds position in the clockwise direction. As shown in FIG. 7, the third light blocking area 21*f* is provided between the arcuate apertures 21*b* and 21*c* and has an angular extent of substantially the angle of the circular aperture 21*a*, as viewed from the center of the seconds wheel 20. The third light blocking area 21*f* is also diametrically opposed to the aperture 21*a*.

The first light blocking area 21*d* is diametrically opposed to part of the arcuate aperture 21*c*. The second light blocking area 21*e* is diametrically opposed to part of the arcuate aperture 21*b*. As described above, the third blocking area 21*f* is diametrically opposed to the circular aperture 21*a*. Thus, when the seconds wheel 20 rotates clockwise 180 degrees (or half rotation) from the state in which any one of the first-third light blocking areas 21*d*-21*f* blocks the detection position P in the detection unit 13 where the light emission element 31 faces the photo detection element 32, any of the circular and arcuate apertures 21*a*, 21*b* and 21*c* is arranged to align wholly or partially with the detection position P necessarily. In the description, when the rotating directions of the seconds, center and hour wheels 20, 25 and 27 are not specified, they should be rotated clockwise around their respective rotational axes, as shown by arrows in the respective FIGS. 5 and 10A-15F, and at this time the rotating direction of the intermediate wheel 23 should be counterclockwise.

Figure 8:
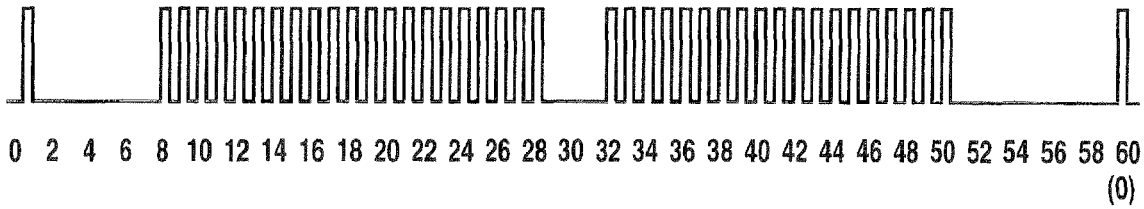
FIG. 8 is a detected pattern of the seconds wheel of FIG. 7 detected by a detection unit.

While the seconds wheel 20 rotates around a center axis thereof 2 steps, 12 degrees or 2 seconds at a time until it rotates 60 steps, 360 degrees or 60 seconds in total, the detection unit 13 tries to detect light or apertures at intervals of 2 seconds, thereby producing a detected pattern shown in FIG. 8. More particularly, when the seconds wheel 20 is at the position of 0 seconds or degrees, the detection unit 13 detects the circular aperture 21*a*. When the seconds wheel 20 rotates from a 2 seconds or 12 degree position to a 6 seconds or 36 degree position, the first light blocking area 21*d* blocks the detection position or light path P in the detection unit 13, and hence three non-detection events where the detection unit 13 cannot detect light occur successively.

When the seconds wheel 20 is between an 8 seconds or 48 degree position and a 28 seconds or 168 degree position, the detection unit 13 detects light or the arcuate aperture 21*b* continuously. When the seconds wheel 20 is at a 30 seconds or 180 degree position, the third light blocking area 21*f* blocks the detection position P, and hence the detection unit 13 cannot detect apertures. When the seconds wheel 20 is between a 32 seconds or 182 degree position and a 50 seconds or 300 degree position, the detection unit 13 detects light or the arcuate aperture 21*b* continuously. When the seconds wheel 20 is between at a 52 seconds or 312 degree position and a 58 seconds or 348 degree position, the light blocking area 21*e* blocks the detection position P, and hence four non-detection events occur successively to the detection unit 13.

Figure 9:
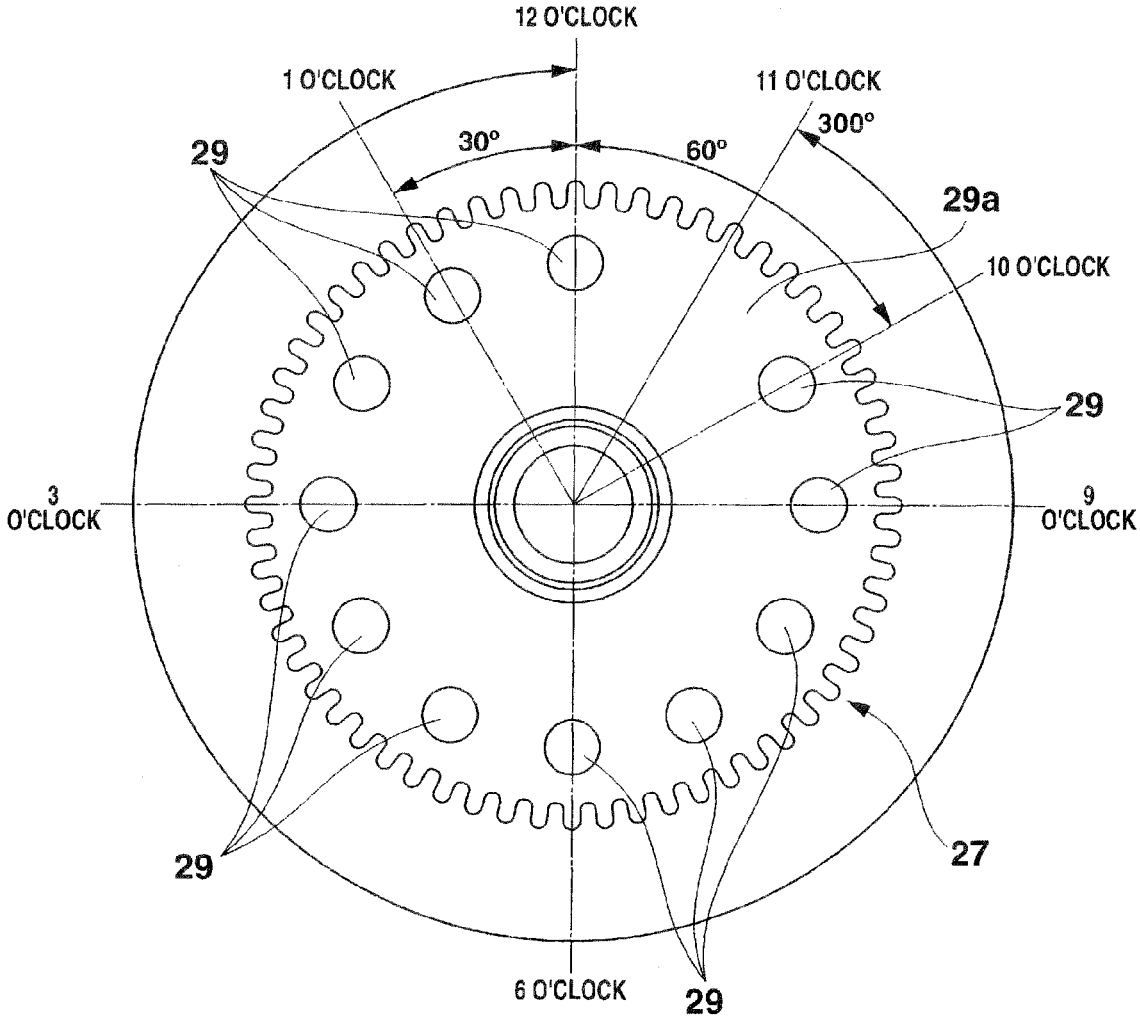
FIG. 9 is an enlarged plan view of the hour wheel of FIG. 5.

As shown by a solid line in FIG. 5, the aperture 28 in the center wheel 25 is a circular one provided at a reference or 00-minute or 0-degree position in the center wheel 25. The aperture 28 has substantially the same size as the circular one 21*a* in the seconds wheel 20 and is provided diametrically opposed to the circular aperture 21*a* in the seconds wheel 20. As shown in FIGS. 5 and 9 and mentioned above, the hour wheel 27 has the 11 circular light-passing apertures 29 arranged at angular intervals of 30 degrees along the periphery thereof, starting at a reference, 0-o'clock or 0 degree position therein. A (fourth) light blocking area 29*a* is provided in the hour wheel 27 between the aperture at the reference position and the eleventh aperture (i. e., at the one o'clock position in FIG. 9).

As shown in FIG. 9, the apertures 29 in the hour wheel 27 are provided at respective angular positions of 0, 30, 60, 90, 120, 150, 180, 210, 240, 270 and 300 degrees in the counterclockwise direction or at 0, 1, 2, 3, 4, 5, 6, 7, 8, 9 and 10 o'clock positions with a 0-o'clock or 0-degree position as a reference position in the hour wheel 27 in the clockwise direction (in FIG. 9, in the counterclockwise direction). The fourth light blocking area 29*a* is provided at an 11 o'clock position (or a one o'clock position in FIG. 9). These circular apertures 29 in the hour wheel 27 have substantially the same size as the aperture 21*a* in the seconds wheel 20.

As shown in FIG. 5, the aperture 30 in the intermediate wheel 23 can align with the aperture 28 in the center wheel 25 and has substantially the same size as the apertures 21*a* and 28 in the seconds and center wheels 20 and 25, respectively. The aperture 30 is provided at such a position in the intermediate wheel 23 that when the aperture 28 in the center wheel 25 aligns with the detection position P, the aperture 30 aligns with the aperture 28 in the center wheel 25.

The intermediate, center and hour wheels 23, 25 and 27 of the second driving system 12 rotate 30, 1 and 1/12 degrees, respectively, in one step or one half rotation of the rotor 22*c*. Thus, as shown in FIG. 5, the arrangement is such that each time the hour hand 4 indicates every hour on the hour, excluding the 11 o'clock hour point; that is, every one of 0-10 o'clock hour points, the apertures 28 and 30 in the center and intermediate wheels 25 and 23 and a relevant one of the apertures 29 in the hour wheel 27 align all at the detection position P.

The seconds wheel 20 of the first driving system 11 rotates 6 degrees (or a half rotation of the rotor 17*c*) per step. Each time the seconds wheel 20 rotates 60 steps or seconds, its aperture 21*a* aligns with the detection position P. Thus, as shown in FIG. 5, each time the hour hand 4 indicates a respective one of 0-10 o'clock positions, the aperture 21*a* aligns with the apertures 28, 30 and a relevant one of the apertures 29.

Description will be made of preconditions for detecting the driving positions of the seconds, center and hour hands 2, 3 and 4 with the detection unit 13. When the seconds, center and hour hands 2, 3 and 4 point to the same 12 o'clock direction (in FIG. 5), the apertures 21*a* in the seconds wheel 20, the aperture 28 in the center wheel 25, the apertures 29 at the reference position in the hour wheel 29 and the aperture 30 in the intermediate wheel 23 should align with the detection position P in FIG. 5 such that a light beam from the light emission element 31 is received through these apertures by the photo detection element 32.

Since the light from the light emission element 31 is blocked when any of those apertures is offset or away from the detection position P, no light from the light emission element 31 is received by the photo detection element 32.

By reversing 180 degrees the rotation of the respective rotors 17*c* and 22*c* of the first and second stepping motors 17 and 22, the respective seconds, center and hour hands 2, 3 and 4 are rotated one step. To this end, pulses of opposite polarities are applied alternately to each of the stepping motors 17 and 22 at every step, thereby rotating the rotors 17*c* and 22*c*. Thus, even when pulses of the same polarity are applied successively to a respective one of the stepping motors 17 and 22, the respective rotors 17*c* and 22*c* do not rotate and remain stopped.

In the first stepping motor 17 of the first driving system 11, unless the seconds wheel 20 rotates 2 steps, its circular aperture 21*a* does not completely move away from the detection position P due to a relationship between the size of the aperture 21*a* and a moving quantity per step of the seconds wheel 20 rotation. Thus, with the seconds wheel 20, it is effective that the detection unit 13 tries to detect light at every 2 steps (or seconds) of the seconds wheel 20 rotation. With the second driving system 12, it is effective that the detection unit 13 tries to detect light at every step.

Then, referring to FIGS. 10A-10M, description will be made of a basic seconds hand position detecting method for detecting a reference or 00 seconds position in the seconds wheel 20. In this process, the center, hour and intermediate wheels 25, 27 and 23 of the second driving system 12 should be neglected. FIGS. 10A-10M each show a relationship between the detection position P of the detection unit 13 and a rotational angular position of the seconds wheel 20 when the same rotates 2 steps (or a rotational angle of 12 degrees) at a time.

Figure 10A:
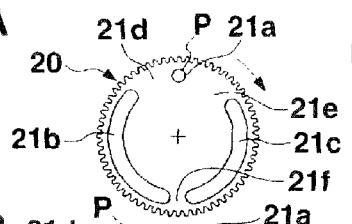
FIGS. 10A-10M show a basic position detecting operation of the seconds wheel of FIG. 7, wherein FIGS. 10B-10M each illustrate respective states of the seconds wheel rotated 2 steps or 12° at a time from a detection point P (FIG. 10A).

The reference position in the seconds wheel 20 can be obtained by detecting the reference or 00 seconds position in the seconds wheel 20 shown in FIG. 10A where the aperture 21*a* in the seconds wheel 20 aligns with the detection position P. In this state, the detection unit 13 can detect light.

Figure 10B:
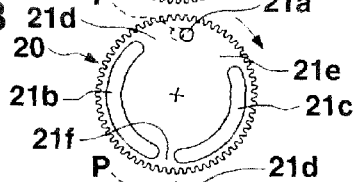
Figure 10C:
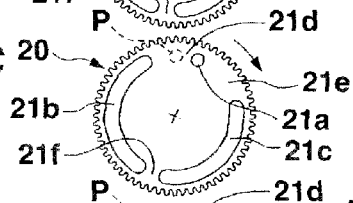
Figure 10D:
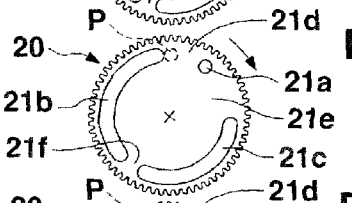

First, when the seconds wheel 20 rotates clockwise 2 steps from the state of FIG. 10A until its total rotational angle is 12 degrees, the aperture 21*a* in the seconds wheel 20 moves clockwise away from the detection position P and the first light blocking area 21*d* covers the detection position P, as shown in FIG. 10B. Thus, the detection unit 13 cannot detect light, as shown at a 2 seconds position in FIG. 8. Likewise, as shown in FIGS. 10C-10D, until the seconds wheel 20 rotates 2 steps at a time until its total rotational angle is 36 degrees, the third light blocking area 21*d* blocks the detection position P. Thus, the detection unit 13 cannot detect light and three non-detection events occur successively, as shown at 3-6 seconds positions in FIG. 8.

Figure 10E:
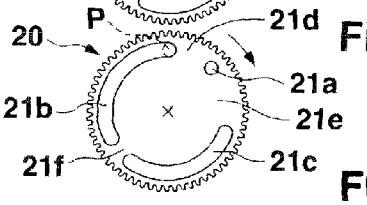
Figure 10F:
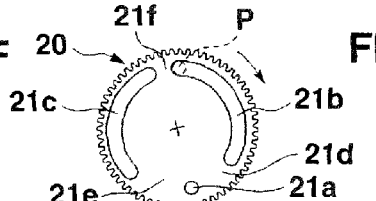

Then, as shown in FIG. 10E, when the seconds wheel 20 further rotates 2 steps until its total rotational angle is 48 degrees, the arcuate aperture 21*b* in the seconds wheel 20 aligns partially with the detection position P. Thus, as shown at an 8 seconds position in FIG. 8, the detection unit 13 detects light. Similarly, as shown in FIG. 10F, when the seconds wheel 20 rotates 2 steps at a time until its total rotational angle is 168 degrees, the arcuate aperture 21*b* in the seconds wheel 20 aligns partially with the detection position P. Thus, the detection unit 13 detects light continuously, as shown at 10-28 seconds positions in FIG. 8.

Figure 10G:
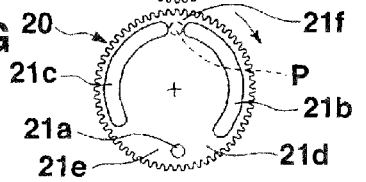
Figure 10H:
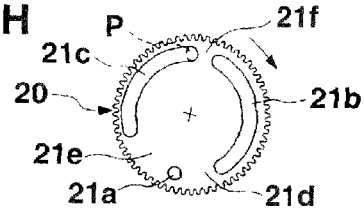

As shown FIG. 10G, when the seconds wheel 20 further rotates 2 steps until its total rotational angle is 180 degrees, its arcuate aperture 21*b* moves clockwise from the detection position P and the third light blocking area 21*f* covers the detection position P. Thus, the detection unit 13 cannot detect light, as shown at a 30 seconds position in FIG. 8. Then, as shown in FIG. 10H, when the seconds wheel 20 further rotates 2 steps until its total rotational angle is 192 degrees, the arcuate aperture 21*c* in the seconds wheel 20 aligns partially with the detection position P. Thus, as shown at a 32 seconds position in FIG. 8, the detection unit 13 can detect light.

Figure 10I:
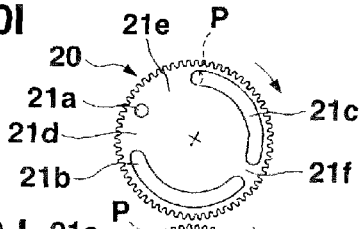
Figure 10J:
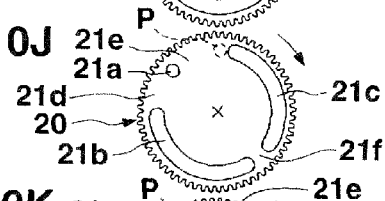

Then, as shown in FIG. 10I, until the seconds wheel 20 rotates 2 steps at a time so that its total rotational angle is 300 degrees, the arcuate aperture 21*c* aligns partially with the detection position P. Thus, as shown at 34-50 seconds positions in FIG. 8, the detection unit 13 detects light continuously. As shown in FIG. 10J, when the arcuate aperture 21*c* in the seconds wheel 20 moves clockwise from the detection position P and the second light blocking area 21*e* blocks the detection position P, the detection unit 13 can not detect light, as shown at a 52 seconds position in FIG. 8.

Figure 10K:
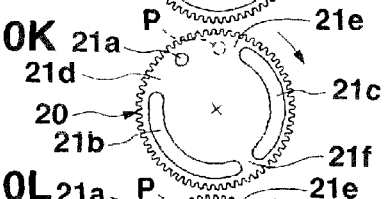
Figure 10L:
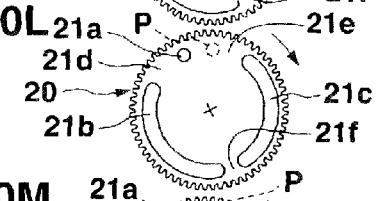
Figure 10M:
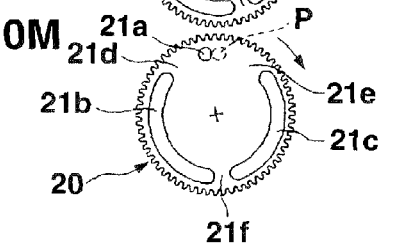

Similarly, as shown in FIGS. 10K-10M, until the seconds wheel 20 rotates 2 steps at a time so that its total rotational angle is 348 degrees, the light blocking area 21*e* covers the detection position P. Thus, the detection unit 13 cannot detect light. Thus, as shown at 54-58 seconds positions in FIG. 8, four non-detection events occur successively. When the seconds wheel 20 rotates 2 steps from this state until its total rotational angle is 360 degrees, the aperture 21*a* in the seconds wheel 20 aligns with the detection position P, as shown in FIG. 10A. Thus, as shown at a 00-second position in FIG. 8, the detection unit 13 detects light.

As described above, in the state of FIG. 10A, the detection unit 13 can detect light. In the states of FIGS. 10B-10D, the detection unit 13 can not detect light successively three times. In the states of FIGS. 10E-10F, the detection unit 13 can detect light successively. In the state of FIG. 10G, the detection unit 13 cannot detect light. In the states of FIGS. 10H-10I, the detection unit 13 can detect light successively. In the states of FIGS. 10J-10M, the detection unit 13 can not detect light successively four times.

As will be known from the above, the detection unit 13 cannot detect light in both the states of FIGS. 10B-10D and FIGS. 10J-10M. When the detection unit 13 tries to detect light once every 2 steps of the seconds wheel rotation, in the former state three non-detection events occur successively whereas in the latter case four non-detection events occur successively. It will be seen that the former and latter cases are different in the number of successive non-detection events. By counting this number of successive non-detections, the reference position in the seconds wheel 20 can be located as follows.

More particularly, each time the seconds wheel 20 rotates 2 steps or seconds, the detection unit 13 tries to detect light. When four successive non-detection events occur and the detection unit 13 detects light in next 2 steps of the seconds wheel rotation, the aperture 21*a* aligns with the detection position P. Thus, it will be seen that the reference or 00-second position in the seconds wheel 20 has aligned with the detection position P. If the number of non-detection events is counted from the state of FIG. 10B, non-detection events occur three times successively until the state of FIG. 10D comes. Then, in the state of FIG. 10E, the detection unit 13 can detect light. Thus, the conditions of four successive non-detection events are not met and it will be seen that the reference position in the seconds wheel 20 has not aligned with the detection position P. This is the basic position detecting process for detecting the reference position in the seconds wheel 20.

Then, referring to FIGS. 11A-11P, description will be made of a basic hour and minute position detecting process for detecting the respective reference positions in the hour and center wheels 27 and 25. In this process, the seconds wheel 20 in the first driving system is ignored. FIGS. 11A-11M illustrate that the center wheel 25 has rotated one step or degree at a time, thereby causing the intermediate wheel 23 to make one rotation. FIGS. 11M-11N illustrate that the center wheel 25 has rotated 360 steps or degrees, thereby rotating the hour wheel 27 30 degrees. FIG. 11N-11O show that the hour wheel 27 has rotated 9 hours from the state of FIG. 11N (or 10 hours in all). FIGS. 11O-11P show that the hour wheel 27 has rotated one more hour (or 11 hours in all).

Figure 11A:
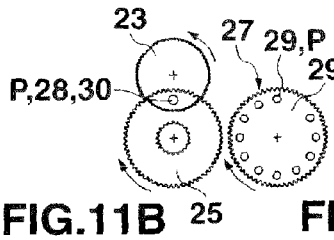

Both the reference or 0-o'clock and 00-minute positions in the center and hour wheels 25 and 27 can be obtained by detecting the reference positions in them shown in FIG. 11A. This detection is achieved when the aperture 28 at the reference or 00-minute position in the center wheel 25 and the apertures 29 at the reference or 0-o'clock position in the hour wheel 27 align with the detection position P along with the aperture 30 in the intermediate wheel 23. In this case, the detection unit 13 detects light.

Figure 11B:
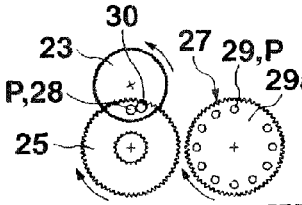
Figure 11C:
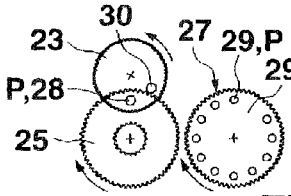
Figure 11D:
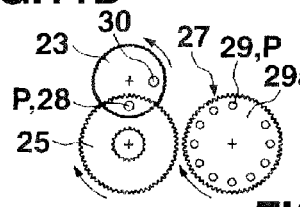
Figure 11E:
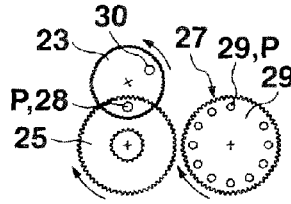
Figure 11F:
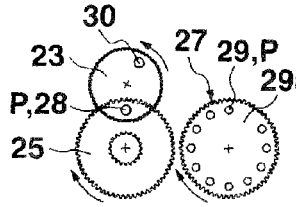

When the center wheel 25 is rotated clockwise one step or degree in FIG. 11A, the intermediate wheel 23 rotates 30 degrees, its aperture 30 moves counterclockwise away from the detection position P, and then the intermediate wheel 23 covers the detection position P, as shown in FIG. 11B. At this time, the center wheel 25 rotates clockwise one degree, and its aperture 28 moves slightly, but not completely, away from the detection position P in the detection unit 13 and hence the detection unit 13 can still detect light.

Figure 11G:
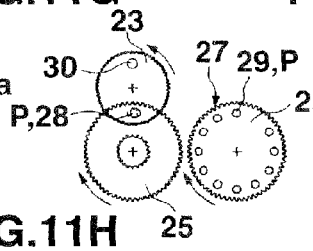
Figure 11H:
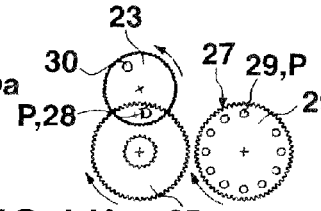
Figure 11I:
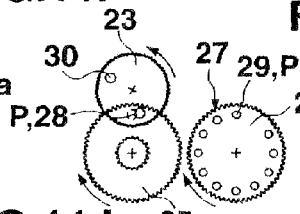
Figure 11J:
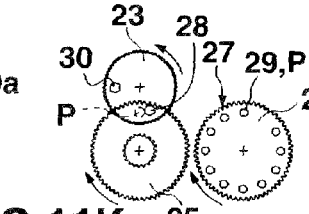
Figure 11K:
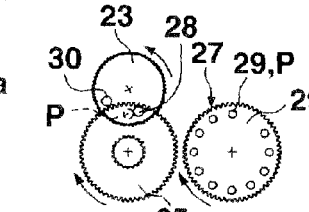
Figure 11L:
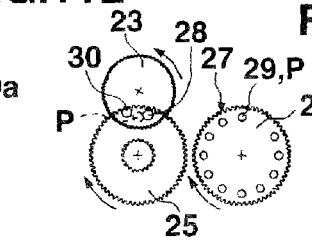
Figure 11M:
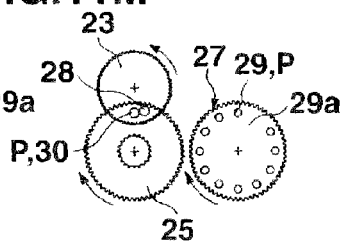
Figure 11N:
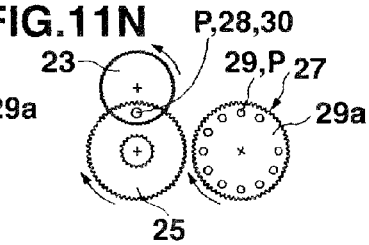
FIG. 11N shows the state of these wheels when the center wheel is rotated 360 steps or one hour from the state of FIG. 11M.
Figure 11O:
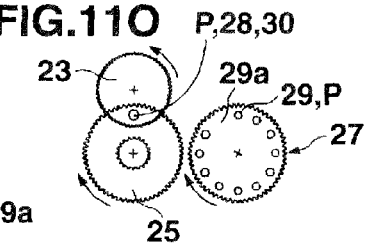
FIG. 11O shows the state of these wheels obtained when the center wheel is rotated 9 hours from the state of FIG. 11N.
Figure 11P:
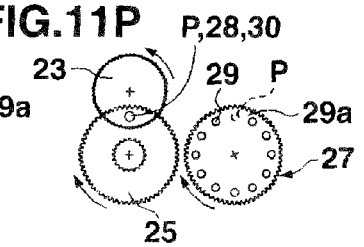
Figure 16:
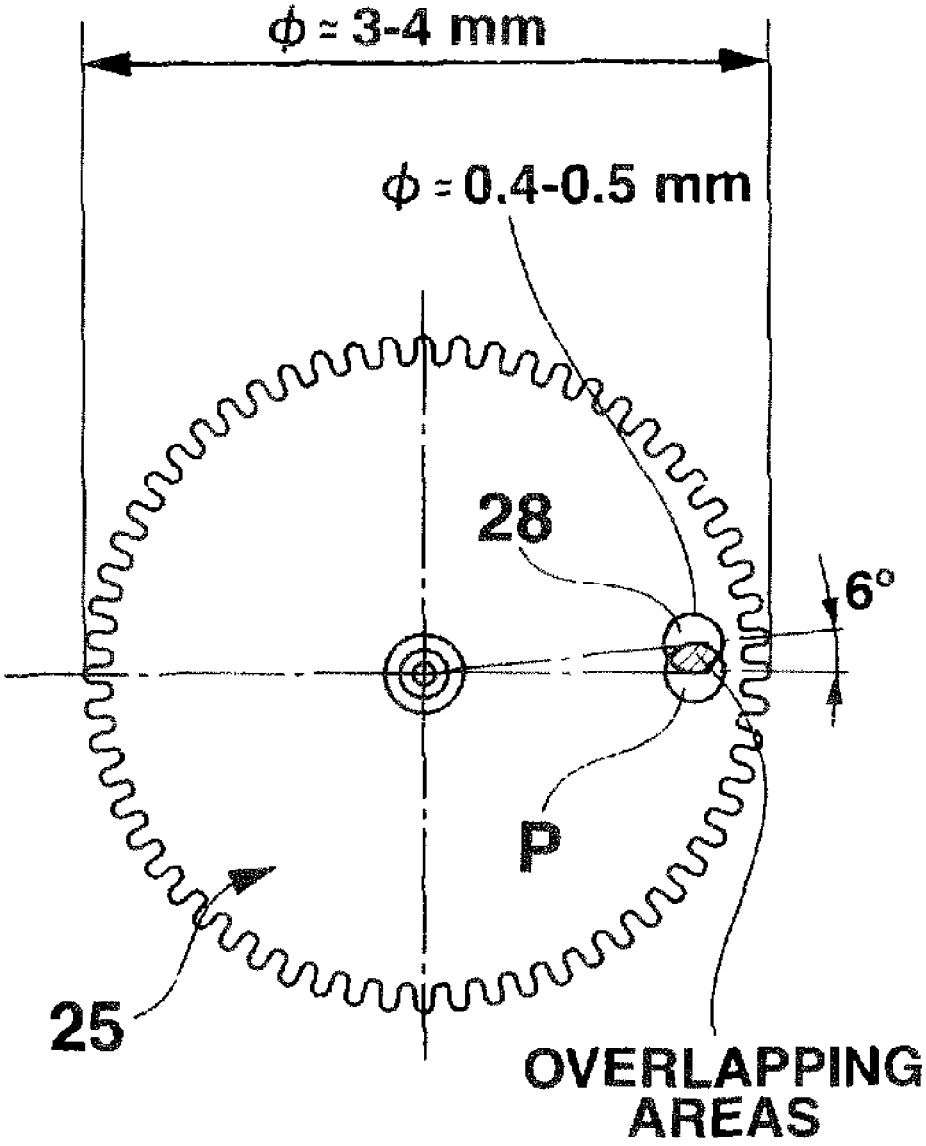
FIG. 16 is an enlarged plan view of a quantity of movement of an aperture provided in the center wheel relative to the detection position when the center wheel of FIG. 5 rotates one step or degree at a time.

Then, when the center wheel 25 rotates clockwise one step at a time and hence 6 steps or degrees in total, the intermediate wheel 23 rotates 180 degrees clockwise, its aperture 30 rotates counterclockwise 180 degrees away from the detection position P, and thus the intermediate wheel 23 continues to cover the detection position P, as shown in FIG. 11G. At this time, the center wheel 25 rotates 6 degrees clockwise and its aperture 28 moves a half of its size away from the detection position P, but the detection unit 13 still detects light (FIG. 16).

Then, when the center wheel 25 rotates clockwise one step at a time until 12 steps or degrees in total are reached, the intermediate wheel 23 rotates 360 degrees and its aperture 30 aligns with the detection position P, as shown in FIG. 11M. At this time, the aperture 28 in the center wheel 25 is substantially completely away from and aligns hardly with the detection position P. The center wheel 25 covers the detection position P, which can not detect light. At this time, since the hour wheel 27 rotates only one degree, the circular aperture 29 at the reference position in the hour wheel 27 is only slightly offset from the detection position P and the detection unit 13 can still detect light.

When the center wheel 25 rotates 360 steps or makes one rotation clockwise from the state of FIG. 11A, the apertures 28 and 30 in the center and intermediate wheel 25 and 23 align with the detection position P, as shown in FIG. 11N. At this time, the hour wheel 27 has rotated 30 degrees clockwise from the state of FIG. 11A; the aperture 29 at the reference position in the hour wheel 27 has moved away from the detection position P; and a second left aperture from the aperture 29 at the reference position aligns with the detection position P. Hence the detection unit 13 can detect light. When the center wheel 25 rotates 9 hours (or 10 hours in all) from this state, the apertures 28 and 30 in the center and intermediate wheels 25 and 23 align with the detection position P, as shown in FIG. 110. At this time, the hour wheel 27 has rotated 300 degrees. Thus, an eleventh aperture present counterclockwise from the aperture 29 at the reference position aligns with the position P and the detection unit 13 can detect light.

Then, when the center wheel 25 rotates further one hour (or 11 hours in all), the apertures 28 and 30 in the center and intermediate wheels 25 and 23 align with the detection position P, as shown in FIG. 11P. At this time, the hour wheel 27 has rotated 330 degrees; the eleventh aperture from the aperture 29 at the reference position has moved away from the detection position P; and the light blocking area 29*a* in the hour wheel 27 covers the detection position P. Thus, the detection unit 13 cannot detect light. That is, it can be said that the hour wheel 27 is at an 11-o'clock 00-minute position.

When the center wheel 25 rotates further for one hour (or 12 hours in all), the apertures 28 and 30 in the center and intermediate wheels 25 and 23 align with the detection position P, as shown in FIG. 11A. At this time, the hour wheel 27 has rotated 360 degrees; the light blocking area 29*a* of the hour wheel 27 has moved away from the detection position P; and the aperture 29 at the 0-o'clock position in the hour wheel 27 has aligned with the detection position P. Thus, the hour wheel 27 has returned to the state of FIG. 11A.

As described above, since a rotational quantity of the center wheel 25 for one step is very small or one degree, it is not enough for the rotational amount per step of the center wheel 25 to cause the aperture 28 to move completely away from the detection position P, and the reference position in the center wheel 25 can not be detected accurately. The intermediate wheel 23 rotates 30 degrees per step. Thus, even when the rotational amount per step of the center wheel 25 rotation is small, the rotational amount of the intermediate wheel 23 is large enough to cover the detection position P.

As shown in FIG. 11M, when the intermediate wheel 23 makes one rotation in 12 steps, the center wheel 25 rotates 12 degrees. Thus, the aperture 28 in the center wheel 25 moves completely away from the detection position P and hence the center wheel 25 covers the detection position P. At this time, even when the aperture 30 in the intermediate wheel 23 aligns with the detection position P, the detection unit 13 cannot detect light.

Each time the center wheel makes one rotation in 360 steps, thereby returning to the detection point P, the aperture 28 and 30 in the in the center and intermediate wheels 25 and 23 and a relevant one of the apertures 29 in the hour wheel 27 (aside from the blocking area 29*a* at the 11 o'clock position in the hour wheel 27) align with the detection position P. Thus, each time the center wheel 25 makes one rotation or 360 steps, the aperture 28 at the reference, 0 degree or 00 minute position in the center wheel 25 coincides with the detection position P.

When the center wheel 25 rotates 360 steps or one rotation at a time after the reference or 0 degree position in the center wheel 25 is detected, the hour wheel 27 rotates 30 degrees at a time. Thus, even if the detection unit 13 does not detect light each time the center wheel 25 rotates one step, the rotational position of the hour wheel 27 can be detected if the detection unit 13 tries to detect light only when the center wheel 25 makes one rotation. At this time, even if the detection unit 13 tries to detect light by rotating the center wheel 25 by 360 steps at a time from the state of FIG. 110, the detection unit 13 cannot detect light because the light blocking area 29*a* in the hour wheel 27 has covered the detection position P, as shown in FIG. 11*p*. The reference position in the hour wheel 27 at this time is specified as an "11-o'clock 00-minute position".

When the center wheel 25 is further rotated by 360 degrees from this "11-o'clock 00-minute position", the aperture 29 at the reference or 0-o'clock position in the hour wheel 27 aligns with the detection position P and the detection unit 13 can detect light. That aperture 29 in the hour wheel 27 at this time is at the reference or 0-o'clock 00-minute position. Thus, each time the center wheel 25 rotates by 360 degrees or makes one rotation from the state in which the detection unit 13 can detect light, the detection unit 13 tries to detect light. Then, when the position in the hour wheel 25 (FIG. 11A) where the detection unit 13 can detect light is found by rotating the center wheel 25 by further 360 degrees from the position where the detection unit 13 can not detect light (FIG. 11P), it can be specified as the reference or 0-o'clock 00 minute position in the hour wheel 27.

Referring to FIGS. 12A-14F, description will be made of a basic three-hand detection process for detecting the positions of the seconds, center and hour hands 2, 3 and 4. This process comprises a seconds hand position detecting operation to be performed when any of the apertures 21*a*, 21*b* and 21*c* in the seconds wheel 20 is offset from the detection position P, an hour/minute hand position detecting process to be performed when the aperture 28 in the center wheel 25 or a relevant one of the apertures 29 in the hour wheel 27 is offset from the detection position P, and a combination of the seconds hand position detecting operation and the hour/minute hand position detecting process to be performed when any of the apertures 21*a*, 21*b* and 21*c* in the seconds wheel 20, the aperture 28 in the center wheel 25 and a relevant one of the apertures 29 in the hour wheel 27 are all offset from the detection position P.

First, referring to FIGS. 12A-12F, description will be made of the three-hand position detecting process to be performed when only the aperture 21 in the seconds wheel 20 is offset from the detection position P. At this time, assume that the state of the seconds wheel 20 is completely unknown and that the reference positions in the center and hour wheels 25 and 27 are at a 0-o'clock and 00-minute position. First, a basic seconds hand position detecting process to detect the reference position in the seconds wheel 20 will be tried by rotating the seconds wheel 20 by clockwise 2 steps at a time, thereby causing the detection unit 13 to detect light on each such occasion.

Figure 12A:
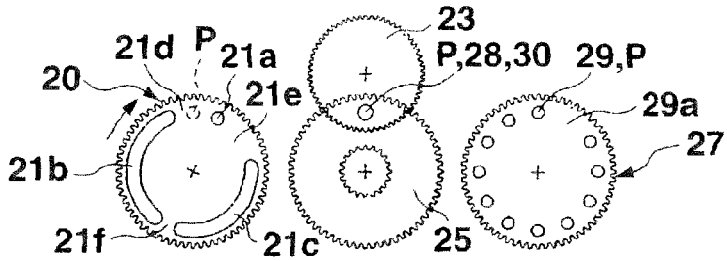
FIGS. 12A-12F show a position detecting operation for the seconds wheel alone in FIG. 5, and FIGS. 12A-12F illustrate the respective states of the seconds wheel obtained in corresponding stages where the seconds wheel whose reference position is offset from the detection position is moved to the same.

If at this time the state of FIG. 12A is obtained, the detection unit 13 can not detect light, and this state is counted as one non-detection event. When such state successively occurs, the number of these non-detection events should be sequentially counted up and then when the detection unit 13 detects light, the count obtained so far is cleared.

Figure 12B:
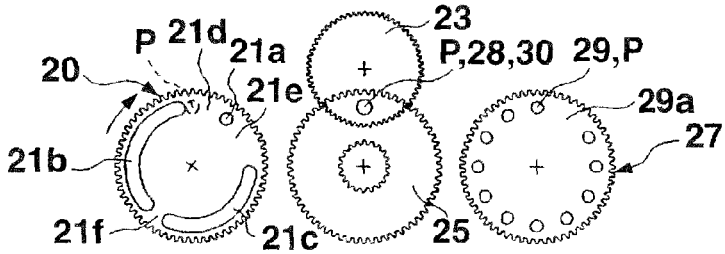
Figure 12C:
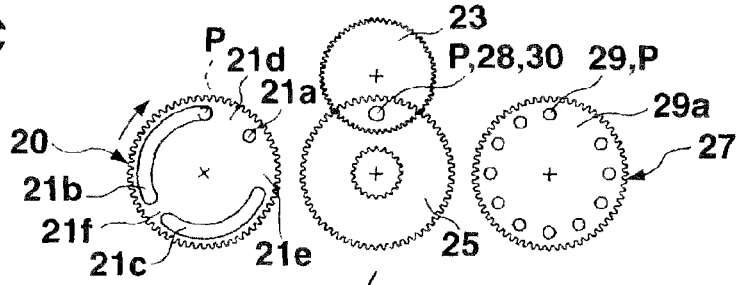
Figure 12D:
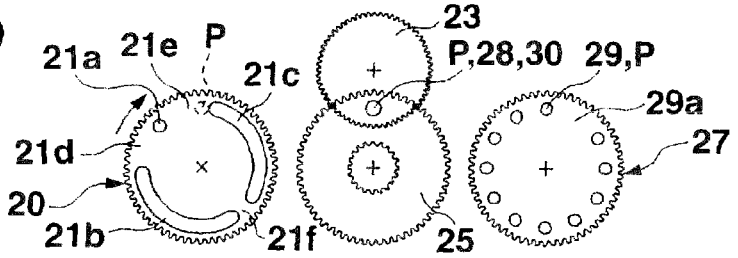

When the detection unit 13 cannot detect light, the seconds wheel 20 is rotated further 2 steps, thereby causing the detection unit 13 to try to detect light. As shown in FIG. 12B, if at this time the detection unit 13 can not detect light, it is determined that another non-detection event has occurred successively and hence is counted. Then, the seconds wheel 20 is rotated by further 2 steps from this state, thereby causing the detection unit 13 to try to detect light. If the detection unit 13 detects light at this time, as shown in FIG. 12C, non-detection events do not occur successively, and the counted number of non-detection events obtained so far is cleared.

Figure 12E:
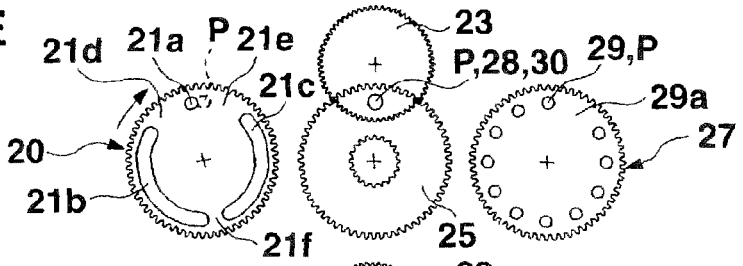

Subsequently, the detection unit 12 tries to detect light each time the seconds wheel 20 is rotated by 2 steps. As shown FIG. 12D, at this time, when a state where the detection unit 13 cannot detect light occurs after the detection unit 13 has successfully detected light successively so far, this event is counted again as one non-detection event. Then, light detection is tried each time the seconds wheel 20 is rotated 2 steps. At this time, four non-detection events occur successively in which the detection unit 13 cannot detect light, as shown in FIG. 12E.

Figure 12F:
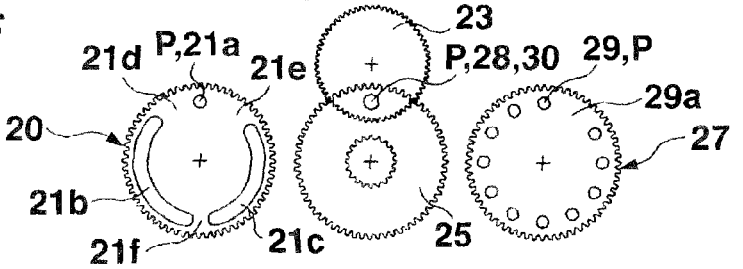

If the detection unit 13 can detect light in next 2 steps, it can be said that the aperture 21*a* in the seconds wheel 20 has aligned with the detection position P. Thus, it will be seen that the position of the aperture 21*a* is its reference or 00-seconds position, as shown in FIG. 12F.

Then, referring to FIGS. 13A-13F, description will be made of the three-hand position detection process to be performed when the apertures 28 and 29 in the center and hour wheels 25 and 27 are offset from the detection position P. At this time, even when the aperture 21 in the seconds wheel 20 aligns wholly or partially with the detection position P, the apertures in the center and hour wheels 25 and 27 do not align with the detection position P. Thus, the detection unit 13 cannot detect light. Therefore, first, a basic seconds hand position detection process to move the reference position in the seconds wheel 20 to the detection position P will be performed.

Figure 13A:
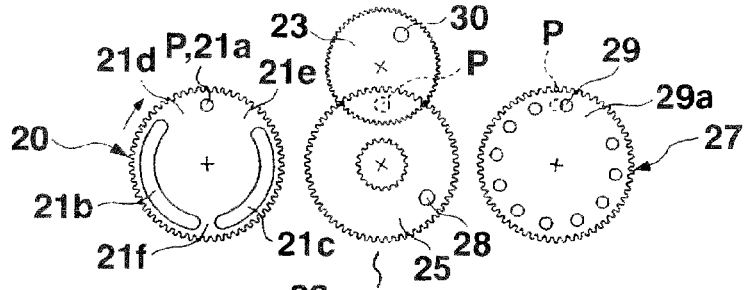
FIGS. 13A-13F show a position detecting operation for the center and hour wheels in FIG. 5, and FIGS. 13A-13F illustrate the respective states of each of the seconds and hour wheels obtained in corresponding stages where the center and hour wheels whose reference positions are offset from the detection position P are moved to the same.
Figure 13B:
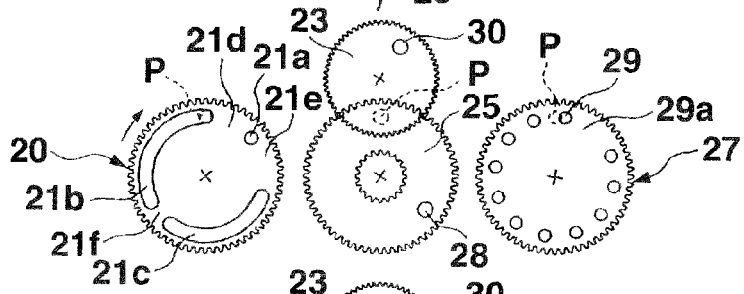

At this time, when the seconds wheel 20 is rotated by 2 steps at a time, thereby causing the detection unit 13 to detect light each time, the state changes from that of FIG. 13A to that of FIG. 13B. Thus, even when the aperture 21 in the seconds wheel 20 aligns with the detection position P, the apertures 28 and 29 in the center and hour wheels 25 and 27 are offset from the detection position P, and the detection unit 13 cannot detect light. When the state of the seconds wheel 20 changes from that of FIG. 13A to that of FIG. 13B, four non-detections events have occurred successively.

Figure 13C:
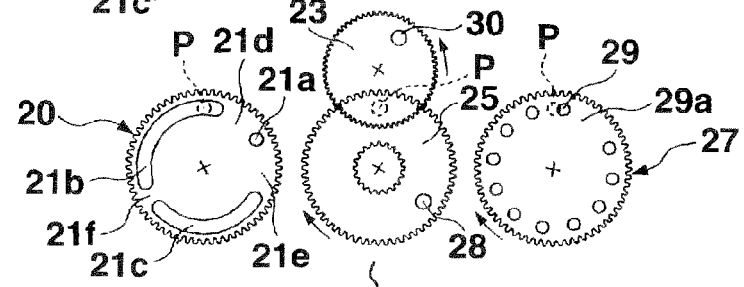

The basic seconds wheel position detecting method is that if the detection unit 13 tries to detect light, it encounters four non-detection events successively and then detects light in next 2 steps, the position of the aperture in the seconds wheel 20 at this time is a reference position in the seconds wheel 20. In view of this method, in the state of FIG. 13B, four non-detection events have occurred successively. Thus, if the detection unit 13 detects light in next 2 steps, it can he said that the reference position in the seconds wheel 20 at this time aligns with the detection position P. However, as shown in FIG. 13C, the apertures 28 and 29 in the center and hour wheels 25 and 27 are offset from the detection position P even when the seconds wheel 20 is rotated 2 steps. Thus, the detection unit 13 cannot detect light.

Thus, if the detection unit 13 cannot detect light successively five times each time the seconds wheel 20 rotates 2 steps, it will be seen that either the aperture 28 in the center wheels 25 or any of the apertures 29 in hour wheel 27 is offset from the detection position P. In this state, it is unknown if the aperture 21 in the seconds wheel 10 aligns wholly or partially with the detection position P.

Since it is seen at this point that either the apertures 28 in the center wheels 25 or any of the apertures 29 in the hour wheel 27 is offset from the detection position P, a trial will be made of a basic process for detecting the reference positions in the center and hour wheel 25 and 27. To this end, the seconds wheel 20 is rotated one step at a time, thereby causing the detection unit 13 to detect light. Therefore, when the state of the center and hour wheels 25 and 27 changes from that of FIG. 13C to that of FIG. 13D, the apertures 28 and 30 in the center and intermediate wheels 25 and 23 align with the detection position P and a relevant one of the apertures 29 in the hour wheel 27 also aligns with the detection position P. Thus, the detection unit 13 can detect light.

Thus, it is seen that the reference or 00-minute position in the center wheel 25 has aligned with the detection position P. At this time, it is unknown at which rotational positions the seconds and hour wheels 20 and 27 are. In this case, the detection unit 13 can detect light. Thus, a basic seconds hand position detecting process for detecting the reference position in the seconds wheel 20 is tried by moving the seconds wheel 20 to the position of FIG. 13E where the reference or 00-second position in the seconds wheel 20 aligns with the detection position P. Thus, it will be seen that at this time the respective reference positions in the seconds and center wheels 20 and 25 are at a 00-minute and 00-second position.

Then, when the center wheel 25 is rotated 360 degrees or one rotation at a time, the respective apertures 29 in the hour wheel 27 align sequentially with the detection position P. The detection unit 13 can detect light. Thus, when the center wheel 25 is further rotated 360 degrees from the state (or 11 o'clock position) where the detection unit 13 cannot detect light, the reference or 0-o'clock position in the hour wheel 27 aligns with the detection position P. Thus, the respective reference positions in all the seconds, center and hour wheels 20, 25 and 27 are at the 0-o'clock 00-minute 00-second position which aligns with the detection position P.

Figure 14A:
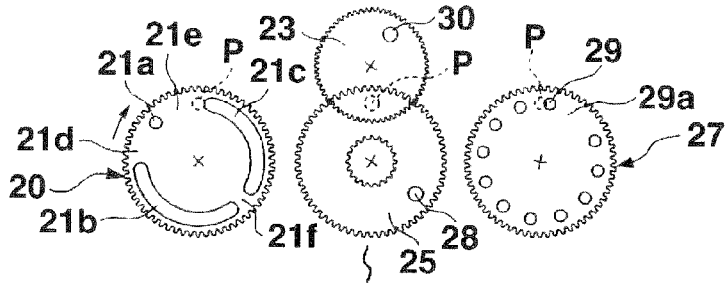
FIGS. 14A-14F show a basic position detecting operation for the seconds, center and hour wheels in FIG. 5, and FIGS. 14A-14F illustrate the respective states of each of the seconds, center and hour wheels obtained in corresponding stages where the seconds, center and hour wheels whose reference positions are offset from the detection position P are moved to the same.
Figure 14B:
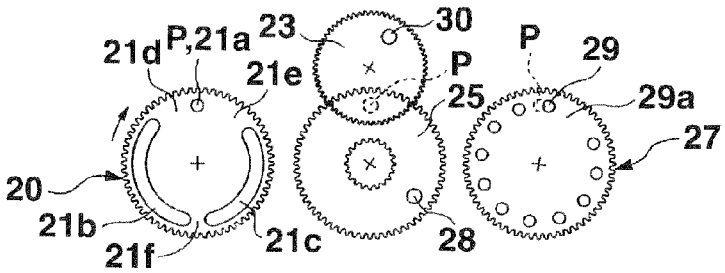

Then, referring to FIGS. 14A-14F, description will be made of a three-hand position detecting process for detecting the three-hand positions when any of the apertures 21, 28 and 29 in the seconds, center and hour wheels 20, 25 and 27 is offset from the detection position P. At this time, the rotational positions of these wheels 20, 25 and 27 are unknown. Thus, a basic seconds hand position detecting process for detecting the reference position of the seconds wheel 20 will be tried by rotating the seconds wheel 20 by 2 steps at a time from the state of FIG. 14A. As shown in FIG. 14B, at this time even when the aperture 21 in the seconds wheel 20 aligns wholly or partially with the detection position P, the detection unit 13 cannot detect light if none of the apertures 28 and 29 in the center and hour wheels 25 and 27 aligns with the detection position P.

Figure 14C:
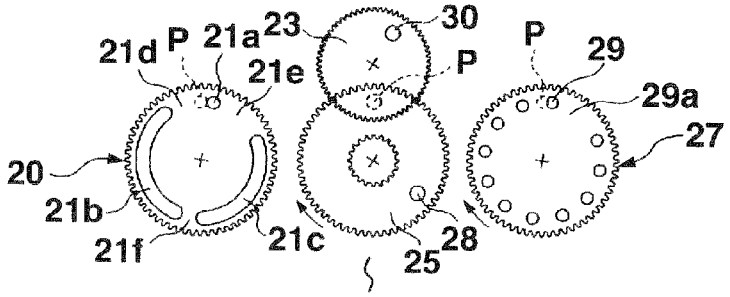

Therefore, the basic hand position detection for the seconds wheel 20 will be further performed. The conditions for detecting the reference position in the seconds wheel are that the detection unit 13 tries to detect light each time the seconds wheel 20 rotates 2 steps at a time, encounters four successive non-detection events, and then detects light successfully in next 2 steps. Thus, as shown in FIG. 14B, when these conditions hold, the reference position in the seconds wheel 20 at this time aligns with the detection position P and is detected. As shown in FIG. 14C, if the detection unit 13 cannot detect light even when the seconds wheel 20 rotates 2 steps, it is determined that any of the apertures 28 and 29 in the center and hour wheels 25 and 27 is offset from the detection position P. At this time, it also is not seen if the aperture 21 in the seconds wheel 20 has aligned with the detection position P.

Figure 14D:
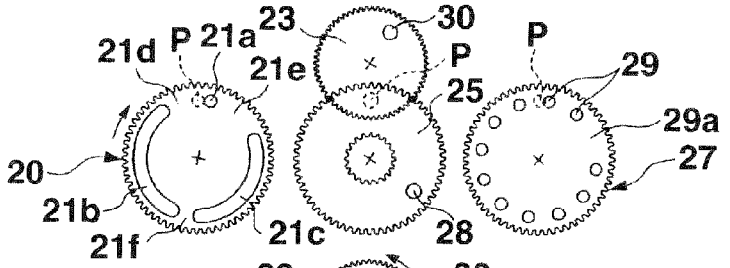

In this state, it is determined that the aperture 28 in the seconds wheel 25 is offset from the detection position P and then a basic position detecting process for detecting the reference positions in the center and hour wheels 25 and 27 is tried by rotating the center wheel 25 one step at a time. As shown in FIG. 14C, if the detection unit 13 detects no light even when the center wheel 25 is rotated 360 degrees, the aperture 21 in the seconds wheel 20 is regarded as not having aligned with the detection position P, as shown in FIG. 14D. Thus, the seconds wheel 20 is rotated by further 30 steps or 180 degrees.

Figure 13D:
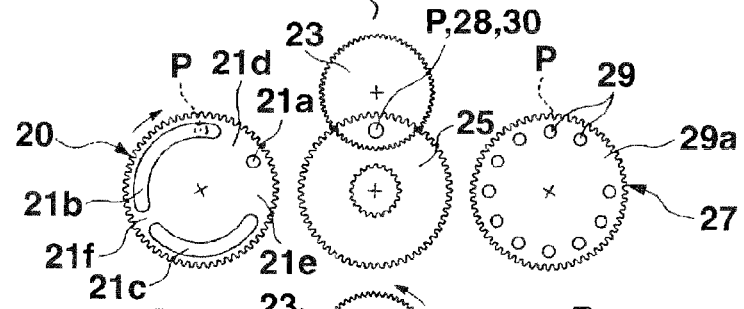
Figure 13E:
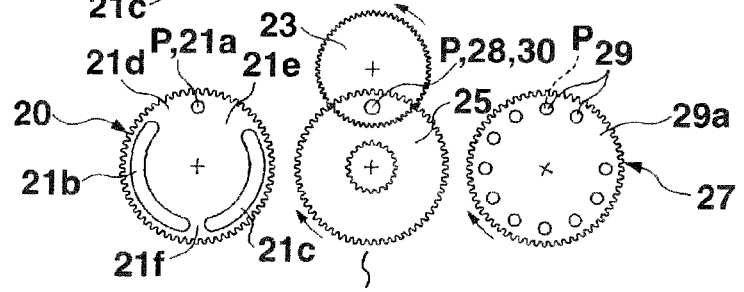
Figure 13F:
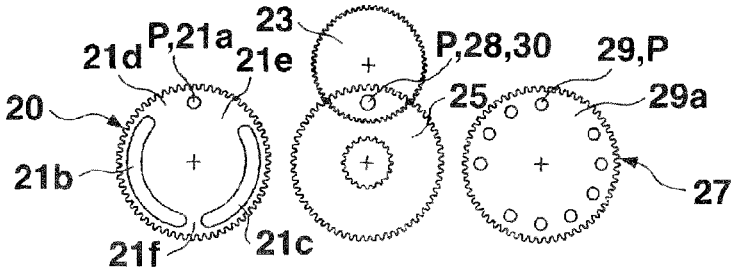
Figure 14E:
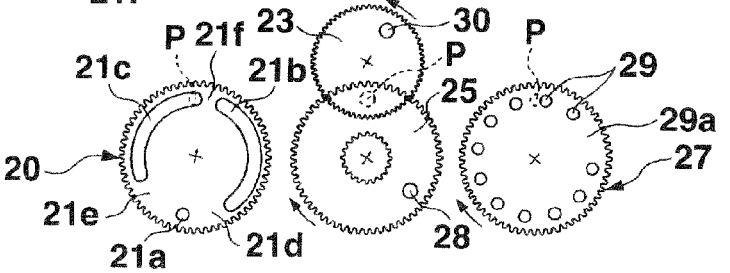
Figure 14F:
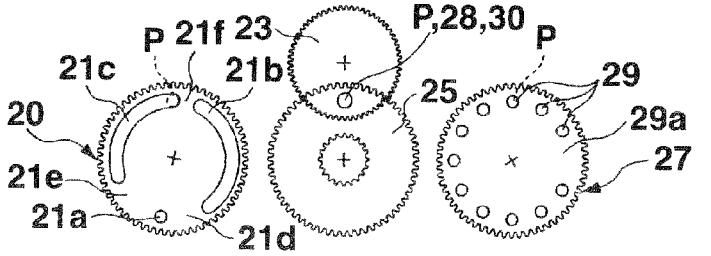

If the seconds wheel 20 is rotated 180 degrees or a half rotation when the aperture 21 in the seconds wheel 20 aligns neither wholly nor partially with the detection position P, it is assumed that the aperture 21 necessarily aligns wholly or partially with detection position P, as shown in FIG. 14E. In this state, the center wheel 25 is again rotated by one step at a time, thereby causing the detection unit 13 to try to detect light. At this time, if the aperture 28 in the center wheel 25 aligns with detection position P, thereby causing the detection unit 13 to detect light, it can be said that the reference or 00 minute position in the center wheel 25 is as shown in FIG. 14F. The state of the center wheel 25 of FIG. 14F is the same as that of the center wheel 25 of FIG. 13D in that their reference or 00 minute positions coincide with the detection position P. If the same operations as bring about the states of FIGS. 13E and 13F following the state of FIG. 13D are performed sequentially on the center wheel 25 in the state of FIG. 14F, all the reference positions in the seconds, center and hour wheel 20, 25 and 27 will coincide at the detection point P.

Referring to FIGS. 15A-15F, description will be made of a basic hand position confirming process for confirming if the seconds, center and hour hands 2, 3 and 4 are set correctly at every hour on the hour in the normal hand rotating operation. This process includes confirming in 10 seconds from that related hour if the seconds hand 2 is set correctly at every hour excluding at the 11 and 23 o'clock hour points. This is because when 10 seconds elapse from the related hour, the center wheel 25 is rotated one step or degree by the second stepping motor 22 of the second driving system 12, which rotates the intermediate wheel 23 by 30 degrees, thereby causing the light blocking area of the center wheel 25 to cover the detection position P.

Figure 15A:
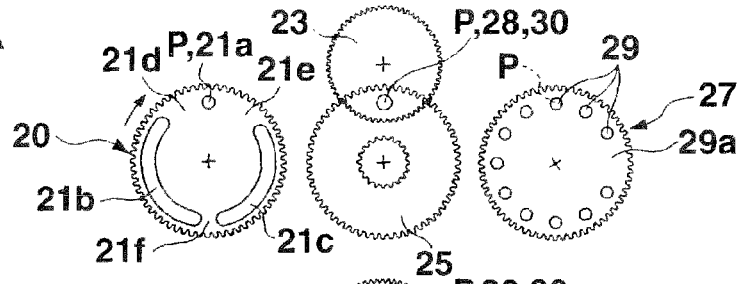
FIGS. 15A-15F show a hand position confirming process for confirming if at every hour on the hour all the seconds, center and hour hands point to the direction of that hour in the normal hand rotating operation.

FIG. 15A shows that the apertures 21*a* and 28 in the seconds and center wheels 20 and 25, a relevant (for example, third) one of the apertures 29 in the hour wheel 27 and the aperture 30 in the intermediate wheel 23 align with the detection position P at a particular hour, for example, of 2 o'clock in the normal hand rotating operation. From this state, the seconds wheel 20 rotates one step (or 6 degrees) at a time. Thus, the aperture 21*a* in the seconds wheel 20 does not completely move away from the detection position P and the detection unit 13 can detect light.

Figure 15B:
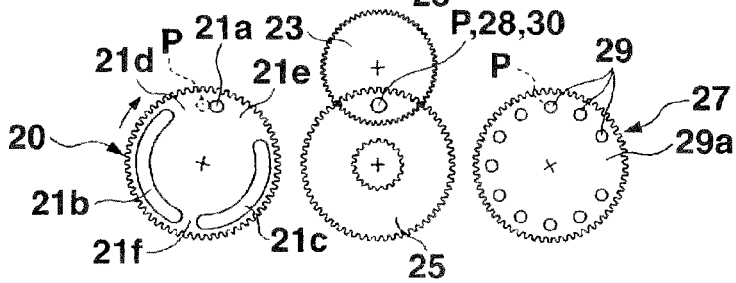

Then, when the seconds wheel 20 rotates further one step (or in all 2 steps or 12 degrees) to come to a 2 seconds position, the aperture 21*a* in the seconds wheel 20 moves completely away from the detection position P and the first light blocking area 21*d* covers the detection position P, as shown in FIG. 15B. Even if the detection unit 13 tries to detect light at this time, the detection unit 13 cannot detect light. Thus, this state is counted as one non-detection event.

Figure 15C:
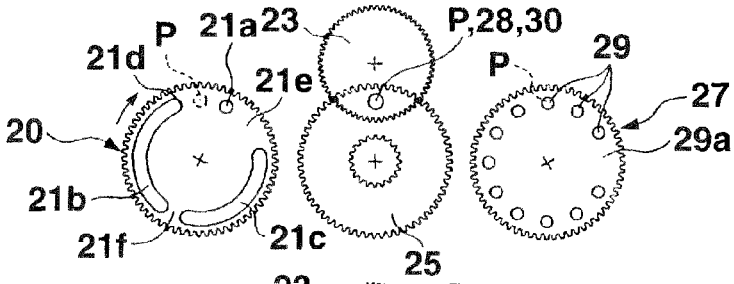
Figure 15D:
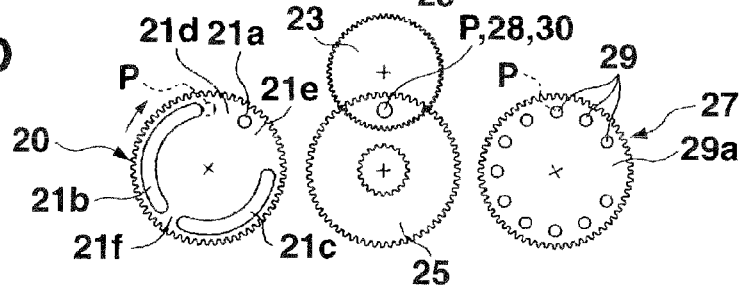

Further, the seconds wheel 20 rotates one step at a time and the detection unit 13 tries to detect light at every 2 steps. At this time, the first light blocking area 21*d* of the seconds wheel 20 continuously covers the detection unit 13, as shown at 4 and 6 seconds positions in FIGS. 15C and 15D, respectively. Thus, as shown in FIGS. 15B-15D, three non-detection events occurs successively.

Figure 15E:
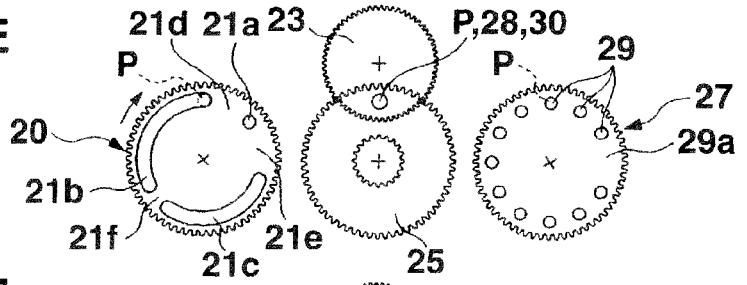

Then, when the seconds wheel 20 rotates further 2 steps from this state, and as shown at an 8 seconds position in FIG. 15E, the arcuate aperture 21*b* in the seconds wheel 20 aligns partially with the detection position P, thereby causing the detection unit 13 to detect light, and the aperture 21*a* at the reference position in the seconds wheel 20 is at an 8 seconds position. Thus, it will be seen that the seconds wheel 20 rotates exactly and the seconds hand 2 rotates around the dial exactly. That is, each time the seconds wheel 20 rotates 2 steps at a time, starting from a related hour position, the detection unit 13 tries to detect light. When the detection unit 13 encounters three non-detection events successively and then detects light, the seconds hand 2 is at the 8 seconds position. This indicates that the seconds hand 2 rotates exactly around the dial.

Figure 15F:
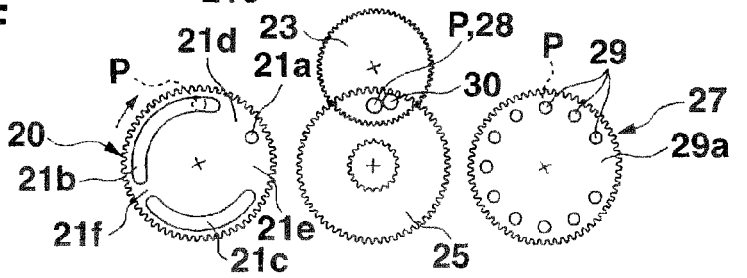

Then, when the seconds wheel 20 rotates by further 2 steps or 10 seconds elapses, the arcuate aperture 21*b* in the seconds wheel 20 aligns partially with the detection position P and the detection unit 13 can detect light, as shown in FIG. 15F. In this case, the center wheel 25 rotates one step or degree and the intermediate wheel 23 rotates one step or 30 degrees. Thus, even if the aperture 28 in the center wheel 25 is not completely away from the detection position P, the aperture 30 in the intermediate wheel 23 is completely away from the detection position P, thereby causing the intermediate wheel 23 to cover the detection unit 13. Thus, hand setting in the normal hand rotating operation is required to be performed in 10 seconds from the related hour.

Figure 17:
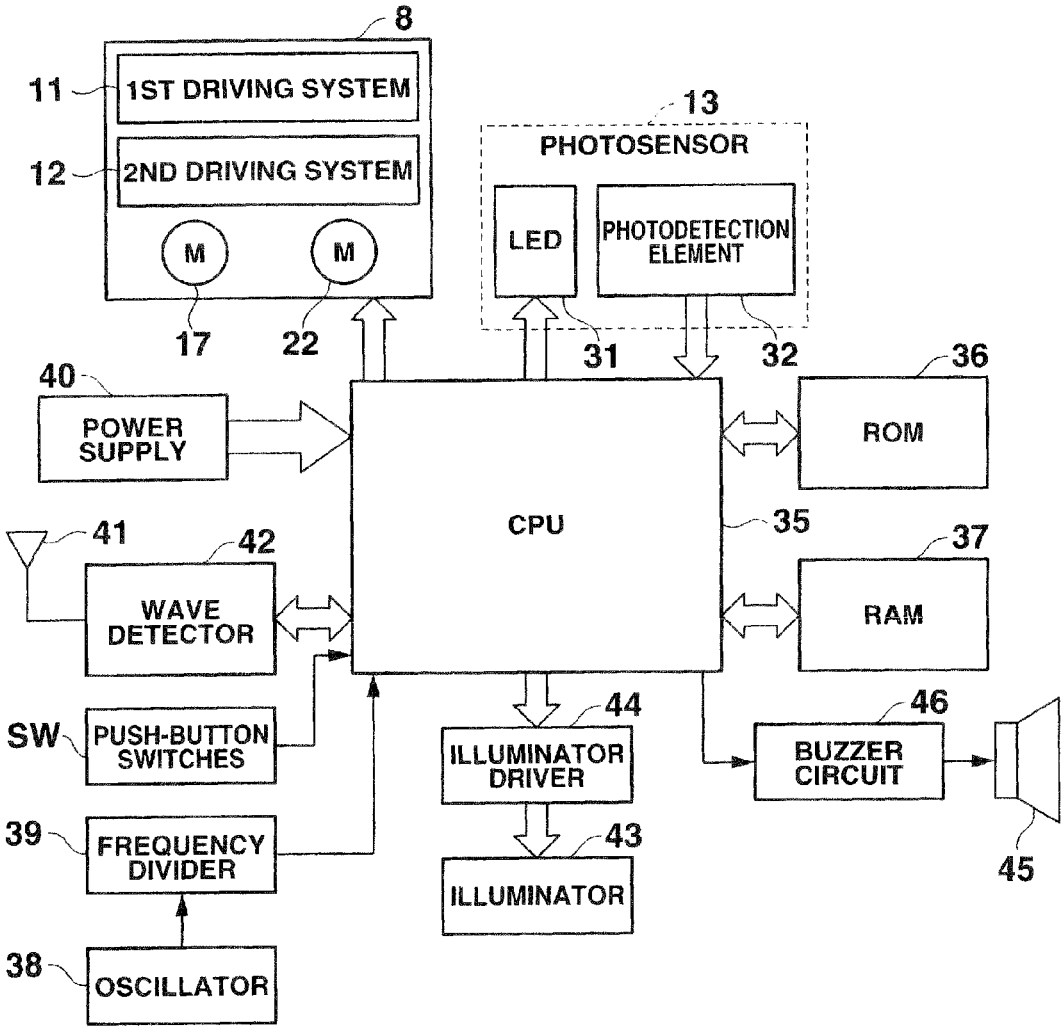
FIG. 17 is a block diagram of a circuit configuration of the wristwatch of this embodiment.

Then, referring to FIG. 17, the circuit configuration of this wristwatch comprises a CPU 35 which controls the whole circuit, a ROM 36 which has stored predetermined programs, a RAM 37 which stores data to be processed, an oscillator 38 which generates a pulse signal to operate the CPU 35, a frequency divider 39 which converts the pulse signal generated by the oscillator 38 to an appropriate frequency to operate the CPU 35, a watch movement 8 which rotates the seconds, center and hour hands 2, 3 and 4 around the dial, and the detection unit 13 which comprises the light emission element 31 and the photo detection element 32 which receives light from the light emission element 31.

The circuit further comprises a power supply 40 which includes a solar panel 9 (FIG. 2) and a battery to supply power, an antenna 41 which receives the standard radio waves, a wave detector 42 which detects the received standard radio waves, an illuminator 43 which illuminates time indications, a driver 44 which drives the illuminator 43, a speaker 45 which emanates sound, a buzzer circuit 46 which drives the speaker 45, and a plurality of push-button switches SW.

Figure 18:
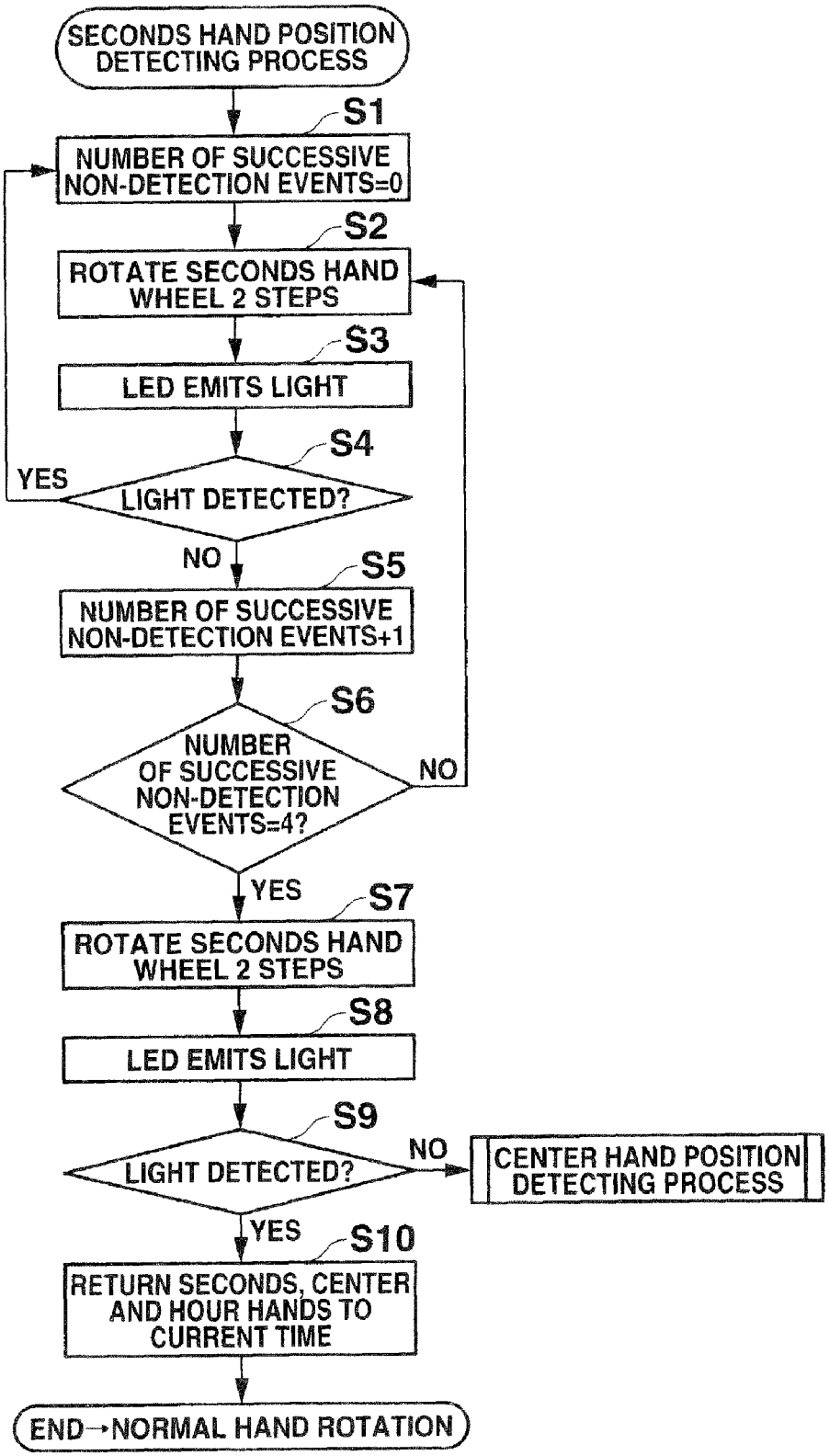
FIG. 18 is a flowchart indicative of a basic seconds hand position detecting process to move the seconds hand to the detection position P.

Then, referring to FIG. 18, description will be made of a basic seconds hand position detecting process for detecting the reference position of the seconds hand 2 of this wristwatch. This process includes detecting the reference or 00-second position in the seconds wheel 20 where the aperture 21*a* in the seconds wheel 20 aligns with the detection position P, as shown in FIG. 10A. In this case, it is assumed that the apertures 28 and 30 in the center and intermediate wheels 25 and 23 and a relevant one of the apertures 29 in the hour wheel 27 have aligned with the detection position P and that these wheels are at a stop.

When this process starts, the counted number of non-detection events which the detection unit 13 has encountered so far is cleared, thereby resetting a non-detection flag bit to 0 (step S1). Then, the seconds wheel 20 is rotated 2 steps or 12 degrees (step S2). Further, the light emission element 31 of the detection unit 13 is caused to emit light (step S3) and then it is determined if the photo detection element 32 has received light from the light emission element 31 or if the detection unit 13 has detected light (step S4).

When any one of the apertures 21*a*, 21*b* and 21*c* in the seconds wheel 20 aligns wholly or partially with the detection position P, it is determined that the photo detection element 32 has received light from the light emission element 31 and that the detection unit 13 has detected light. Then, control returns to the step S1 and then repeats the above operations of steps S1-S4 until one of the light blocking areas 21*d*-21*f* in the seconds wheel 20 blocks or covers the detection position P.

When the seconds wheel 20 rotates 2 steps at a time until any of the apertures 21*a*, 21*b* and 21*c* in the seconds wheel 20 is offset from the detection position P and one of the light blocking areas 21*d*-21*f* in the seconds wheel 20 covers the detection position P, the photo detection element 32 receives no light from the light emission element 31. This state is counted up as one non-detection event, thereby setting the non-detection flag bit to "1" (step S5). Then, it is determined if four non-detection events have occurred successively to the detection unit 13 (step S6).

This is because when the detection unit 13 detects light as shown in FIG. 10A after four non-detection events have occurred successively as shown in FIGS. 10J-10M, the position in the seconds wheel 20 which has aligned with the detection position P is specified as the reference position in the seconds wheel 20. Thus, the light blocking area 21*d* of the seconds wheel 20 covers the detection position P, for example, in the states of FIGS. 10B-10D. Therefore, three non-detections occur successively to the detection unit 13. Then, when the seconds wheel 20 rotates 2 steps, the arcuate aperture 21*b* in the seconds wheel 20 aligns partially with the detection position P, thereby causing the detection unit 13 to detect light. At this time, the control returns to the step S2, thereby repeating the steps S1 to S6.

Similarly, since in the state of FIG. 10G the light blocking area 21*f* of the seconds wheel 20 covers the detection position P, the detection unit 13 does not detect light. Then, when the seconds wheel 20 rotates 2 steps, the arcuate aperture 21*c* in the seconds wheel 20 aligns partially with the detection position P, and the detection unit 13 detects light. Also at this time, the control returns to the step S2 to repeat the steps S1 to S4. When the seconds wheel 20 rotates from the state of FIG. 10J to that of FIG. 10M, the light blocking area 21*e* of the seconds wheel 20 covers the detection position P, and four non-detection events occur successively to the detection unit 13.

Then, the seconds wheel 20 is rotated 2 steps (step S7), the light emission element 31 is caused to emit light (step S8), and then it is determined if the photo detection unit 32 has received light from the light emission element 31 (step S9). If so, it can be said that the aperture 21*a* in the seconds wheel 20 has aligned with the detection position P. Thus, it is determined that the reference or 00 seconds position in the seconds wheel 20 has been detected. Then, a hand position correction process is performed, thereby returning the seconds, center and hour hands 2, 3, and 4 to the current time (step S10). Thus, the watch is returned to its normal hand rotating operation, thereby terminating this process.

In the step S9, assume that the respective apertures 28 and 30 in the center and intermediate wheel 25 and 23 and a relevant one of the apertures 29 in the hour wheel 27 have aligned with the detection position P and are at a stop there. Thus, the detection unit 13 necessarily detects light. However, if the respective apertures 28, 29 and 30 in the center, hour and intermediate wheel 25, 27 and 23 are offset or away from the detection position P, the detection unit 13 detects no light.

Figure 19:
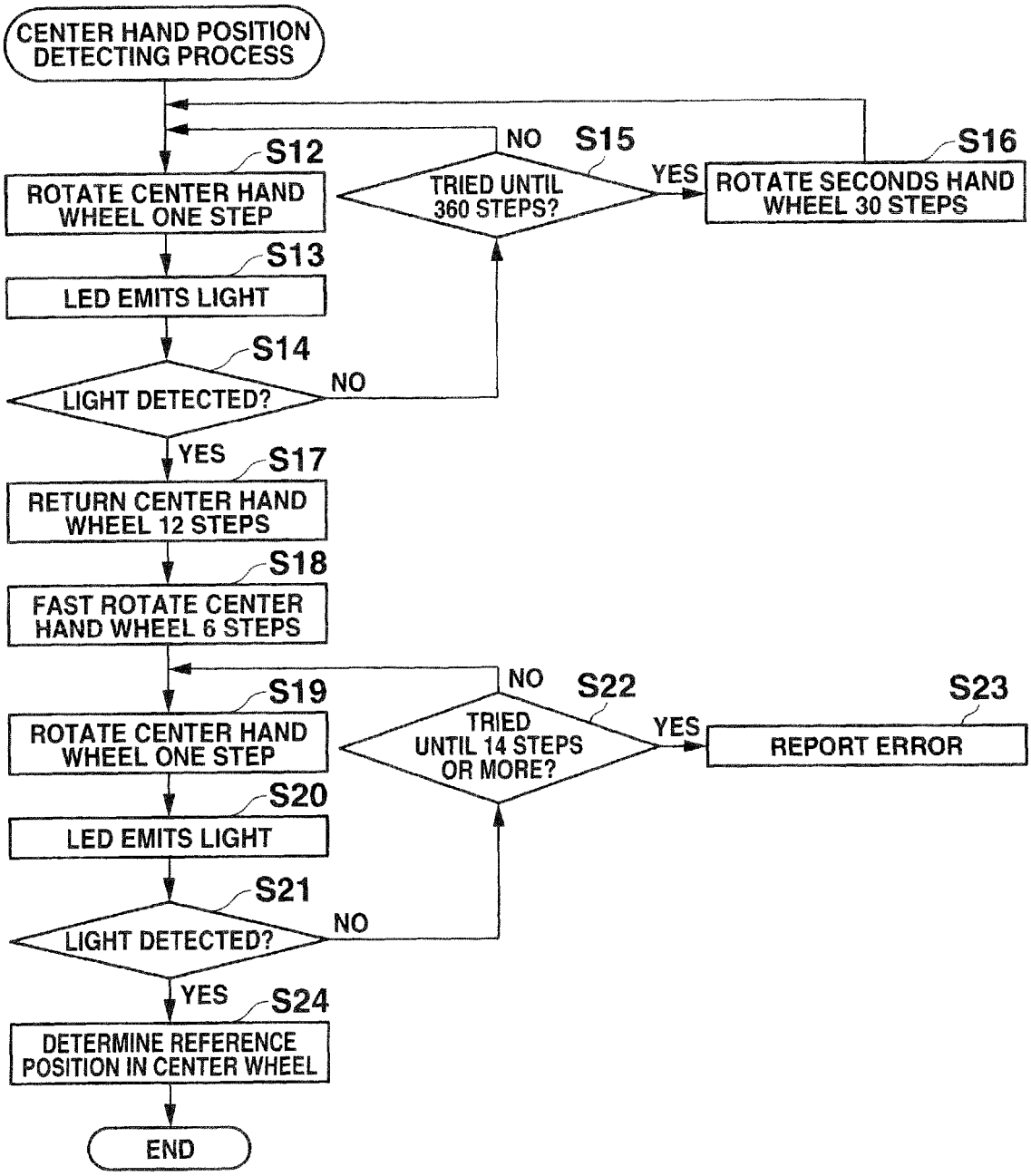
FIG. 19 is a flowchart indicative of a basic center hand position detecting process to move the center hand to the detection position P.

Referring to FIG. 19, description will be made of a basic center hand position detecting process for detecting the reference position of the center hand 3 of this wristwatch, which involves detecting a reference or 00 minute position in the center wheel 25 which aligns with the detection position P along with the apertures 28 and 30 in the center and intermediate wheels 25 and 23, as shown in FIG. 11A. In this case, assume that a relevant one of the apertures 29 in the hour wheel 27 has also aligned with the detection position P.

When this process starts, the center wheel 25 is rotated clockwise one step or degree (step S12), the light emission element 31 is caused to emit light (step S13), and then it is determined if the photo detection element 32 has received light from the light emission element 31 (step S14). If not, the control repeats the steps S12-S14 until the seconds wheel 25 is rotated 360 degrees or one hour (step S15).

Unless the detection unit 13 detects light even when the center wheel 25 rotates 360 degrees (or one hour), it is determined that the aperture 21 in the seconds wheel 20 is away from the detection position P. Thus, the seconds wheel 20 is rotated 30 steps (or 180 degrees), thereby causing the aperture 21 in the seconds wheel 20 to align wholly or partially with the detection position P (step S16). Then, the steps S12-S15 are repeated until the seconds wheel 25 is rotated 360 degrees again from this state.

When the detection unit 13 detects light in the step S14, it is determined that the reference position in the center wheel 25 has aligned with the detection position P. At this time, however it is necessary to confirm if this determination is correct. Assume that as shown in FIG. 11M, the center and intermediate wheels 25 and 23 are rotated such that when the intermediate wheel 23 makes one rotation and hence its reference position returns to the detection position P and that the center wheel 25 is rotated 12 steps to move away 12 degrees from the detection position P. At this time, the photo detection element 32 can receive light through the apertures 28 and 30 in the center and intermediate wheels 25 and 23 from the light emission element 31 if there are errors in the manufacture or assembly of the center and intermediate wheels 25 and 23.

To avoid this situation, the center wheel 25 is returned 20 steps counterclockwise from its rotational position where the detection unit 13 detected light in the step S14, or 14 degrees or more necessary for the aperture 28 in the center wheel 25 to move substantially completely away from the detection position P (step S17). Then, the center wheel 25 is fast rotated clockwise (step S18). This eliminates any possible backlash between the center and intermediate wheels 25 and 23 and places the center wheel 25 at a position where the center wheel 25 has been returned 14 steps from the position of the center wheel 25 where the detection unit 13 detected light.

That is, when the center wheel 25 is returned 14 steps counterclockwise from the detection position P, the aperture 28 in the center wheel 25 should be completely away from the detection position. Then, the center wheel 25 is again rotated clockwise one step at a time from the position where the center wheel 25 has been returned (step S19); the light emission element 31 of the detection unit 13 is caused to emit light (step S20); and then it is determined if the photo detection element 32 of the detection unit 13 has received the light from the light emission element 13, and hence if the detection unit 13 has detected light (step S21).

Unless the detection unit 13 detects light in the step S21, the steps S19-S21 are repeated until the center wheel 25 is rotated 14 steps (step S22). At this time, the detection unit 13 should detect light necessarily in the step S21. Otherwise, a hand position detection error is reported with a stop position of the seconds hand 2 or buzzer sound (step S23). If the detection unit 13 detects light in the step S21, it is determined that the position of the aperture 28 in the center wheel 25 where the detection unit 13 detected light this time is the reference or 00 minute position in the center wheel 25 (step S24). Then, this process is terminated.

Figure 20:
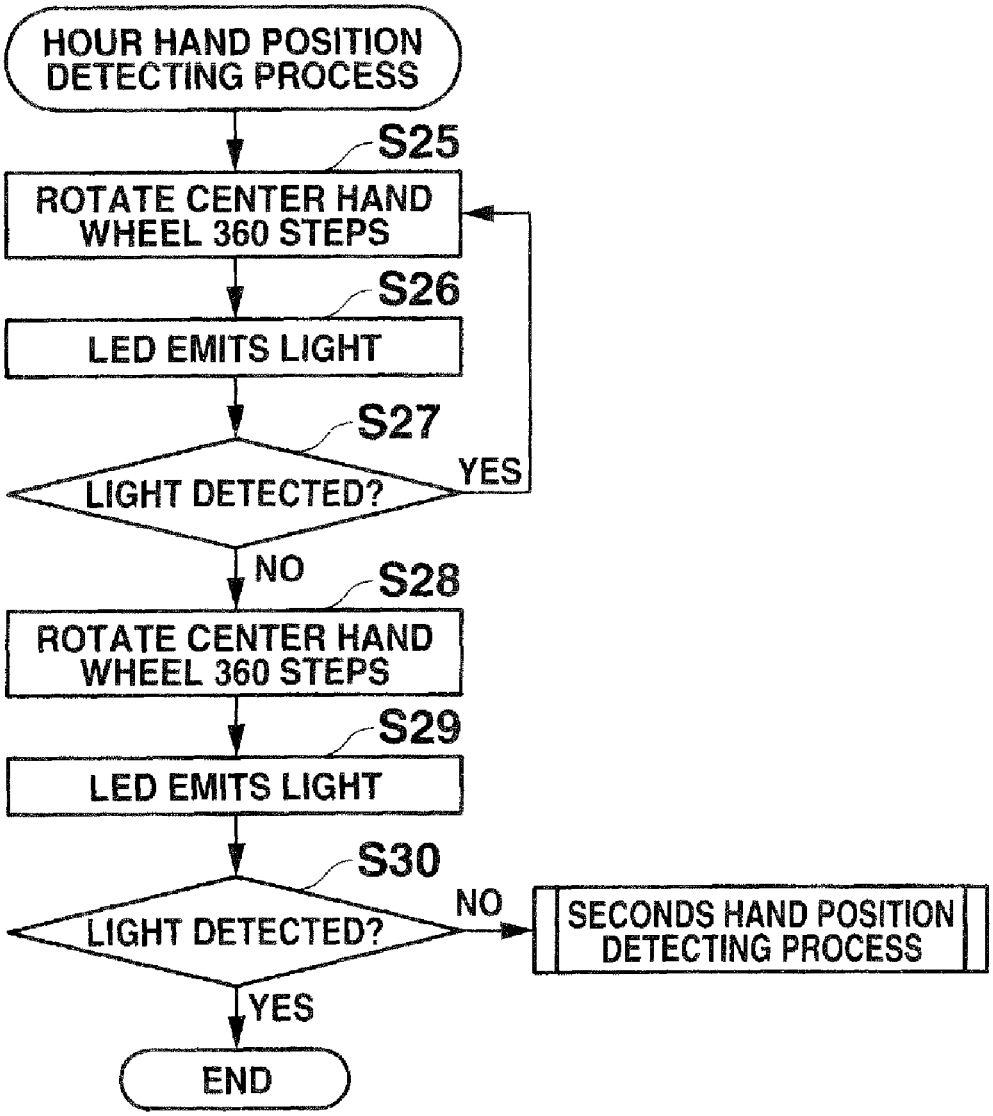
FIG. 20 is a flowchart indicative of a basic hour hand position detecting process to move the hour hand to the detection position P.

Then, referring to FIG. 20, description will be made of a basic hour hand position detecting process for detecting the reference position of the hour hand 4 of the wristwatch. This process involves detecting the reference or 0-o'clock position in the hour wheel 27, as shown in FIG. 1A, which aligns with the detection position P along with the apertures 28 and 30 in the center and intermediate wheels 25 and 23. In this case, it is assumed that the aperture 28 in the center wheel 25 and a relevant one of the apertures 21*a*, 21*b* and 21*c* in the seconds wheel 20 have aligned with the detection point P.

When this process starts, the center wheel 25, where its aperture 28 has aligned with the detection position P, is rotated 360 degrees, thereby rotating the hour wheel 27 by 30 degrees (step S25). The light emission element 31 of the detection unit 13 is then caused to emit light (step S26), and then it is determined if the photo detection element 32 has received light from the light emission element 31. That is, it is determined if one of the apertures 29 in the hour wheel 27 has aligned with the detection position P and the detection unit 13 has detected light (step S27).

At this time, the hour wheel 27 has 11 circular apertures 29 therein provided at angular intervals of 30 degrees along the circumference thereof with the fourth light blocking area 29*a* at the 11 o'clock position. Thus, when the center wheel 25 rotates 360 degrees and the hour wheel 27 rotates 30 degrees, a relevant one of the apertures 29 in the hour wheel 27 aligns with the detection position P and the detection unit 13 detects light. Thus, when the center wheel 25 makes a complete rotation a required number of times, the apertures 29 in the hour wheel 27 align sequentially with the detection position P, and the detection unit 13 detects light accordingly, as shown in FIGS. 11N-11O, although the detection unit 13 detects no light when the fourth light blocking area 29*a* at the 11 o'clock position covers the detection position P. Thus, when the detection unit 13 detects light in the step S27, the control returns to the step S25 to repeat the steps S25-S27 until the fourth light blocking area 29*a* of the hour wheel 27 covers the detection position P, thereby disabling the detection unit 13 from detecting light after the respective apertures 29 in the hour wheel 27 sequentially align with the detection position P.

As shown in FIG. 11P, if the detection unit 13 detects no light due to the fourth light blocking area 29*a* of the hour wheel 27 covering the detection position P, it is determined that the hour wheel 27 is at its 11 o'clock position. Then, the center wheel 25 is rotated further 360 degrees, thereby rotating the hour wheel 27 further 30 degrees (step S28). Then, the light emission element 31 is caused to emit light (step S29), and then it is determined if the photo detection element 32 has received light from the light emission element 31 and hence if the detection unit 13 has detected light (step S30).

As shown in FIG. 11A, in the step S30 the aperture 29 at the "0 o'clock position in the hour wheel 27 aligns necessarily with the detection position P and the detection unit 13 detects light. Thus, it is confirmed that the reference or 0 o'clock position in the hour wheel 27 has aligned with the detection position P, and then this process is terminated. Assume in the step S30 that one of the apertures 21*a*, 21*b* and 21*c* in the seconds wheel 20 has aligned wholly or partially with the detection position P. Thus, the detection unit 13 should necessarily detect light. Otherwise, then it is determined that any of the apertures 21*a*, 21*b* and 21*c* in the seconds wheel 20 has not aligned with the detection position P. Then, the control returns to the seconds hand position detecting process.

Figure 21:
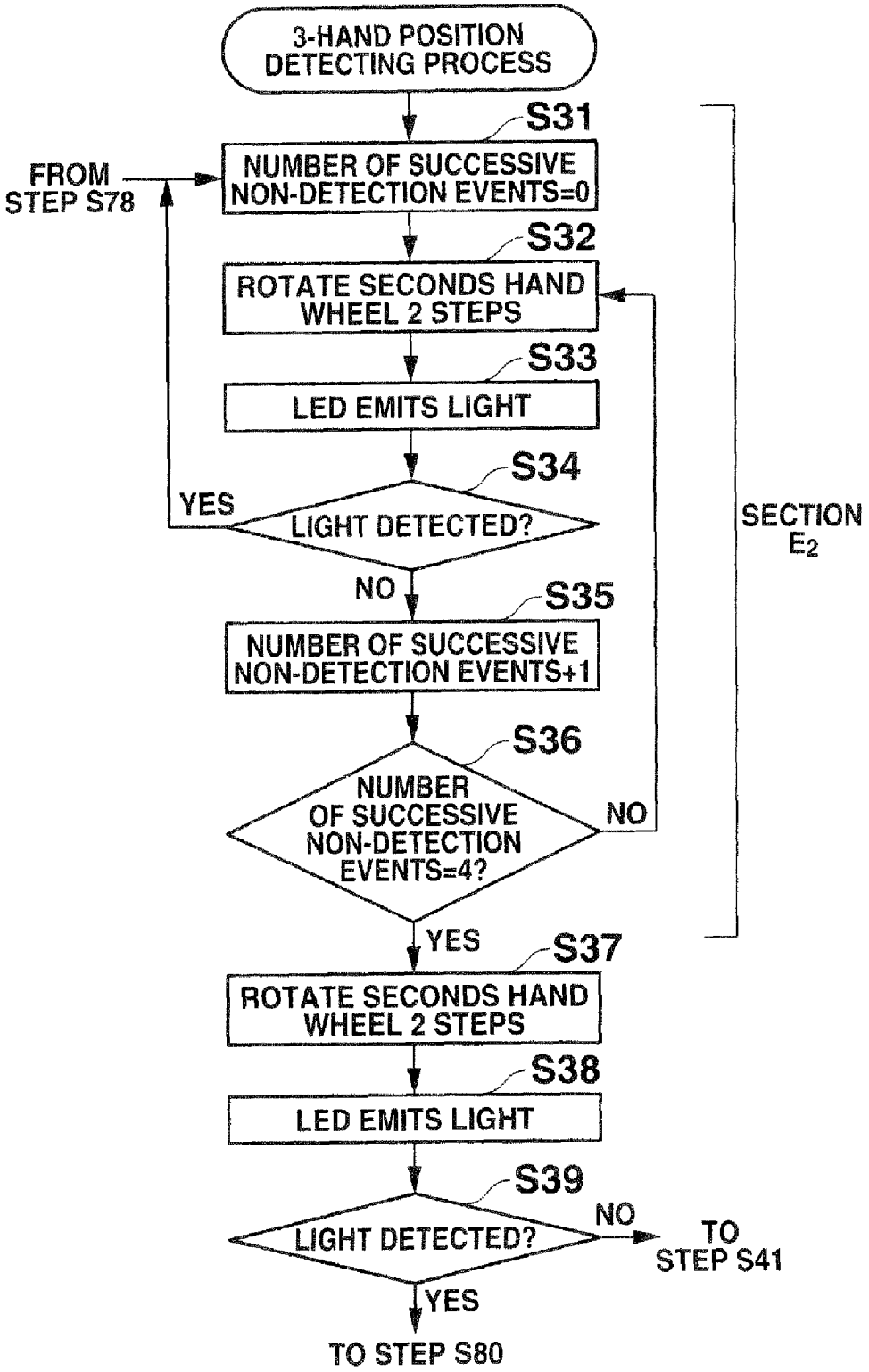
FIG. 21 illustrates a flowchart of a seconds hands position detecting process included in a basic three-hand position detecting process to move the seconds, center and hour hands to the detection position P.
Figure 22:
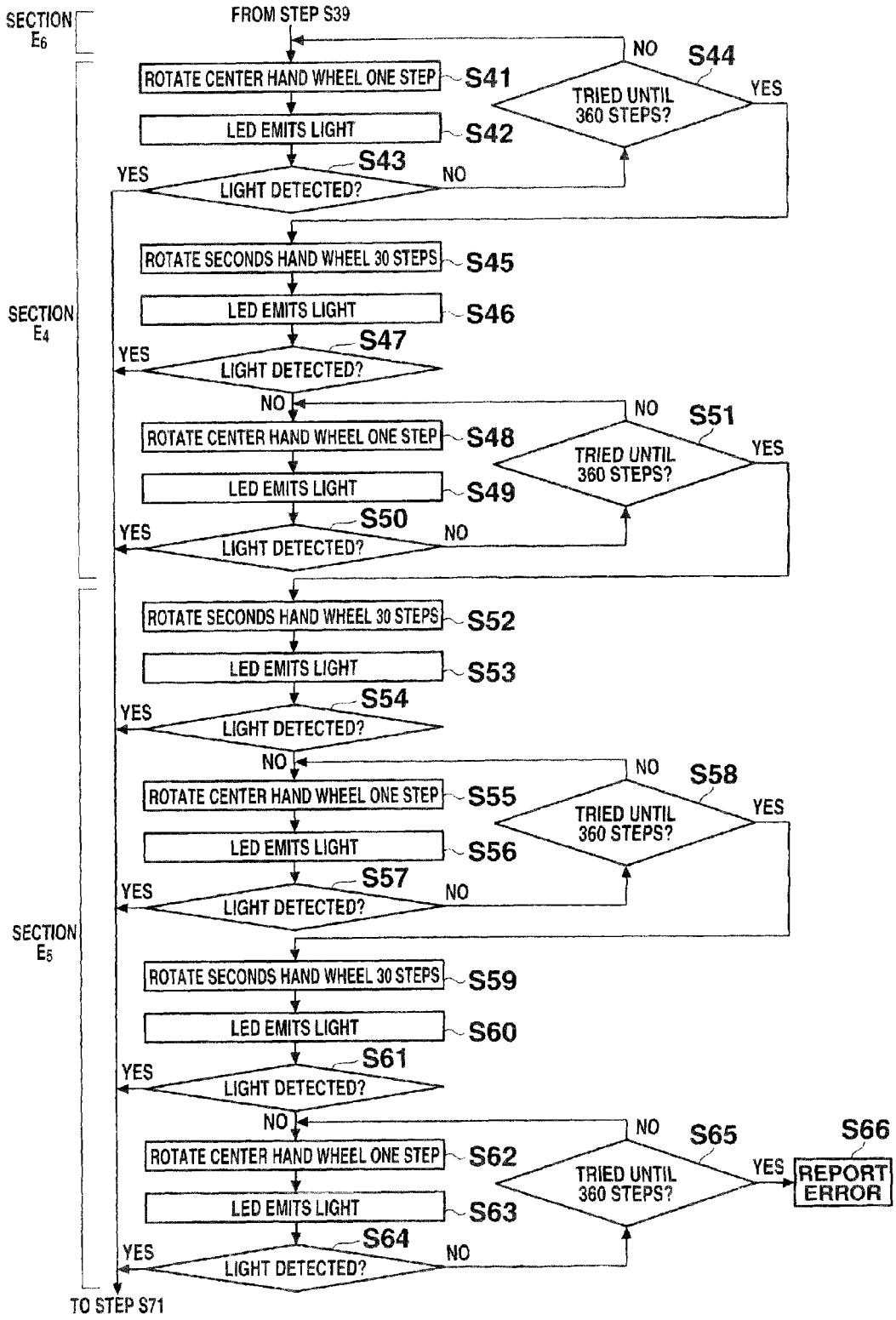
FIG. 22 illustrates a flowchart of a center hand position detecting process included in the basic three-hand position detecting process.
Figure 23:
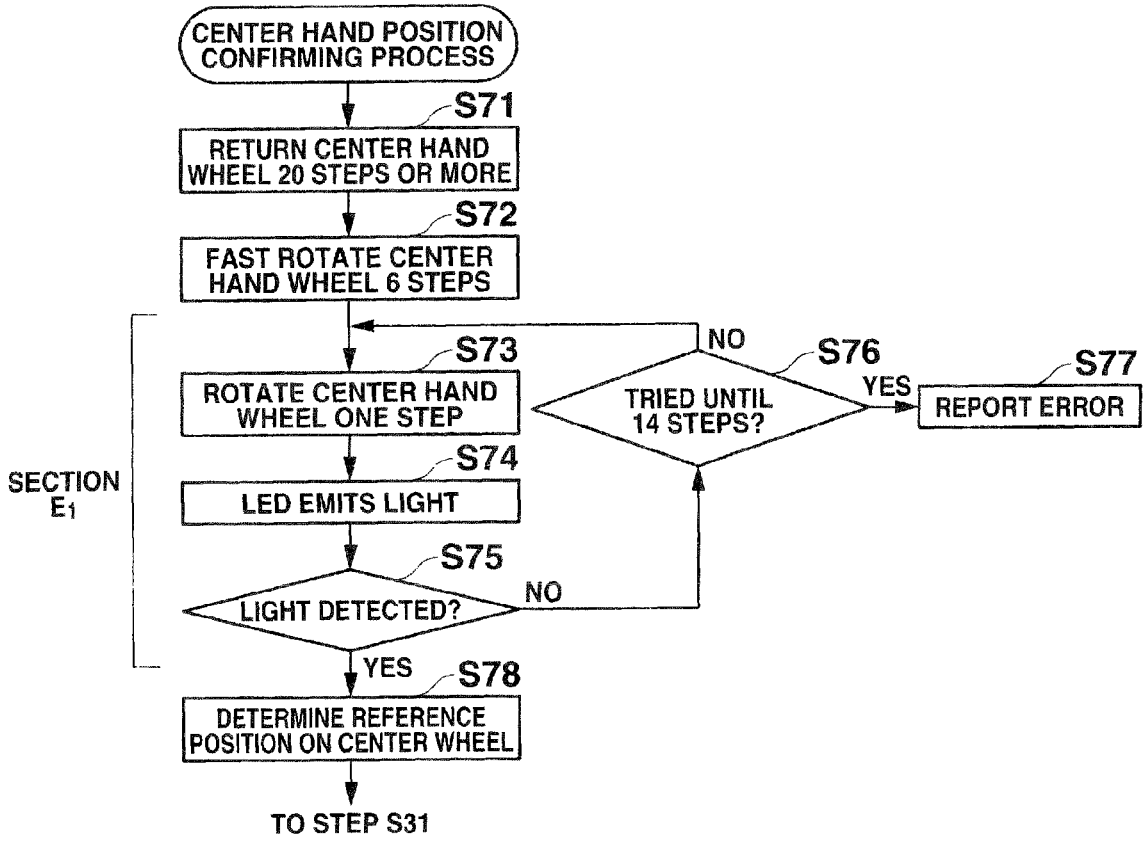
FIG. 23 illustrates a flowchart of a center hands position confirming process included in the basic three-hand position detecting process.
Figure 24:
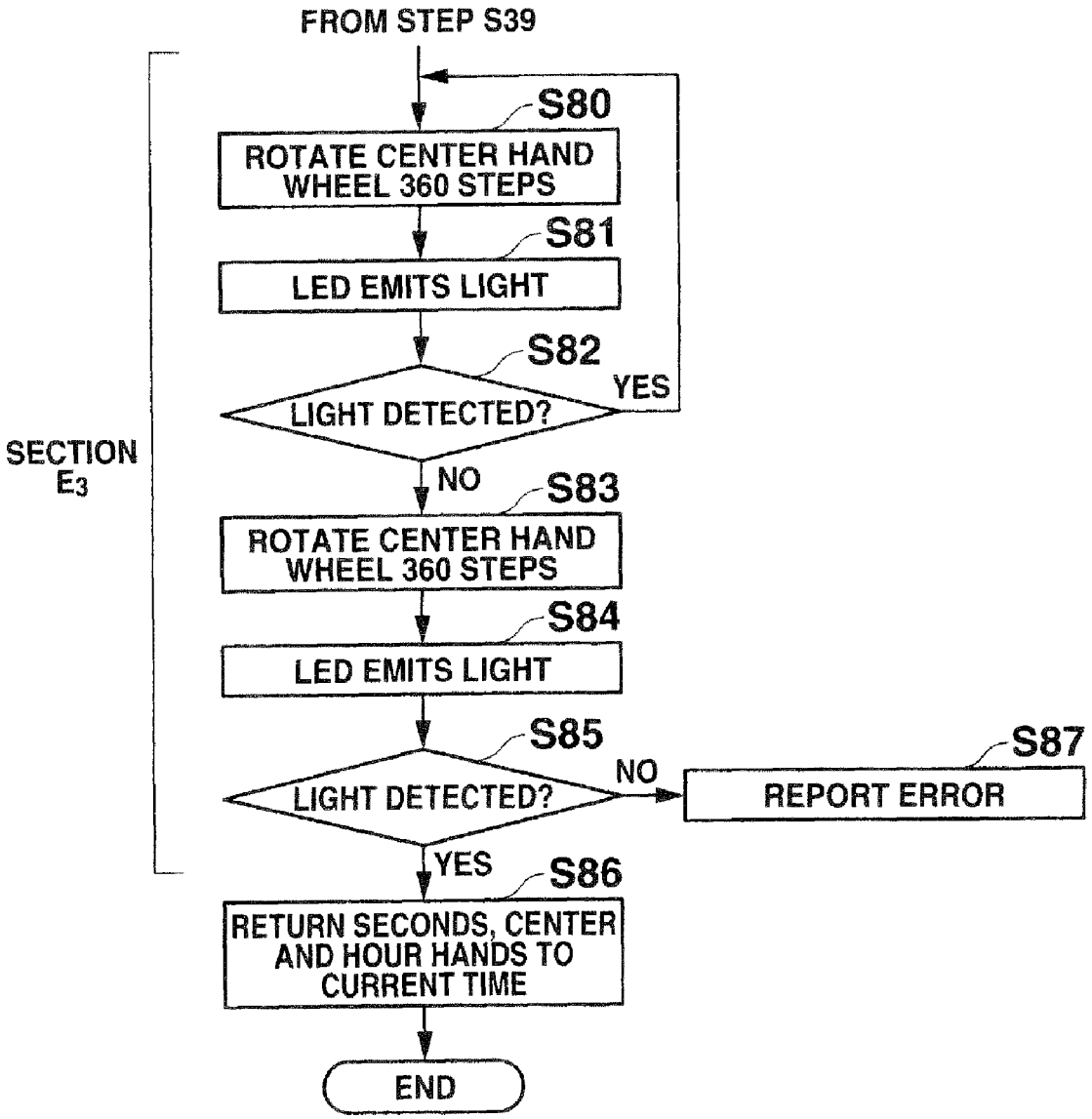
FIG. 24 illustrates a flowchart of a hour hand position detecting process included in the basic three-hand position detecting processes.

Referring to FIGS. 21-22, description will be made of a basic three-hand position detecting process for detecting the reference positions of the seconds, center and hour hands 2, 3 and 4 of the wristwatch. In this case, assume that none of the positions of the seconds, center and hour hands 2, 3 and 4 is known. This process involves a combination of the seconds hand position detecting process and the hour and center hand position detecting process. FIG. 21 shows steps S31-S39 of the seconds hand position detecting process. FIG. 22 shows steps S41-S66 of the center hand position detecting process. FIG. 23 shows steps S71-S78 of the center hand position detecting process. FIG. 24 shows steps S80-S87 of the hour hand position detecting process.

When this three-hand position detecting process starts, the seconds hand position detecting process of FIG. 21 is performed because none of the positions of the seconds, center and hour hands 2, 3 and 4 is known. To this end, the number of non-detection events which have occurred to the detection unit 13 and counted by a counter (not shown) which may be provided in the CPU 35 so far is cleared, thereby resetting the non-detection flag bit to 0 (step S31). Then, the seconds wheel 20 is rotated 2 steps (step S32). Then, the light emission element 31 is caused to emit light (step S33). Then, it is determined if the photo detection element 32 has received light from the light emission element 31 and hence if the detection unit 13 has detected light (step S34).

At this time, none of the rotational positions in the seconds, center and hour wheels 20, 25 and 27 is known. When the photo detection element 32 receives light from the photo-emission element 31 and the detection unit 13 detects light, the control returns to the step S31 to repeat the steps S31-S34 until one of the light blocking areas 21*d*-21*f* of the seconds wheel 20 covers the detection position P.

When the detection unit 13 detects light in the step S34, a relevant one of the apertures 21*a*, 21*b* and 21*c* in the seconds wheel 20; the apertures 28 and 30 in the center and intermediate wheels 25 and 23, respectively; and a relevant one of the apertures 29 in the hour wheel 27 have all aligned accidentally with the detection position P. At this time, the reference or 00 minute position in the center wheel 25 has aligned with the detection position P, but the rotational positions of the seconds and hour wheels 20 and 27 are unknown. Thus, first, the rotational position of the seconds wheel 20 is detected. To this end, the steps S31-S34 are repeated until any one of the light blocking areas 21*d*-21*f* in the seconds wheel 20 covers the detection position P, thereby disabling the detection unit 13 from detecting light.

When one of the light blocking areas 21*d*-21*f* in the seconds wheel 20 covers the detection position P, thereby disabling the detection unit 13 from detecting light in the step S34, this non-detection event having occurred to the detection unit 13 is counted by the counter and the non-detection flag bit is set to 1 (step S35). Then, it is determined if four non-detection events have occurred successively (step 36). Then, the steps S32-S36 are repeated until in the step S36 four non-detection events occur successively to the detection unit 13 due to the light blocking area 21*e* in the seconds wheel 20 covering the detection position P. When the four non-detection events occur successively to the detection unit 13, the seconds wheel 20 is rotated 2 steps (step S37), and the light emission element 31 is caused to emit light (step S38). Then, it is determined if the photo detection element 32 has received light from the light emission element 31, and hence if the detection unit 13 has detected light (step S39).

If the detection unit 13 has detected light in the step S39, it is determined that the reference or 00 minute position in the center wheel 25 has aligned with the detection position P, and that the aperture 28 in the center wheel 25, a relevant one of the apertures 29 in the hour wheel 27, and the aperture 21*a* in the seconds wheel 20 have aligned with the detection position P. Thus, it is determined that the respective reference positions in the seconds and center wheels 20 and 25 are at the 00-minute 00 seconds position. Then, the control passes to a step S80 for a hour hand position detecting process.

When in the step S39 the detection unit 13 detects no light, five non-detection events have occurred successively to the detection unit 13 even when the circular aperture 21*a* in the seconds wheel 20 has aligned with the detection position P, as shown in FIG. 143. Thus, it is determined that one of the apertures 28, 30 and 29 in the center, intermediate and hour wheels 25, 23 and 27 is offset from the detection position P. Then, the control passes to a step S41 in FIG. 22 to perform the center hand position detecting process.

As shown in FIG. 22, in the center hand position detecting process, the center wheel 25 is rotated one step or degree in the step S41; the light emission element 31 is caused to emit light (step S42); and then it is determined if the photo detection element 32 has received light from the light emission element 31, and hence if the detection unit 13 has detected light (step S43). If not, the center wheel 25 is rotated one step at a time, and then it is determined if the seconds wheel 25 has rotated 360 degrees (step S44). If not, the steps S41-S43 are repeated until the center wheel 25 makes one rotation.

When the detection unit 13 has detected light in the step S43, it will be seen that one of the apertures 21*a*, 21*b* and 21*c* in the seconds wheel 20; the apertures 28 and 30 in the center and intermediate wheels 25 and 23, respectively; and a relevant one of the apertures 29 in the hour wheel 27 have all aligned wholly or partially with the detection position P. It will also be seen that before the center wheel 25 started to be rotated in the step S41, the apertures in the center and hour wheels 25 and 27 has been offset from the detection position P. Since it is assumed that the detection unit 13 has now detected light, it is determined that the reference or 00-minute position in the center wheel 25 has aligned with the detection position P. Then the control passes to the step S71 to perform a center hand position confirming process to confirm if this determination is correct.

If the detection unit 13 detects no light even when the center wheel 25 is rotated 360 degrees in the step S44, it is determined that as shown in FIG. 14D that the apertures 21 has aligned neither wholly nor partially with the detection position P. Thus, the seconds wheel 20 is rotated 30 steps or 180 degrees (step S45), and the light emission element 31 is caused to emit light (step S46). Then, it is determined if the photo detection element 32 has received light from the light emission element 31, and hence if the detection unit 13 has detected light (step S47).

When in the step S47 the detection unit 13 has detected light, it will be seen that a relevant one of the apertures 21*a*, 21*b* and 21*c* in the seconds wheel 20; the apertures 28 and 30 in the center and intermediate wheels 25 and 23, respectively; and a relevant one of the apertures 29 in the hour wheel 27 have aligned wholly or partially with the detection position P, and that before the seconds wheel 20 started to be rotated in the step S45, the seconds wheel 20 has been offset from the detection position P. Also in this case, since it is assumed that in the step S47 the detection unit 13 has detected light, it is determined that the reference or 00 minute position in the center wheel 25 has aligned with the detection position P and then the control passes to a center hand position confirming process in the step S71.

However, if the detection unit 13 detects no light in the step S47 even when the seconds wheel 20 is rotated 30 steps or 180 degrees in the step S45, it is determined that as shown in FIG. 14E, the aperture 28 in the center wheel 25 is offset from the detection position P even when the aperture 21 in the seconds wheel 20 aligns wholly or partially with the detection position P. Thus, then the center wheel 25 is rotated one step (step S48).

Then, the light emission element 31 is caused to emit light (step S49), and then it is determined if the photo detection element 32 has received light from the light emission element 31, and hence if the detection unit 13 has detected light (step S50). If not, the center wheel 25 is rotated one step at a time, and then it is determined if the center wheel 25 has rotated 360 degrees (step S51). If not, the steps S48-S51 are repeated until the center wheel 25 makes one rotation.

When the detection unit 13 detects light in the step S50, it will be seen that a relevant one of the apertures 21*a*, 21*b* and 21*c* in the seconds wheel 20; the apertures 28 and 30 in the center and intermediate wheels 25 and 23, respectively; and a relevant one of the apertures 29 in the hour wheel 27 have all aligned wholly or partially with the detection position P, and that before the center wheel 25 started to rotate in the step S50, the aperture in the center wheel 25 had been offset from the detection position P. Since it is assumed that the detection unit 13 has now detected light in the step S50, it is determined that the reference or 00 minute position in the center wheel 25 has aligned with the detection position P. Then, the control passes to the step S71 for the center hand position confirming process.

If the detection unit 13 detects no light in the step S50 even when the center wheel 25 is rotated 360 degrees in the step S51, then it is determined that any of the apertures 29 in the hour wheel 27 is offset from the detection position P and that the light blocking area 29*a* in the hour wheel 27 covers the detection position P even when a relevant one of the apertures 21*a*, 21*b* and 21*c* in the seconds wheel 20; and the apertures 28 and 30 in the center and intermediate wheels 25 and 23, respectively, align wholly or partially with the detection position P, as shown in FIG. 11P.

At this time, it is not seen that any of the apertures 21*a*, 21*b* and 21*c* in the second wheel 20 has aligned wholly or partially with the detection position P. Thus, the seconds wheel 20 is rotated 30 steps or 180 degrees (step S52), and the light emission element 31 is caused to emit light (step S53). Then, it is determined if the photo detection element 32 has received light, and hence if the detection unit 13 has detected light (step S54).

When the detection unit 13 has detected light at this time, it will be seen that a relevant one of the apertures 21*a*, 21*b* and 21*c* of the seconds wheel 20; the apertures 21 and 28 in the seconds and center wheels 20 and 25, respectively; a relevant one of the apertures 29 in the hour wheel 27; and the aperture 30 in the intermediate wheel 23 have all aligned wholly or partially with the detection position P. It will also be seen that the light blocking area 29*a* of the hour wheel 27 does not cover the detection position P, and that before the seconds wheel 20 started to be rotated in the step S52, the aperture 21 in the seconds wheel 20 has been offset from the detection position P. Also, since it is assumed that the detection unit 13 has detected light, it is determined that at this time the reference or 00 minute position in the center wheel 25 has aligned with the detection position P. Then, the control passes to the step S71 for the center hand position confirming process.

When the detection unit 13 does not detect light in the step S54, it is determined that the fourth light blocking are 29*a* of the hour wheel 27 has blocked the detection position P, as shown in FIG. 11P. Thus, the center wheel 25 is rotated one step (step S55), and the light emission element 31 is caused to emit light (step 56). Then, it is determined if the photo detection element 32 has detected light from the light emission element 31, and hence if the detection unit 13 has detected light (step S57). If not, the center wheel 25 is rotated one step at a time, and then it is determined if the center wheel 25 has been rotated 360 degrees (step S58). If not, then the steps S55-S57 are repeated until the center wheel 25 makes one rotation.

When the detection unit 13 has detected light in the step S57, a relevant one of the apertures 21*a*, 21*b* and 21*c* of the seconds wheel 20; the apertures 28 in the center wheel 25; a relevant one of the apertures 29 in the hour wheel 27; and the aperture 30 in the intermediate wheel 23 have aligned all wholly or partially with the detection position P. Thus, the light blocking area 29*a* of the hour wheel 27 does not block the detection position P and before the center wheel 25 started to be rotated in the step S55, the aperture 28 in the center wheel 25 has been offset from the detection position P. Since it is now assumed that in the step S57 the detection unit 13 has detected light, it is determined that the reference or 00 minute position in the center wheel 25 has aligned with the detection position P. Then, the control passes to the step S71 for the center hand position confirming process.

If the detection unit 13 has detected no light in the step S57 even when the center wheel 25 is rotated 360 degrees in the step S58, it is conjectured that the light blocking area 29 of the hour wheel 27 has blocked the detection position P and hence that the hour wheel 27 is at the 11 o'clock position. In order to confirm if this conjecture is correct, the seconds wheel 20 is rotated 30 steps or 180 degrees (step S59); the light emission element 31 is caused to emit light (step S60); and then it is determined if the photo detection element 32 has received light from the light emission element 31 and hence if the detection unit 13 has detected light (step S61).

If at this time the detection unit 13 has detected light, a relevant one of the apertures 21*a*, 21*b* and 21*c* of the seconds wheel 20; the aperture 28 in the center wheel 25, a relevant one of apertures 29 in the hour wheel 27, and the aperture 30 in the intermediate wheel 23 have all aligned wholly or partially with the detection position P. Thus, it will be seen that the 11 o'clock position of the hour wheel 27 is not at the detection position P and that before the seconds wheel 20 started to be rotated in the step S59 the aperture in the seconds wheel 20 had been offset from the detection position P. Also, since it is now assumed that the detection unit 13 has detected light, it is determined that the reference or 00 minute position in the center wheel 25 has aligned with the detection position P. Then, the control passes to the step S70 for the center hand position confirming process.

When in the step S61 the detection unit 13 detects no light, it is determined that the light blocking area 29*a* of the hour wheel 27 has blocked the detection position P. Thus, the center wheel 25 is rotated one step (step S62). Then, the light emission element 31 is caused to emit light (step S63) and it is determined if the photo detection element 32 has received light from the light emission element 31 and hence if the detection unit 13 has detected light (step S64).

If at this time the detection unit 13 detects no light, the center wheel 25 is rotated one step at a time and then it is determined if the center wheel 25 has rotated 360 degrees (step S65). If not, the steps S62-S64 are repeated until the center wheel 25 rotates 360 degrees. If the detection unit 13 detects no light even when the steps S62-S64 are repeated, a hand position detection error is reported with a stop position of the seconds hand 2 or buzzer sound (step S66). When in the step S64 the detection unit 13 detects light, it is determined that the reference or 0 o'clock and 00 minute positions in the hour and center wheels 27 and 25, respectively, have aligned with the detection position P. Then, the control passes to the step S71 for the center hand position confirming process.

As shown in FIG. 23, in the center hand position confirming process, the center wheel 25 is returned 20 steps counterclockwise from its position where the detection unit 13 has detected light, or 14 degrees or more necessary for the aperture 28 in the seconds wheel 25 to be substantially completely away from the detection position P (step S71). Then, the center wheel 25 is fast rotated 6 steps clockwise from its position to which the center wheel 25 has been returned (step S72). Thus, any possible backlash between the center and intermediate wheels 25 and 23 is eliminated and the center wheel 25 is put in a state where the center wheel 25 has been returned 14 steps counterclockwise from its position where the detection unit 13 detected light.

That is, the center wheel 25 has been returned 14 steps or 12 degrees or more necessary for the aperture 28 in the center wheel 25 to move away substantially completely from the detection position P. Then, the center wheel 25 is again rotated clockwise one step from its position where the center wheel 25 has been returned (step S73). Then, the light emission element 31 is caused to emit light (step S74) and it is determined if the photo detection element 32 has received light from the light emission element 31 and hence if the detection unit 13 has detected light (step S75).

Unless the detection unit 13 detects light in the step S75, the steps S73-S75 are repeated until the center wheel 25 is rotated by 14 steps (step S76). In the step S75 the detection unit 13 should necessarily detects light. However, otherwise, a hand position detection error is reported with a stop position of the seconds hand 2 or buzzer sound (step S77). If in the step S75 the detection unit 13 detects light, it is determined that the position of the aperture 28 in the center wheel 25 which has aligned at this time with the detection position P is the reference or 00 minute position in the center wheel 25 (step S78).

Also in this case, it is unclear if the reference position in the seconds wheel 20 has aligned with the detection position P. Thus, the control returns to the step S31 for the second hand position detecting process to perform the steps S31-S39, thereby rotating the seconds wheel 20 so that its reference position aligns with the 00-minute 00-seconds position or the detection position P. Then, the control passes to a step S80 for the hour hand position detecting process shown in FIG. 24. In the step S80, the reference positions in the seconds and center wheels 20 and 25 have aligned with the detection position P. Thus, the center wheel 25 is rotated 360 degrees, thereby rotating the hour wheel 27 by 30 degrees. Then, the light emission element 31 is caused to emit light (step S81), and it is determined if the photo detection element 32 has received light from the light emission element 31 and hence if the detection unit 13 has detected light (step S82).

At this time, when the detection unit 13 detects light each time the hour wheel 27 rotates 30 degrees, the respective apertures 29 in the hour wheel 27 sequentially align with the detection position P and the hour wheel 27 comes to its related hour position. Thus, the control returns to the step S80 to repeat the steps S80-S82 until the light blocking area 29*a* at the 11 o'clock position in the hour wheel 27 covers the detection position P. Unless the detection unit 13 detect light, it is determined that the light blocking area 29*a* of the hour wheel 27 has blocked the detection position P and that the 11 o'clock position of the hour wheel 27 has aligned the 11 o'clock position with the detection position P.

In order to confirm if this determination is correct, the center wheel 25 is again rotated 360 degrees, thereby rotating the hour wheel 27 30 degrees (step S83). Then, the light emission element 31 is caused to emit light (step S84). It is then determined if the photo detection element 32 has received light from the light emission element 31 and hence if the detection unit 13 has detected light (step S85). If so, it is determined that the reference positions in all the seconds, center and hour wheels 20, 25 and 27 are at the 0-o'clock 00-minute 00-seconds position which has aligned wholly or partially with the detection position P. Thus, the seconds, center and hour hands 2, 3 and 4 are set to the exact current time (step S86) and then switched over to the normal driving operation, thereby terminating this process. In the step S85, the detection unit 13 should necessarily detect light. Otherwise, a hand position detection error is reported with a stop position of the seconds hand 2 or buzzer sound (step S87).

Then, referring to FIG. 25, description will be made of a hand position confirming process to confirm if the seconds, center and hour hands 2, 3 and 4 are set correctly, five minutes before each of 1-12 o'clock hours or at the 55th minute of each of the 1-12 o'clock hours in the normal hand rotating operation. In this process, the detection unit 13 tries to detect light at the 55th minute of every hour excluding at the 55th minute of each of the 10 and 12 o'clock hours.

If this process is performed at every hour on the hour, it would coincide with generation of a time/alarm signal or other various operations expected to be performed. Thus, this process is preferably performed several minutes before each of 1-12 o'clock hours. In this case, the hour wheel 27 rotates one degree per 12 minutes. Thus, even when this process is performed 10 minutes or so offset from every hour on the hour, the aperture 29 does not completely move away from the detection position P. Therefore, the detection unit can detect light.

When the detection unit 13 detects light in the process, the hour hand 4 is regarded as being set correctly. Then, it is confirmed if the seconds hand 2 and 3 are set correctly. In this case, this process can be confirmed only when the center hand 3 is fast or slow by less than 60 minutes from the related starting time. When 10 seconds elapses from the related starting time, the center wheel 25 is rotated one step and thus the intermediate wheel 23 rotates 30 degrees, thereby blocking the detection position P. Thus, it is necessary to confirm in 10 seconds from the related starting time if the seconds hand 2 is fast or slow.

To this end, the hand position confirming process starts at the 55th minute of every hour excluding 11 and 22 o'clock hours. Then, the light emission element 31 is caused to emit light (step S90). Then, it is determined if the photo detection element 32 has received light from the light emission element 31 and hence if the detection unit 13 has detected light (step S91). If not, it is determined that at least one of the seconds, center and hour hands 2, 3 and 4 is fast or slow and then the control passes to the three-hand position detecting process.

If the detection unit 13 detects light, it is determined that one of the apertures 21*a*, 21*b* and 21*c* in the seconds wheel 20 has aligned wholly or partially with the detection position P. Then, the counted number of non-detection events having occurred to the detection unit 13 and counted so far is cleared, thereby resetting the non-detection flag bit to zero (step S92). Then, the seconds wheel 20 rotates one step or 6 degrees in the normal manner, thereby causing the seconds hand 2 to rotate around the dial in the normal manner (step S93). Then, it is determined if the seconds wheel 20 has rotated 2 steps or 12 degrees (step S94). When the seconds wheel 20 rotates only one step or 6 degrees, the circular aperture 21*a* in the seconds wheel 20 does not completely move away from the detection position P. Thus, the detection 13 tries to detect light each time the seconds wheel 20 rotates 2 steps.

Unless in the step S94 the seconds wheel 20 rotates 2 steps, the seconds hand 2 is caused to rotate around the dial one step (or 6 degrees) at a time in the normal manner until the seconds wheel 20 rotates 2 steps, whereupon it is determined at which of 2, 4, 6 and 8 seconds positions the light emission element 31 is (step S95). In this case, since the first stepping motor 17 cannot operate correctly due to external factors such as external magnetic field, it can occur that the seconds hand 2 is not at any of the 2, 4, 6 and 8 seconds positions. In this case, a hand position detection error is reported with a stop position of the seconds hand 2 and/or buzzer sound (step S96).

If it is determined in the step S95 that the seconds hand 2 is at one of the 2, 4, 6 and 8 seconds positions, the light emission element 31 of the detection 13 is caused to emit light without being influenced by external factors such as external magnetic field (step S97). Then, it is determined if the photo detection element 32 has received light from the light emission element 31 and hence if the detection unit 13 has detected light (S98). When at this time the detection unit 13 detects light, a relevant one of the apertures 21*a*, 21*b* and 21*c* in the seconds wheel 20 has aligned wholly or partially with the detection position P. Hence, it is determined that the seconds wheel 20 was not set exactly before the step S93 and then the control passes to the three-hand position detecting process.

When in the step S98 the detection unit 13 detects no light, it is determined that as shown in FIG. 15B, one of the blocking areas 21*d*-21*f* of the seconds wheel 20 has blocked the detection position P. Thus, this non-detection event is counted and the non-detection flag bit is set to 1 (step S99). Then, it is determined if non-detection events have occurred three times successively (step S100). If not, the control returns to the step S93 to cause the seconds hand 2 to rotate around the dial in the normal manner to repeat the steps S93-S100.

If in the step S100 three non-detection events have occurred successively when 6 seconds elapses from the 55th minute of every hour, which brings about, for example, a change in the state from FIG. 15B to FIG. 15D, it is determined that one of the light blocking areas 21*d* and 21*e* of the seconds wheel 20 has blocked the detection position P. Thus, the seconds wheel 20 is rotated one step or 6 degrees, thereby causing the seconds hand 2 to sweep around the dial in the normal manner (step S101). It is then determined if the seconds wheel 20 has rotated 2 steps (step S102). If not, the seconds hand 2 is caused to rotate around the dial in the usual manner until the seconds wheel 20 rotates 2 steps.

When the seconds wheel 20 rotates 2 steps, the light emission element 31 is caused to emit light (step S103). Then, it is determined if the photo detection element 32 has received light from the light emission element 31 and hence if the detection unit 13 has detected light when 8 seconds elapses from the 55th minute of every hour (step S104). If not, it is determined that the light blocking area 21*e* of the seconds wheel 20 has blocked the detection position P and hence that the seconds wheel 20 is not at its correct rotational position. Thus, the control passes to the three-hand position detecting process. As shown in FIG. 15E, when in the step S104 the detection unit 13 detects light, the aperture 21*b* in the seconds wheel 20 has aligned partially with the detection position P. Thus, it is determined that the seconds wheel 20 is not at its correct rotational position. Then, the seconds wheel 20 is switched over to the normal rotating operation. Then, this process is terminated.

Figure 26:
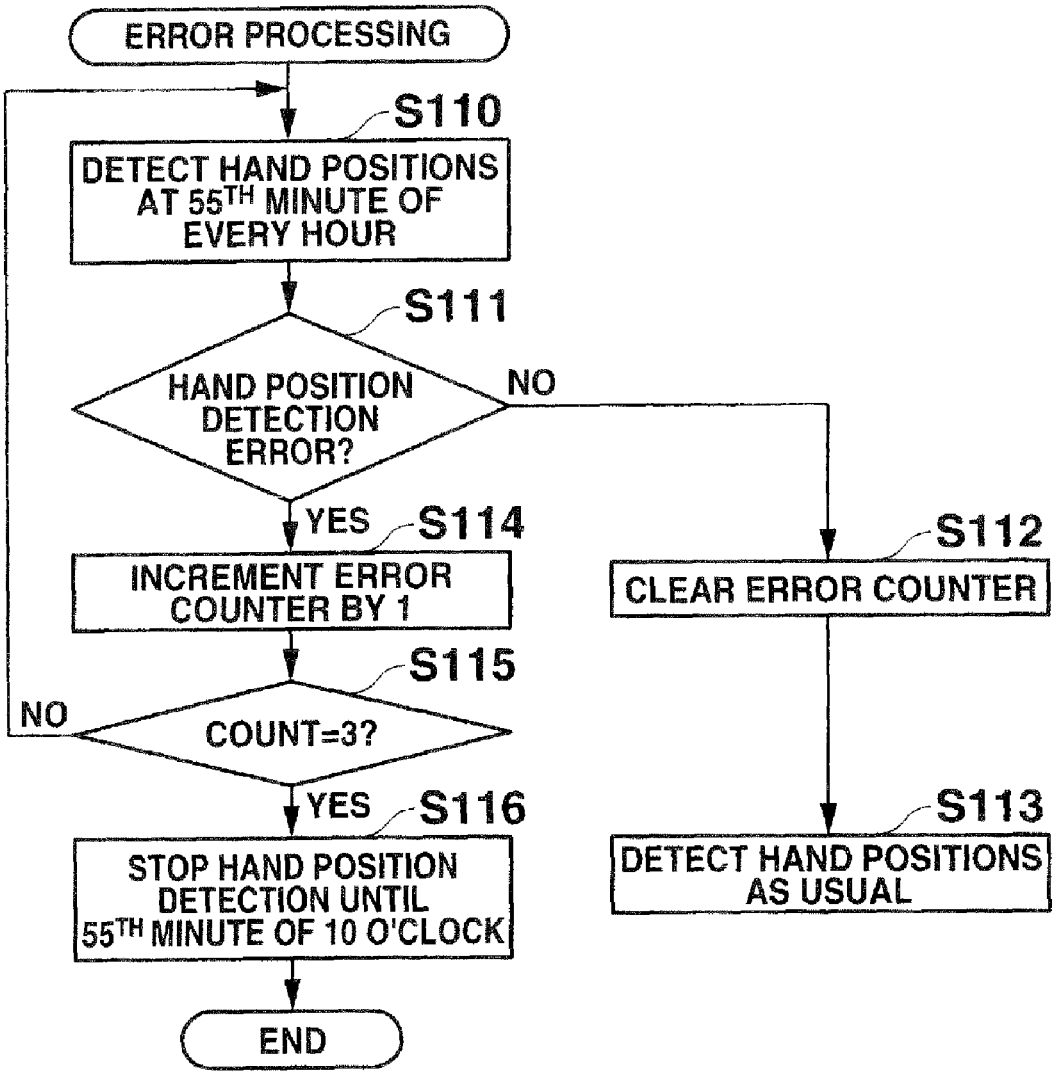
FIG. 26 is a flowchart of error processing which stops the detection of hand positions when hand position detection errors have occurred successively.

Next, referring to FIG. 26, error processing will be described which stops the hand position detecting process when hand position detection errors have occurred successively. This error processing includes passing to the three-hand position detecting process in the respective steps S91, S98 and S104 of the hand position confirming process of FIG. 25 which is performed at the 55th minute of every hour, and when hand position detection errors have occurred successively in the three-hand position detection process and the hand position confirming process, then stopping the hand position detection process until the 55th minute of one of the 10 and 22 o'clock hours in the future which is nearer the time when the hand position detection errors have occurred.

More particularly, this error processing starts, the hand position confirming process involving the steps S90-S104 is performed (step S110). Then, the control can pass to the three-hand position detection process at the respective steps S91, S98 and S104 to determine if a hand position detection error has occurred in the three-hand position detection process and the hand position confirming process (step S111). If not, an error counter (not shown) is cleared to zero (step S112) and then the hand position confirming process is performed at the 55th minute of every hour on the hour as usual (step S113).

When it is determined in the step S111 that a hand position detection error has occurred, the error counter counts this error event as one (step S114) and then determines if such errors have occurred successively a predetermined number of times (in this embodiment, three times) so far (step S115). If not, the control returns to the step S110 to repeat the steps S110 to S115 until hand position detection errors occur successively three times.

When it is determined in the step S115 that the hand position detection errors have occurred successively three times, the contents of those errors are stored in the RAM 37 and then the hand position detection process including the hand position confirming process involving the steps S90-S104 of FIG. 25 is stopped until a predetermined time (in this embodiment, the 55th minute of the next 10 o'clock hour) and this process is terminated (step S116). Then, the hand positions are adjusted manually.

Next, referring to FIG. 27, a display of the hand position detection errors will be described. In this process, when three predetermined ones of push-button switches SW (FIG. 17) provided on a side of the case TK are depressed simultaneously in the normal hand rotating mode, an error display mode is selected and a list of hand position detection errors of FIG. 27 stored in the RAM 37 is displayed. In this list, as shown in FIG. 27, those errors are allotted respective numbers (0-8, D and E) each indicative of an error type and have corresponding stop positions of the seconds hand 2. When an error occurs, the seconds hand 2 is stopped at a corresponding predetermined position, thereby displaying the type of that error.

Error No. 0: This indicates that the hands are detected at their correct positions and that the seconds hand 2 is stopped at a 55 seconds position.

Error No. 1: In the center hand position confirming process of FIG. 23, the center hand 3 can be wrongly determined as being at a correct position 12 steps before its proper position. In this case, in a section E1 of FIG. 23, the steps S73-S77 are performed which include returning the center hand 3 fourteen steps from the position where the center hand position was wrongly determined and then confirming if light has been detected by rotating the center hand 3 reversely one step at a time. If no light is detected even when 14 steps are reached, it is determined that Error 1 has occurred and then this error is reported (step S77). At this time, the seconds hand 2 is stopped at a 3 seconds position.

Error No. 2: In a section E2, the steps S31-S36 are performed to confirm that the number of places, where no light is detected successively four times when the seconds hand 2 makes a rotation in 60 steps, 2 steps at a time, is one in the three-hand position detection process of FIG. 21. If no light is detected even when the seconds wheel 2 is rotated 60 steps, Error No. 2 occurs and the seconds hand 2 is stopped at a 6 seconds position.

Error No. 3: In a section E3, each time the center hand 3 is rotated 360 degrees, the steps S80-S85 are performed to confirm optical detection of a respective one of the 11 apertures 29 provided at angular intervals of 30 degrees along the periphery of the hour wheel 27 in the three-hand position detection process of FIG. 24. When light is detected successively 12 times, Error No. 3 is reported as occurring (step S87). In this case, the seconds hand 2 is stopped at a 9 seconds position.

Error No. 4: This error occurs in a section E6 when no light is detected in the step S39 of FIG. 21 and then the control passes to the step S41 of FIG. 22 in the three-hand position detection process in a state where flags A and B are set on the RAM 37 in a section E4 for the S41-S51 and in a section E5 for the steps S52-S66, respectively, in the three-hand position detection process of FIG. 22. In this case, the second hand 2 is stopped at a 12 seconds position.

Error No. 5: In a section E7, the steps S93-S98 are performed to confirm if the seconds hand 2 has been rotated 2 steps in the hand position confirming process which is performed at the 55th minute of every hour in the normal hand rotating operation of FIG. 25. This error occurs when the first stepping motor 17 does not work correctly due to an external factor such as external magnetic field applied thereto although the output terminals are set from which pulses are applied to the first stepping motor 17 of the first driving system 11 (step S96). In this case, the seconds hand 2 is stopped at a 15 seconds position.

Error No. 6: This error occurs when light has been detected successively 11 times and then not in a next trial in the steps S52-S66 in a period E5 of the three-hand position detection process of FIG. 22 (step S66). In this case, seconds hand 2 is stopped at a 18 seconds position. Error No. 7: This error occurs when no light is detected in the three-hand position detection process of FIGS. 21-24 and in the hand position confirming process performed at the 55th minute of every hour on the hour in FIG. 25 because one or more of the seconds, center and hour hands 2, 3 and 4 cannot be rotated due to being caught in the wristwatch or the device is broken. In this case, the seconds hand 2 is stopped at a 21 seconds position.

Error No. 8: This error can occur after at least one light detection has been performed successfully in the three-hand position detecting process of FIGS. 21-24 and in the hand position confirming process of FIG. 25 which is performed at the 55th minute of every hour. In this case, the seconds hand 2 is stopped at a 24 seconds position. The above-mentioned errors Nos. 1-8 occur in the wheel system.

Error No. D: This error occurs when no light is detected because any of the light emission element 31 and the photo detection element 32 of the detection unit 13 is broken, thereby making light detection impossible. In this case, the seconds hand 2 is stopped at a 39 seconds position. Error No. E: This error occurs when no light can be detected because the CPU 35 of the wristwatch is broken or some electric parts are badly soldered on the circuit board. In this case, the seconds hand 2 is stopped at a 42 seconds position. The above-mentioned errors Nos. D and E occur in the circuit system.

As described above, the hand position detecting device comprises the detection unit 13 for detecting passage of light through the plurality of apertures 21, 28, 29 and 30 provided in the seconds, center, hour and intermediate wheels 20, 25, 27 and 30, respectively, the wheels 20, 25 and 30 having the hands 2, 3 and 4, respectively; the position detecting unit (CPU 35, steps S31-S86) for detecting the respective positions of the hand wheels on the basis of a transmitted state of light detected by the detection unit 13; and the position detection controlling unit (CPU 35, S110-S117) for stopping the position detecting unit from detecting the hand wheel positions until a predetermined time when the position detecting unit has failed to detect the positions of the hand wheels successively the predetermined number of times. Thus, when the respective positions cannot be detected, useless consumption of battery power is prevented which would otherwise occur.

Assume that hand position detection errors in which the position detection unit (CPU 35) cannot detect the respective positions of the seconds hand 2, center hand 3 and hour hand 4 occur successively a predetermined number of (3) times (steps S31-S86). In this case, the position detection controlling unit (CPU 35) stops the position detection unit from detecting the respective positions of the seconds hand 2, center hand 3 and hour hand 4 until the predetermined time, for example, the 55th minute of the next 10 o'clock hour (steps S110-S117). This prevents unnecessary repetition of detection of the positions of these hands 2, 3 and 4 which would otherwise be performed, and hence useless consumption of battery power.

In this case, the position detection error reporting unit (CPU 35, S66, S77, S87 and S96) is responsive to the position detecting unit (CPU 35, S31-S86) failing to detect the respective positions of the seconds, center and hour hands 2, 3 and 4 to report a hand position detection error with indication of a stop position of the seconds hand 2 or buzzer sound. Thus, when a position detection error occurs, the error can be reported rapidly.

This hand position detection device comprises the plurality of push-button switches SW which compose an operation unit to be operated to select one of the normal hand rotating mode in which the seconds, center and hour hands 2, 3 and 4 are normally rotated around the dial and the error display mode in which the contents of a hand position detection error occurring are displayed. Thus, when, for example, the three predetermined ones of the plurality of push-button switches SW are depressed simultaneously in the normal hand rotating mode, the error display mode is selected, thereby displaying the contents of the hand position detection error. In this error display mode, the contents of the error are indicated by the stop position of the seconds hand 2. Thus, the contents of the error can be seen easily and hence hand position adjustment or repair can be performed easily and rapidly.

The hand position detection device comprises the seconds wheel 20 with the aperture 21, the center wheel 25 with the aperture 28, and the hour wheel 27 with the 11 apertures 29 provided at the corresponding 1-11 o'clock positions excluding at a specified o'clock position along the periphery thereof. Thus, the position detection unit (CPU 35) detects the respective positions of the seconds, center and hour hands 2, 3 and 4 several minutes before every hour on the hour or at the 55th minute of every hour on the hour, thereby achieving good detection (steps S31-S86). If the hand position detection unit detects the respective positions of these hands 2, 3 and 4 at every hour on the hour, this processing would coincide with generation of a time signal and/or an alarm which are expected to be performed, thereby decreasing the battery power which would influence the position detection adversely.

In this hand position detection device, the position detection controlling unit (CPU 35) stops the detection of the respective positions of the second, center and hour hands 2, 3 and 4 (steps S110-S116) for a time period ranging from when the last of the predetermined number of (in this embodiment, 3) successive errors has occurred to several minutes before the specified next 11 o'clock hour, or more particularly, the 55th minute of the specified next 10 o'clock hour. Thus, when the positions of the seconds, center and hour hands 2, 3 and 4 cannot be detected, they are not required to be detected at the 55th minute of every hour. Since the detection of the positions of the seconds, center and hour hands 2, 3 and 4 is normally performed at the 55th minute of every hour, it is stopped for a maximum of about 12 hours, thereby preventing useless consumption of battery power, which would otherwise occur.

(Modification)

In the above embodiment, the center hand position detecting unit is illustrated as configured such that the center wheel 25 is rotated one step at a time in a predetermined direction to a position where the aperture 28 in the center wheel 25 aligns with the aperture 30 in the intermediate wheel 23, thereby causing the detection unit 13 to detect light passing through the aligning apertures 28 and 30 in the center and intermediate wheels 25 and 23; then the center wheel 25 is returned 20 steps from the position of the aperture 28 in the center wheel 25 where the detection unit 13 detected light; then the center wheel 25 is fast rotated 6 steps in the predetermined direction from the position where the center wheel 25 is returned; the center wheel 25 is rotated one step at a time in the predetermined direction from the position where the center wheel 25 was returned 14 steps finally, thereby causing the detection unit 13 to try to detect light; and when the detection unit 13 detects light again at the same position of the aperture 28 in the center wheel 25 where the detection unit 13 detected light, this position is determined as the reference position in the center wheel 25. Alternatively, the center hand position detecting unit may be constituted as a modification which performs a center hand position detecting process, for example, shown in FIG. 28.

Figure 28:
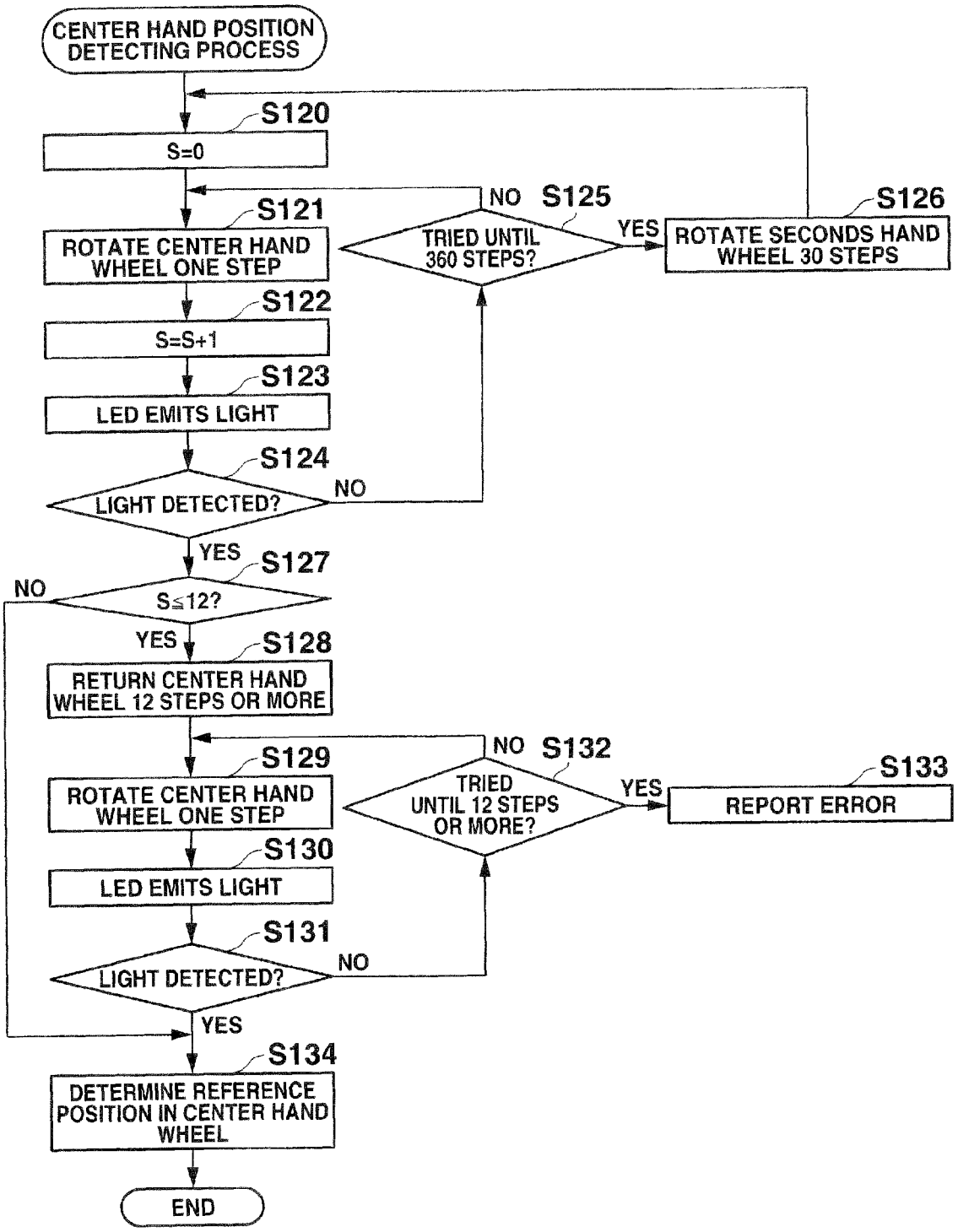
FIG. 28 is a flowchart of a center hand position detection process to be performed by a modification of the center hand position detecting means for the center wheel.
Figure 29:
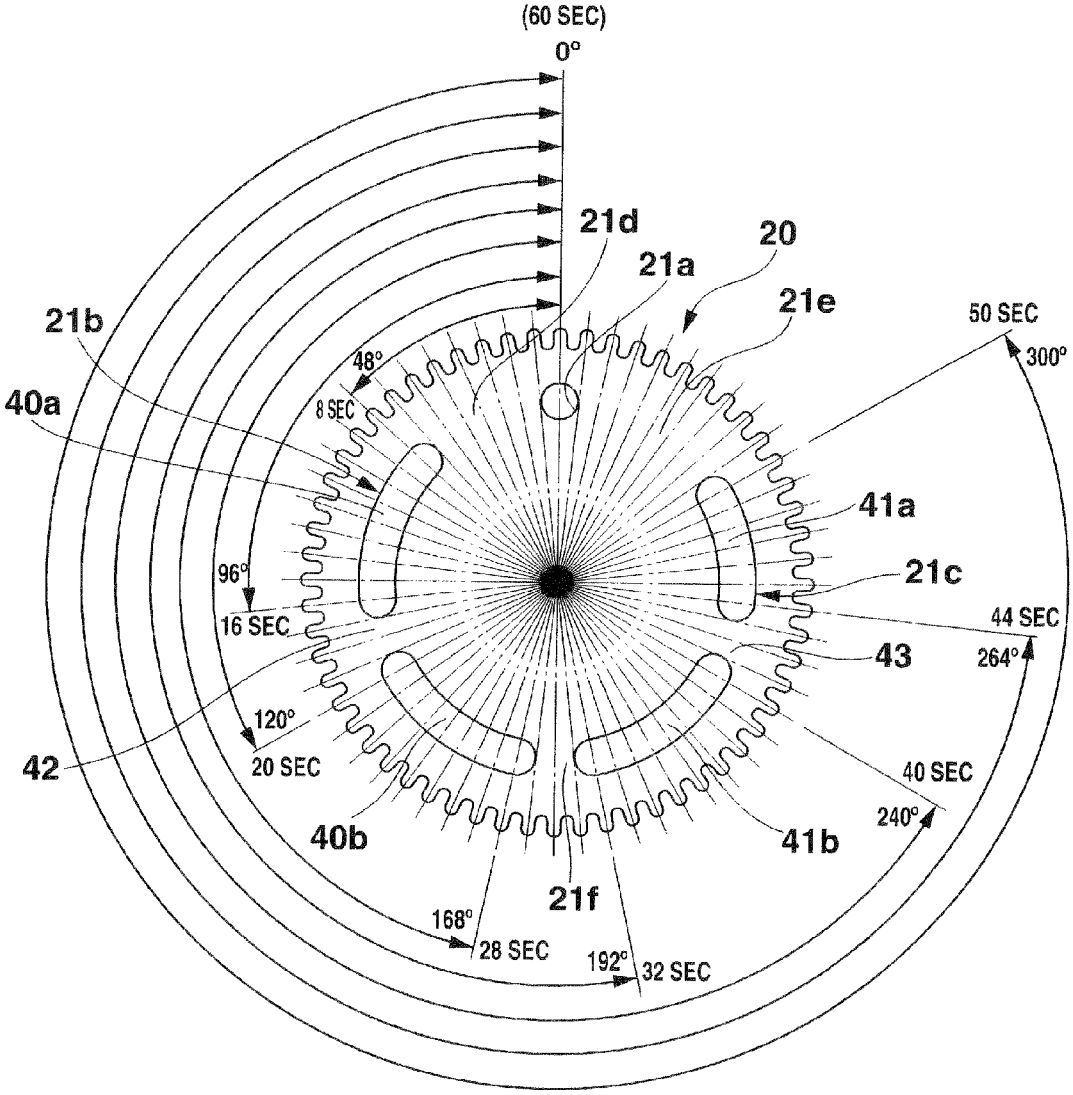
FIG. 29 is an enlarged plan view of a modification of the seconds wheel.

As shown in FIG. 28, when this process is started by this modification, a counter (not shown) which has counted the number of steps the center wheel 25 rotated so far is cleared to 0 (S=0) (step S120). Then, the center wheel 25 rotates one step or degree (step S121). This step is counted (S=S+1) (step S122). Then, the light emission element 31 is caused to emit light (step S123). It is then determined if the photo detection element 32 has received light from the light emission element 31 and hence if the detection unit 13 has detected light (step S124). If not, the steps S121-S124 are repeated until the center wheel 25 rotates 360 degrees or one hour (step S125).

If the detection unit 13 detects no light even when the center wheel 25 rotates 360 degrees for one hour, it is determined that any of the apertures 21*a*, 21*b* and 21*c* in the seconds wheel 20 has aligned neither wholly nor partially with the detection position P. Thus, the seconds wheel 20 is further rotated 30 steps or 180 degrees, thereby causing a relevant one of the apertures 21*a*, 21*b* and 21*c* in the seconds wheel 20 to align wholly or partially with the detection position P (step S126). Then, the control returns to the step S120, thereby clearing the counter which has counted the number of steps of the center wheel 25 counted so far to 0. Then, the step S121-S125 are repeated until the center wheel 25 rotates 360 degrees or one hour by rotating one step at a time.

When the detection unit 13 detects light in the step S124, it is determined that the reference or 00 minute position in the center wheel 25 has aligned with the detection position P, and then the number of steps of the center wheel 25 counted so far is recorded in the RAM 37. Then, it is determined if the number of steps counted is within a predetermined number of (12) steps (S≦12) (step S127). That is, when the center wheel 25 rotates 12 steps, its aperture 28 is substantially completely away from the detection position P, but the detection unit 13 can detect light due to possible manufacturing errors involving, for example, the assembly of the wristwatch.

Thus, if the number of steps the center wheel 25 has been rotated so far when the detection unit 13 detected light in the step S127 is equal to or within 12, it is necessary to confirm if the determination that the reference position in the center wheel 25 has aligned with the detection position P is correct. To this end, the center wheel 25 is returned counterclockwise 12 steps or degrees or more from the position of the aperture 28 in the center wheel 25 where the detection unit 13 detected light in the step S127 (step S128), thereby moving the aperture 28 in the center wheel 25 substantially completely away from the detection position P. The center wheel 25 is again rotated clockwise one step from the position to which the center wheel 25 has been returned (step S129). Then, the light emission element 31 is caused to emit light (step S130), and then it is determined if the photo detection unit 32 has received light from the light emission element 31 and hence if the detection unit 13 has detected light (step S131).

Unless in the step S131 the detection unit 13 detects light, the steps S128-S131 are repeated until the center wheel 25 rotates 12 steps or more (step S132). When the center wheel 25 rotates 12 steps in the step S132, the detection unit 13 should necessarily detect light in the step S131. Otherwise, a hand position detection error is reported with indication of a stop position of the seconds hand 2 or buzzer sound (step S133). If the detection unit 13 detects light in the step S131, it is determined that the position of the aperture 28 in the center wheel 25 at this time is the reference or 00-minute position in the center wheel 25 (step S134), thereby terminating this process.

When it is determined in the step S127 that the center wheel 25 has been rotated the predetermined number of (12) steps or more, the apertures 30 and 28 in the intermediate and center wheels 23 and 25 have aligned with the detection position P after the intermediate wheel 23 has made one rotation or more and the aperture 28 in the center wheel 25 has been rotated 12 degrees or more. Thus, it can be said that the center and intermediate wheels 25 and 23 have encountered the states of FIG. 11A-11M. Thus, even if there are assembly or manufacturing errors in the wristwatch, this process is not influenced adversely. Therefore, the position of the aperture 28 in the center wheel 25 where the detection unit 13 detected light in the step S124 is determined as the reference or 00-minute position in the center wheel 25 in the step S134 by omitting the center hand position confirming process involving the steps S128 to S133, thereby terminating this process.

As described above, the modification of the hand position detecting device includes the CPU 35 which composes counting means which counts the number of steps each of which the center wheel 25 rotates at a time (step S122); the RAM 37 which composes a storage which stores the number of steps, each of which the center wheel 25 has been rotated at a time until the detection unit 13 detects light; and the CPU 35 which also composes resetting means which resets the counter when the detection unit 13 detects no light even when the center wheel 25 makes one rotation (step S120). Thus, when the seconds wheel 20 blocks or covers the detection position P and the detection unit 13 optically detects no aperture 28 in the seconds wheel 25, the resetting means resets and clears the number of steps counted so far so as to allow to correctly count the number of steps each of which the center wheel 25 has been rotated at a time. Thus, it can be determined if the counted number of steps stored indicates the predetermined number of steps.

In this modification, further, the CPU 35 which also composes the center position determining means which determines the position of the aperture in the center wheel 25, where the detection unit 13 detected light, as the reference position in the center wheel 25 (step S127), by omitting the respective processings to be performed in the center hand returning means and the center hand position determining means, when the number of steps stored in the RAM 37, each of which steps the center wheel 25 has been rotated at a time, is a predetermined number of (12) step or more. Thus, when it is determined that the number of steps stored in the RAM 37 is a predetermined number of (12) steps or more, the apertures 30 and 28 in the intermediate and center wheels 23 and 25 have aligned with the detection potion P after the intermediate wheel 23 has made one rotation or more and the aperture 28 in the center wheel 25 has been rotated 12 degrees or more. Thus, even if the processes for confirming the center wheel 25, or more particularly the respective processes to be performed by the center hand returning means and the center hand position confirming means (steps S128-S135), are omitted, the reference position in the center wheel 25 is specified accurately.

(First Modification of the Seconds Wheel)

While in the embodiment the seconds wheel 20 is illustrated as having arcuate light-passing apertures 21*b* and 21*c*, the seconds wheel 20 may be constructed as shown in a first modification in FIG. 27. More particularly, in the seconds wheel 20, the arcuate aperture 21*b* is divided into shorter arcuate apertures 40*a*, 40*b* and the arcuate aperture 21*c* into shorter arcuate apertures 41*a*, 41*b*.

In this case, the arcuate aperture 40*a* adjacent to the circular aperture 21*a* in the counterclockwise direction extends from approximately 48 degrees to approximately 96 degrees counterclockwise relative to center of the circular aperture 21*a*, or through a net angular extent of approximately 60 degrees which is 5 times an angle of the circular aperture 21*a* as viewed from the center of the seconds wheel 20. The arcuate aperture 40*b* also extends from approximately 120 degrees to approximately 168 degrees counterclockwise relative to the circular aperture 21*a*, or through a net angular extent of approximately 60 degrees which is 5 times the angle of the circular aperture 21*a* as viewed from the center of the seconds wheel 20. A fifth light blocking area 42 in the seconds wheel 20 is provided between the arcuate apertures 40*a* and 40*b* so as to be diametrically opposed to a part of the arcuate aperture 41*a* in the seconds wheel 20.

The arcuate aperture 41*a* adjacent to the circular aperture 21*a* in the clockwise direction extends from approximately 60 degrees to approximately 96 degrees clockwise relative to the aperture 21*a*, or through a net angular extent of approximately 48 degrees which is 4 times the angle of the circular aperture 21*a* as viewed from the center of the seconds wheel 20. The arcuate aperture 41*b* extends from approximately 120 degrees to approximately 168 degrees clockwise relative to the circular aperture 21*a* along the periphery of the seconds wheel 20, or through a net angular extent of approximately 60 degrees which is approximately 5 times the angle of the circular aperture 21*a* as viewed from the center of the seconds wheel 20. A sixth light blocking area 43 is provided between the arcuate apertures 41*a* and 41*b* in the seconds wheel 20 so as to be substantially diametrically opposed to the arcuate aperture 40*a* in the seconds wheel 20.

A first light blocking area 21*d* is provided between the circular aperture 21*a* and the arcuate aperture 40*a*. A second light blocking area 21*e* is provided between the circular aperture 21*a* and the arcuate aperture 41*a*. A third light blocking area 21*f* is provided between the arcuate apertures 40*b* and 41*b* so as to be diametrically opposed to the circular aperture 21*a* in the seconds wheel 20.

Also in this case, the first light blocking area 21*d* is provided so as to extend through approximately 48 degrees counterclockwise relative to the circular aperture 21*a*, or through a net angular extent of approximately 36 degrees which is approximately 3 times the angle of the circular aperture 21*a*, as viewed from the center of the seconds wheel 20. The first light blocking area 21*d* also is diametrically opposed to part of the arcuate aperture 41*b* in the seconds wheel 20. The second light blocking area 21*e* extends through approximately 60 degrees clockwise relative to the circular aperture 21*a*, or through a net angular extent of approximately 48 degrees which is approximately 4 times the angle of the circular aperture 21*a*, as viewed from the center of the seconds wheel 20. The second light blocking area 21*e* also is diametrically opposed to the arcuate aperture 40*b* in the seconds wheel 20. Each of the light blocking areas 21*f*, 42 and 43 is substantially the same size as the circular aperture 21*a*. The light blocking area 21*f* is diametrically opposed to the circular aperture 21*a* in the seconds wheel 20; the light blocking area 42 is diametrically opposed to part of the arcuate aperture 41*a*; and the light blocking area 43 is diametrically opposed to part of the arcuate aperture 40*a*.

The arrangement is such that when the seconds wheel 20 rotates 30 steps or 180 degrees from a state in which a relevant one of the light blocking areas 21*d*, 21*f*, 42 and 43 has covered the detection position P, a relevant one of the circular aperture 21*a* and the arcuate apertures 40*a*, 40*b*, 41*a* and 41*b* aligns wholly or partially with the detection position P. Thus, this modification produces similar advantages to those produced by the previous embodiment. In addition, the light blocking area 42 is provided between the arcuate apertures 40*a* and 40*b* and the light blocking area 43 between the arcuate apertures 41*a* and 41*b*. Thus, the mechanical strength of the seconds wheel 20 is improved compared to the previous embodiment.

(Second Modification of the Seconds Wheel)

In the above embodiment and the first modification of the seconds wheel 20, the first light blocking area 21*d*, which indicates a separation between the arcuate aperture 21*b* and the circular aperture 21*a*, is illustrated as extending through approximately 48 degrees relative to the circular aperture 21*a*, or through a net angular extent of approximately 36 degrees which is approximately 3 times the angle of the circular aperture 21*a* as viewed from the center of the seconds wheel 20. The second light blocking area 21*e*, which indicates a separation between the circular aperture 21*a* and the arcuate aperture 21*c*, is illustrated as extending through approximately 60 degrees relative to the circular aperture 21*a*, or through a net angular extent of approximately 48 degrees which is approximately 4 times the angle of the circular aperture 21*a*, as viewed from the center of the seconds wheel 20.

Figure 30:
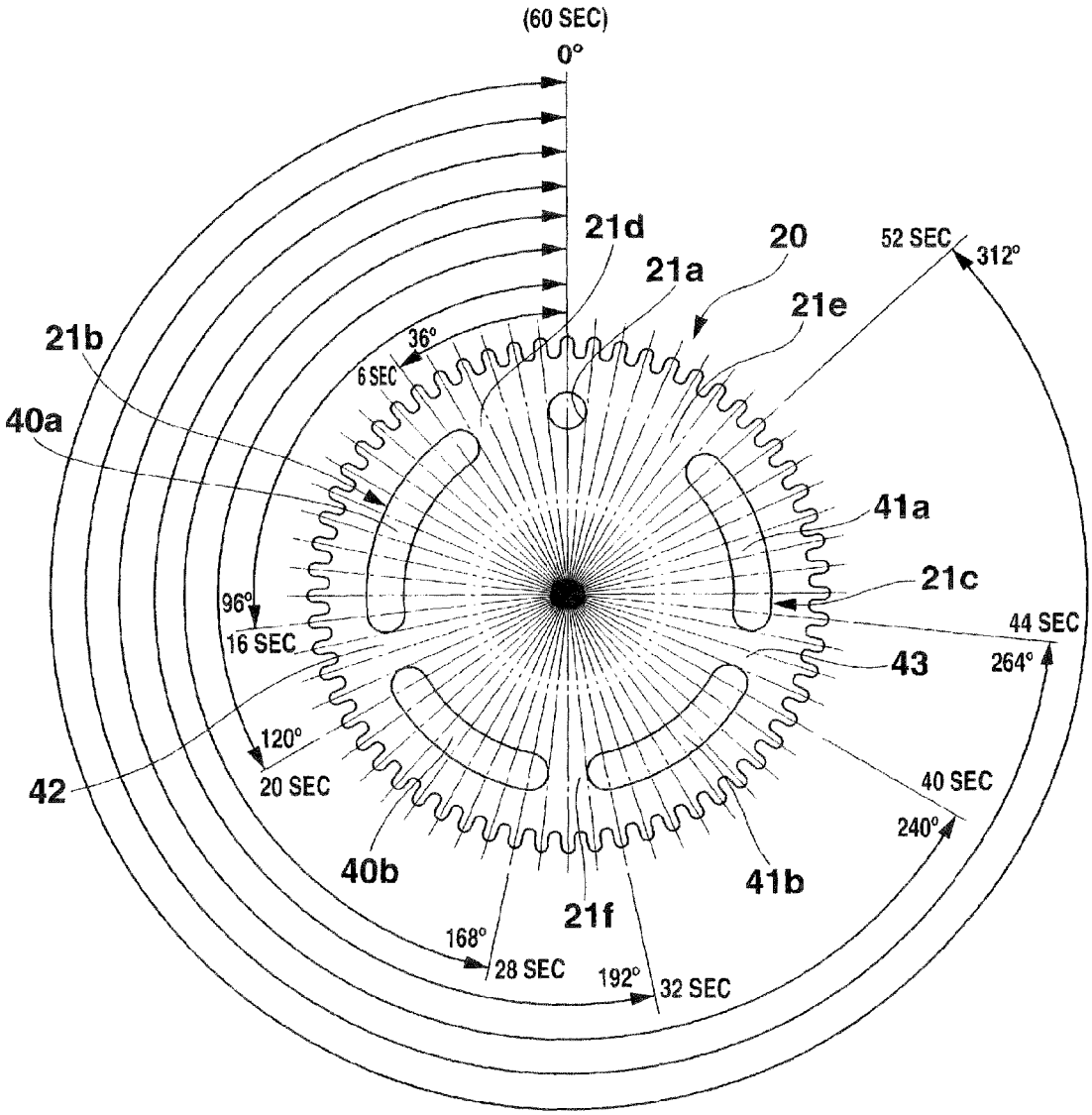
FIG. 30 is an enlarged plan view of a second modification of the seconds wheel.

Alternatively, a second modification of the seconds wheel 20 as shown in FIG. 30 may be employed. In this modification, a first light blocking area 21*d*, which indicates a separation between the second arcuate aperture 21*b* and the circular aperture 21*a*, extends through approximately 36 degrees counterclockwise relative to the circular aperture 21*a*, or through a net angular extent of approximately 24 degrees which is approximately twice the angle of the circular aperture 21*a* as viewed from the center of the seconds wheel 20. A second light blocking area 21*e*, which indicates a separation between the third arcuate aperture 21*c* and the circular aperture 21*a*, extends through approximately 48 degrees counterclockwise relative to the circular aperture 21*a*, or through a net angular extent of approximately 36 degrees which is approximately 3 times the angle of the circular aperture 21*a*, as viewed from the center of the seconds wheel 20.

Like the first modification, the second modification has the arcuate aperture 21*b* which is divided into shorter arcuate apertures 40*a* and 40*b* with a fifth light blocking area 42 in between. The aperture 40*a* extends from approximately 36 degrees to approximately 96 degrees counterclockwise relative to the circular aperture 21*a*, or longer toward the circular aperture 21*a* by an net angular extent of the angle of the circular aperture 21*a* as viewed from the center of the seconds wheel 20 than the arcuate aperture 40*a* in the first modification.

Like the first modification, the second modification has the arcuate aperture 21*c* which is divided into shorter arcuate apertures 41*a* and 41*b* with a fourth light blocking area 43 in between. The aperture 41*a* adjacent to the circular aperture 21*a* extends from approximately 264 degrees to approximately 312 degrees counterclockwise relative to the circular aperture 21*a*, or longer toward the circular aperture 21*a* by a net angular extent of the angle of the circular aperture 21*a*, as viewed from the center of the seconds wheel 20, than the arcuate aperture 41*a* in the first modification.

Also in this case, the first light blocking area 21*d* between the arcuate aperture 21*b* and the circular hole 21*a* is diametrically opposed to part of the arcuate aperture 41*b* in the seconds wheel 20. The second light blocking area 21*e* between the arcuate aperture 21*c* and the circular hole 21*a* is diametrically opposed to the arcuate aperture 40*b* in the seconds wheel 20. In addition, the arcuate aperture 21*f* is diametrically opposed to the circular aperture 21*a* in the seconds wheel 20; the arcuate aperture 42 is diametrically opposed to the arcuate aperture 41*a* in the seconds wheel 20; and the arcuate aperture 43 is diametrically opposed to the circular aperture 41*a* in the seconds wheel 20.

This modification is fabricated such that when the seconds wheel 20 rotates 30 steps or 180 degrees, from the state in which one of the light blocking areas 21*d*, 21*f*, 42 and 43 has aligned wholly or partially with the detection position P of the detection unit 13, a relevant one of the circular aperture 21*a* and the arcuate apertures 40*a*, 40*b*, 41*a* and 41*b* aligns wholly or partially with the detection position P. Thus, this modification also produces advantages similar to those produced by the embodiment and first modification as well as the following additional advantages.

As described above, the first light blocking area 21*d* between the arcuate aperture 21*b* and the circular aperture 21*a* is provided so as to extend through approximately 36 degrees relative to the circular aperture 21*a*, or through a net angular extent of approximately 24 degrees which is approximately twice the angle of the circular aperture 21*a*, as viewed from the center of the seconds wheel 20. Thus, assume that when the seconds wheel 20 rotates one step or 6 degrees at a time in the normal manner and the seconds hand 2 rotates around the dial. In this case, when the seconds wheel 20 rotates four steps or 24 degrees, the first light blocking area 21*d* passes through the detection position P. When the seconds wheel 20 is rotated further two steps or 6 seconds, the arcuate aperture 40*a* aligns partially with the detection position P. Thus, the rotational position of the seconds wheel 20 can be confirmed in 6 seconds after the first light blocking area 21*d* has passed the detection position P. Therefore, when the watch hands should be set within 60 minutes from the related o'clock hour, it is confirmed more quickly in this modification than in the above-mentioned embodiment if the seconds hand 2 is set correctly in the normal rotating operation.

The light blocking area 21*e* between the arcuate aperture 21*c* and the circular aperture 21*a* is provided so as to extend through approximately 48 degrees relative to the circular aperture 21*a*, or through a net angular extent of approximately 36 degrees which is approximately three times the angle of the circular aperture 21*a*, as viewed from the center of the seconds wheel 20. Assume that the number of successive non-detection events the detection unit 13 has encountered due to the second blocking area 21*e* blocking the detection position P is counted by rotating the seconds wheel 20 two steps or 12 degrees at a time. When light passing through the circular aperture 21*a* is detected by the detection unit 13 after three successive non-detection events are counted, the position of that aperture in the seconds wheel 20 is determined as its reference or 00-second position. Thus, the reference position of the seconds hand 2 is detected more quickly than in the embodiment.

In the above embodiment, its modification and the modifications of the seconds wheel, it is illustrated that the optical detection controlling means stops the detection of the positions of the hands 2, 3 and 4 only for the time period ranging from when the third or last one of the three successive hand position detection errors has occurred to several minutes before the specified next 11 o'clock hour, or more particularly the 55th minute of the specified next 10 o'clock hour. However, the present invention is not limited to this particular case. For example, arrangement may be such that the position detection controlling means stops the detection of the positions of the hands 2, 3 and 4 only for the time period ranging from when the third or last one of the three successive hand position detection errors has occurred to the end of a time zone in the daytime or nighttime where the user has decided not to use of the wristwatch; for example, 10:00 p.m.-06:00 a.m. for which people are presumed to sleep, thereby greatly reducing useless consumption of battery power which would otherwise occur.

While in the embodiment, its modification and the modifications of the seconds wheel 20 the time when the hand positions are detected in the normal hand rotating operation is illustrated as being the 55th minute of every hour on the hour, it is not necessarily required to be so. It may be several minutes, for example between 55 and 59 minutes, before every hour on the hour. While in the embodiment, its modification and the modifications of the seconds wheel 20 the apertures 21*a*, 28 and 29 provided in the seconds, center and hour wheels 20, 25 and 27 are illustrated as circular, they may be of another form: for example, square, trapezoidal or polygonal.

While in the above embodiment, its modification and the modifications of the seconds wheel the hand-type wristwatches according to the present invention are illustrated, the invention is applicable to other hand-type timepieces such as travelers' clocks or watches, alarm clocks, table or desk clocks, wall clocks, etc.

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A hand position detecting device comprising:

an optical detection unit configured to detect passage or non-passage of light through a first light-passing aperture in a seconds hand unit, a second light-passing aperture in a minute hand unit, eleven third light-passing apertures in 1-12 o'clock positions of an hour hand unit except at a specified o'clock position, and a fourth light-passing aperture in an intermediate wheel;

a hand position detecting unit configured to optically detect positions of the seconds hand unit, the minute hand unit, and the hour hand unit based on a transmitted state or a non-transmitted state of light detected by the optical detection unit; and a hand position detection stopping unit configured to optically detect the positions of the seconds hand unit, the minute hand unit, and the hour hand unit by the hand position detecting unit at a time which occurs several minutes before every hour and to stop hand position detection by the hand position detecting unit when a number of times that the hand position detecting unit has successively failed to detect the positions of the seconds hand unit, the minute hand unit, and the hour hand unit has exceeded a predetermined number of times, the hand position detection being stopped until a predetermined time.

2. The hand position detecting device according to claim 1, further comprising:

a hand position detection continuing unit configured to optically detect the positions of the seconds hand unit, the minute hand unit, and the hour hand unit by the hand position detecting unit at the time which occurs several minutes before every hour and to continue hand position detection by the hand position detection unit when the positions of the seconds hand unit, the minute hand unit, and the hour hand unit are optically detected by the hand position detection unit.

3. A hand position detecting device comprising:

an optical detection unit configured to detect passage or non-passage of light through a first light-passing aperture in a seconds hand unit, a second light-passing aperture in a minute hand unit, eleven third light-passing apertures in 1-12 o'clock positions of an hour hand unit except at a specified o'clock position, and a fourth light-passing aperture in an intermediate wheel;

a hand position detecting unit configured to optically detect positions of the seconds hand unit, the minute hand unit, and the hour hand unit based on a transmitted state or a non-transmitted state of light detected by the optical detection unit;

a position detection error reporting unit configured to optically detect the positions of the seconds hand unit, the minute hand unit, and the hour hand unit by the hand position detecting unit at a time which occurs several minutes before every hour and to report to a user a hand position detection error indicating that the positions of the seconds hand unit, the minute hand unit, and the hour hand unit are not detected based on an optical detection by the hand position detecting unit; and a hand position detection stopping unit configured to determine if the hand position detecting unit has failed to detect the positions of the seconds hand unit, the minute hand unit, and the hour hand unit successively a predetermined number of times, and to stop hand position detection by the hand position detecting unit for a time period ranging from a time when the hand position detecting unit has failed to detect the positions of the positions of the seconds hand unit, the minute hand unit, and the hour hand unit successively the predetermined number of times and to a time which is several minutes before a predetermined hour.

4. The hand position detecting device according to claim 3, further comprising:

a hand position detection continuing unit configured to optically detect the positions of the seconds hand unit, the minute hand unit, and the hour hand unit by the hand position detecting unit at the time which occurs several minutes before every hour and to continue hand position detection by the hand position detection unit when the positions of the seconds hand unit, the minute hand unit, and the hour hand unit are optically detected by the hand position detection unit.

5. A hand position detecting method comprising:

a hand position detection step to optically detect positions of a seconds hand unit, a minute hand unit, and an hour hand unit based on passage or non-passage of light detected by an optical detection unit configured to detect passage or non-passage of light through a first light-passing aperture in the seconds hand unit, a second light-passing aperture in the minute hand unit, eleven third light-passing apertures in 1-12 o'clock positions of the hour hand unit except at a specified o'clock position, and a fourth light-passing aperture in an intermediate wheel; and a hand position detection stopping step to optically detect the positions of the seconds hand unit, the minute hand unit, and the hour hand unit by the hand position detection step at a time which occurs several minutes before every hour and to stop hand position detection by the hand position detection step when a number of times that the hand position detection step has successively failed to detect the positions of the seconds hand unit, the minute hand unit, and the hour hand unit has exceeded a predetermined number of times, the hand position detection being stopped until a predetermined time.

6. The hand position detecting method according to claim 5, further comprising:

a hand position detection continuing step to optically detect the positions of the seconds hand unit, the minute hand unit, and the hour hand unit by the hand position detection step at the time which occurs several minutes before every hour and to continue hand position detection by the hand position detection step when the positions of the seconds hand unit, the minute hand unit, and the hour hand unit are optically detected by the hand position detection step.

7. A hand position detecting method comprising:

a hand position detection step to optically detect positions of a seconds hand unit, a minute hand unit, and an hour hand unit based on passage or non-passage of light detected by an optical detection unit configured to detect passage or non-passage of light through a first light-passing aperture in the seconds hand unit, a second light-passing aperture in the minute hand unit, eleven third light-passing apertures in 1-12 o'clock positions of the hour hand unit except at a specified o'clock position, and a fourth light-passing aperture in an intermediate wheel;

a position detection error reporting step to optically detect the positions of the seconds hand unit, the minute hand unit, and the hour hand unit by the hand position detection step at a time which occurs several minutes before every hour and to report to a user a hand position detection error indicating that the positions of the seconds hand unit, the minute hand unit, and the hour hand unit are not detected based on an optical detection by the hand position detection step; and a hand position detection stopping step to determine if the hand position detection step has failed to detect the positions of the seconds hand unit, the minute hand unit, and the hour hand unit successively a predetermined number of times, and to stop hand position detection by the hand position detection step for a time period ranging from a time when the hand position detection step has failed to detect the positions of the seconds hand unit, the minute hand unit, and the hour hand unit successively the predetermined number of times and to a time which is several minutes before a predetermined hour.

8. The hand position detecting method according to claim 7, further comprising:

a hand position detection continuing step to optically detect the positions of the seconds hand unit, the minute hand unit, and the hour hand unit by the hand position detection step at the time which occurs several minutes before every hour and to continue hand position detection by the hand position detection step when the positions of the seconds hand unit, the minute hand unit, and the hour hand unit are optically detected by the hand position detection step.

* * * * *